US009701498B2

(12) United States Patent
Kodama et al.

(10) Patent No.: US 9,701,498 B2
(45) Date of Patent: Jul. 11, 2017

(54) CORRUGATED PAPERBOARD SHEET FEEDING APPARATUS

(71) Applicant: KABUSHIKI KAISHA ISOWA, Nagoya-shi, Aichi (JP)

(72) Inventors: Junichi Kodama, Kasugai (JP); Shunsuke Miyashita, Nagoya (JP); Kyohei Asano, Hashima (JP); Hiroshi Yamazaki, Kasugai (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 0 days.

(21) Appl. No.: 14/990,346

(22) Filed: Jan. 7, 2016

(65) Prior Publication Data

US 2016/0200532 A1 Jul. 14, 2016

(30) Foreign Application Priority Data

Jan. 9, 2015 (JP) ..... 2015-003714
Jan. 31, 2015 (JP) ..... 2015-018012

(51) Int. Cl.
*B65H 5/00* (2006.01)
*B65H 3/06* (2006.01)
*B65H 7/18* (2006.01)

(52) U.S. Cl.
CPC ..... *B65H 3/063* (2013.01); *B65H 3/0607* (2013.01); *B65H 7/18* (2013.01);
(Continued)

(58) Field of Classification Search
CPC ..... B65H 3/063; B65H 2403/514; B65H 2403/532; B65H 2403/5321
See application file for complete search history.

(56) References Cited

U.S. PATENT DOCUMENTS 3,486,749 A * 12/1969 Billings ..... G06K 13/103 271/112
4,889,331 A * 12/1989 Sardella ..... B65H 3/063 271/105

(Continued)

FOREIGN PATENT DOCUMENTS

JP 05-050329 A 3/1993
JP 11-272312 A 10/1999

(Continued)

*Primary Examiner* — Howard Sanders
(74) *Attorney, Agent, or Firm* — Brinks Gilson & Lione

(57) ABSTRACT

Disclosed is a corrugated paperboard sheet feeding apparatus which comprises: a plurality of sheet feeding rollers rotatable to feed a bottommost one of a plurality of stacked corrugated paperboard sheets; an up-and-down member movable up and down with respect to the plurality of sheet feeding rollers; a drive motor; a motion conversion mechanism configured to convert a unidirectional rotation of the drive motor into a motion for causing the up-and-down member to be moved up and lowered, and transmit the converted motion to the up-and-down member; and an up-and-down control section configured to perform variable speed control for the unidirectional rotation of the drive motor, according to a given up-and-down speed control pattern, wherein the up-and-down control section is operable to change the up-and-down speed control pattern in conformity to a sheet length of the corrugated paperboard sheet in a feeding direction.

8 Claims, 20 Drawing Sheets

(52) U.S. Cl.
CPC .. *B65H 2403/514* (2013.01); *B65H 2403/532* (2013.01); *B65H 2403/82* (2013.01); *B65H 2511/11* (2013.01); *B65H 2511/20* (2013.01); *B65H 2513/10* (2013.01); *B65H 2513/11* (2013.01); *B65H 2701/1762* (2013.01)

(56) References Cited

U.S. PATENT DOCUMENTS

| | | | | | |
|---|---|---|---|---|---|
| 5,048,812 | A | | 9/1991 | Holmes | |
| 5,172,898 | A | | 12/1992 | Takahashi | |
| 5,184,811 | A | * | 2/1993 | Sardella | B65H 3/063 271/10.11 |
| 5,219,157 | A | | 6/1993 | Takahashi | |
| 5,307,549 | A | | 5/1994 | Tsutsumi et al. | |
| 6,543,760 | B1 | | 4/2003 | Andren | |
| 9,162,834 | B1 | * | 10/2015 | Lee | B65H 3/063 |

FOREIGN PATENT DOCUMENTS

| | | | |
|---|---|---|---|
| JP | 2003-127251 | A | 5/2003 |
| JP | 2006-072399 | A | 3/2006 |
| JP | 2009-291992 | A | 12/2009 |
| JP | 5081703 | B2 | 11/2012 |

* cited by examiner

CORRUGATED PAPERBOARD SHEET FEEDING APPARATUS

RELATED APPLICATIONS

This application claims priority under 35 U.S.C. §119 to Japanese Patent Application Nos. 2015-003714 filed on Jan. 9, 2015 and 2015-018012 filed on Jan. 31, 2015, the entire contents of which are hereby incorporated by reference.

BACKGROUND OF THE INVENTION

1. Field of the Invention

The present invention relates to a corrugated paperboard sheet feeding apparatus for feeding a plurality of stacked corrugated paperboard sheets one-by-one.

2. Description of the Related Art

Heretofore, there have been proposed various types of devices intended to control an up-and-down motion of an up-and-down member with respect to a sheet feeding roller. For example, a sheet-shaped workpiece feeding apparatus described in JP5081703B (Patent Document 1) comprises: a lifter movable up and down with respect to a sheet feeding roller; a servomotor; a crank mechanism for converting a rotational motion of the servomotor to an up-and-down motion of the lifter; and a control circuit. The crank mechanism comprises a crankshaft coupled to a rotary shaft of the servomotor, a plurality of crank arms, and a crank rod. The lifter is coupled to the crank rod, and the crank rod is coupled to the crankshaft via the plurality of crank arms. The control circuit is configured to control a rotation of the servomotor.

SUMMARY OF THE INVENTION

Technical Problem

In the feeding apparatus described in the Patent Document 1, for moving down the lifter with respect to the sheet feeding roller so as to allow a corrugated paperboard sheet to be fed, the servomotor is rotated in a forward direction by a given rotation amount. On the other hand, for moving up the lifter with respect to the sheet feeding roller so as to stop the feeding of a corrugated paperboard sheet, the servomotor is rotated in a backward direction by a given rotation amount. The control circuit is operable to switch a rotational direction of the servomotor from the forward direction to the backward direction, and repeat the switching of the rotational direction, so as to allow a plurality of corrugated paperboard sheets to be sequentially fed.

In the feeding apparatus described in the Patent Document 1, for one cycle of up-and-down motion of the lifter, the rotational direction of the servomotor is switched from the forward direction to the backward between the forward and backward directions direction. Further, in each of the forward and backward rotational directions, the servomotor is rotated by a given rotation amount, through a sequence of changes in operating state, i.e., acceleration, deceleration and stopping. However, the crank mechanism having relatively large inertia is coupled to the rotary shaft of the servomotor, and thereby it is not easy to rotate the servomotor in each of the rotational directions exactly by a given rotation amount. In particular, as a corrugated paperboard sheet feeding speed becomes higher, it becomes more difficult to rotate the servomotor in each of the rotational directions exactly at a given timing by a given rotation amount, so that there is a risk of failing to accurately feed each corrugated paperboard sheet.

The present invention has been made in view of the above circumstances, and an object thereof is to provide a corrugated paperboard sheet feeding apparatus capable of moving up and down an up-and-down member according to a unidirectional rotation of a drive motor and changing an up-and-down speed control pattern in conformity to a sheet length of a corrugated paperboard sheet to thereby accurately feed each corrugated paperboard sheet.

Solution to Technical Problem

In order to achieve the above object, according to a first aspect of the present invention, there is provided a corrugated paperboard sheet feeding apparatus which comprises: a plurality of sheet feeding rollers rotatable to feed a bottommost one of a plurality of stacked corrugated paperboard sheets; an up-and-down member movable up and down with respect to the plurality of sheet feeding rollers; a drive motor for causing the up-and-down member to be moved up and down; a motion conversion mechanism configured to convert a unidirectional rotation of the drive motor into a motion for causing the up-and-down member to be moved up and down, and transmit the converted motion to the up-and-down member; and an up-and-down control section configured to perform variable speed control for the unidirectional rotation of the drive motor, according to a given up-and-down speed control pattern, wherein the up-and-down control section is operable to change the up-and-down speed control pattern in conformity to a sheet length of the corrugated paperboard sheet in a feeding direction.

In the corrugated paperboard sheet feeding apparatus of the present invention having the above feature, as compared to a conventional corrugated paperboard sheet feeding apparatus configured to rotate a drive motor in each of forward and backward rotational directions by a given rotation amount, through a sequence of changes in operating state, i.e., acceleration, deceleration and stopping, it becomes possible to accurately feed each corrugated paperboard sheet.

In the first aspect of the present invention, the up-and-down control section may store therein a plurality of types of up-and-down speed control patterns preliminarily prepared in conformity to different sheet lengths, or may be configured to calculate the up-and-down speed control pattern based on a sheet length of a target corrugated paperboard sheet in each case.

Preferably, in the corrugated paperboard sheet feeding apparatus of the present invention, the up-and-down control section is operable to change the up-and-down speed control pattern, based on the sheet length of the corrugated paperboard sheet in the feeding direction, and a feeding speed of the corrugated paperboard sheet.

This feature makes it possible to create an optimal up-and-down speed control pattern in response to a change in sheet length or feeding speed and thus more accurately feed each corrugated paperboard sheet.

In this case, in addition to the sheet length and the feeding speed, the up-and-down control section may be configured to calculate the up-and-down speed control pattern while taking into account other factor, such as a period of use of the up-and-down member, in terms of wear of a sheet contact surface of the up-and-down member.

Preferably, in the corrugated paperboard sheet feeding apparatus of the present invention, the up-and-down speed control pattern is set to cause the up-and-down member to undergo one cycle of up-and-down motion, wherein the up-and-down speed control pattern comprises: a first region for moving down the up-and-down member which is located above the plurality of sheet feeding rollers, the first region comprising sub-regions for acceleration and deceleration of the drive motor; a second region for controlling the rotation of the drive motor to allow the up-and-down member to be located below the plurality of sheet feeding rollers; a third region for moving up the up-and-down member which is located below the plurality of sheet feeding rollers, the third region comprising sub-regions for acceleration and deceleration of the drive motor; and a fourth region for controlling the rotation of the drive motor to allow the up-and-down member to be located above the plurality of sheet feeding rollers.

This feature makes it possible to change the up-and-down of the up-and-down member easily and accurately by controlling the unidirectional rotation of the drive motor, in the four regions of the up-and-down speed control pattern.

In this case, when the rotation of the drive motor is controlled in the second region and the fourth region, the drive motor may be rotationally stopped or may be rotated at a relatively low speed.

Preferably, in the above corrugated paperboard sheet feeding apparatus, the up-and-down control section is operable to change a time interval between the first region and the third region and the first region of the up-and-down speed control pattern, in conformity to the sheet length, in such a manner that, as the sheet length of the corrugated paperboard sheet in the feeding direction becomes longer, a duration of the second region becomes longer, and a duration of the fourth region becomes shorter.

In the corrugated paperboard sheet feeding apparatus having this feature, the up-and-down motion of the up-and-down member can be changed in conformity to the sheet length by changing the duration of the second region and the duration of the fourth region, so that it becomes possible to change the up-and-down motion easily and accurately, as compared to a conventional corrugated paperboard sheet feeding apparatus configured to adjust a position of a mechanical element such as an up-and-down control cam.

Preferably, the above corrugated paperboard sheet feeding apparatus further comprises: a roller motor for rotating the plurality of sheet feeding rollers; and a roller control section configured to operate in synchronization with the variable speed control by the up-and-down control section, to perform variable speed control for a rotation of the roller motor, according to a roller speed control pattern, wherein: the roller control section is operable to change the roller speed control pattern in conformity to a maximum sheet length of the corrugated paperboard sheet feedable in the feeding direction, and a feeding speed of the corrugated paperboard sheet; and the roller speed control pattern is set to cause the plurality of sheet feeding rollers to operate to feed one corrugated paperboard sheet, wherein the roller speed control pattern comprises: a stopping region for stopping the rotation of the roller motor; an acceleration region for accelerating the roller motor from a stopped state thereof to a given rotational speed corresponding to the feeding speed; a constant-speed region for rotating the roller motor at a given rotational speed; and a deceleration region for decelerating the roller motor from the given rotational speed to the stopped state.

This feature makes it possible to change a rotational operation state of the plurality of sheet feeding rollers according to a change in the maximum sheet length or feeding speed, easily and accurately, by controlling the rotation of the roller motor, in the four regions of the roller speed control pattern.

In this case, the roller control section may store therein a plurality of types of roller speed control patterns preliminarily prepared in conformity to different maximum sheet lengths and feeding speeds, or may be configured to calculate the roller speed control pattern based on a maximum sheet length and a feeding speed of a target corrugated paperboard sheet in each case.

Preferably, in the above corrugated paperboard sheet feeding apparatus, each of the up-and-down control section and the roller control section is operable to set a respective one of the up-and-down speed control pattern and the roller speed control pattern, in such a manner that the second region of the up-and-down speed control pattern and a combination of the acceleration region and the constant-speed region of the roller speed control pattern overlap each other in terms of control timing, and the upper-position control region of the up-and-down speed control pattern and the deceleration region of the roller speed control pattern overlap each other in terms of control timing, wherein a rate of change of speed per unit time at which the rotation of the roller motor is accelerated in the acceleration region of the roller speed control pattern is set to be greater than a rate of change of speed per unit time at which the rotation of the roller motor is decelerated in the deceleration region of the roller speed control pattern.

This feature makes it possible to increase the maximum sheet length feedable by the plurality of sheet feeding rollers, as compared to the case where the rate of change of speed per unit time during the acceleration is set to be less than the rate of change of speed per unit time during the deceleration.

Preferably, in the above corrugated paperboard sheet feeding apparatus, the up-and-down control section is operable, in the lower-position control region of the up-and-down speed control pattern, to stop the rotation of the drive motor so as to keep the up-and-down member at a lower position below the plurality of sheet feeding rollers, and, in the fourth region the up-and-down speed control pattern, to stop the rotation of the drive motor so as to keep the up-and-down member at an upper position above the plurality of sheet feeding rollers, and the roller control section is operable to set the roller speed control pattern, in such a manner that the constant-speed region of the roller speed control pattern is continued until a bottommost one of the corrugated paperboard sheets is spaced apart the plurality of sheet feeding rollers when the up-and-down member is moved up from the lower position toward the upper position, wherein the constant-speed region is terminated before termination of the third region of the up-and-down speed control pattern set in conformity to the maximum sheet length.

This feature makes it possible to increase a duration of the constant-speed region while ensuring a required duration of the deceleration region in the roller speed control pattern, and thus reliably feed a relatively long corrugated paperboard sheet.

Preferably, in the corrugated paperboard sheet feeding apparatus of the present invention, the motion conversion mechanism comprises: a drive shaft configured to receive transmission of the unidirectional rotation of the drive motor to rotate 360 degrees during one cycle of up-and-down motion of the up-and-down member; an eccentric member formed eccentrically with respect to an axis of the drive shaft and fixed to the drive shaft; a support mechanism supporting the up-and-down member in a movable up and down manner; a coupling shaft coupled to the support mechanism; and a swingable member fixed to the coupling shaft and configured to be swung about the coupling shaft while being engaged with the eccentric member, wherein the up-and-down member is configured to undergo the up-and-down motion, according to two contra-directional rotational movements of the coupling shaft along with the swinging motion of the swingable member.

This feature allows the motion conversion mechanism to convert the unidirectional rotation of the drive motor into the two contra-directional rotational movements of the coupling shaft, so that it becomes possible to cause the up-and-down member to undergo a smooth up-and-down motion.

In this case, the drive shaft may be directly coupled to the rotary shaft of the up-and-down drive motor, or may be coupled to the rotary shaft of the up-and-down drive motor via a speed change mechanism such as a gear train.

Preferably, the above corrugated paperboard sheet feeding apparatus comprises a detection section configured to detect a rotational position of the drive shaft and generate a position detection signal, wherein the up-and-down control section is operable to perform variable speed control for the unidirectional rotation of the drive motor, in synchronization of the position detection signal from the detection section.

This feature makes it possible to accurately cause the up-and-down member to undergo the up-and-down motion, following the rotational position of the drive shaft.

In this case, the detection section may have a function of detecting a rotation amount of the drive shaft or a rotational speed of the drive shaft, in addition to detecting the rotational position of the drive shaft serving as a reference position.

Preferably, the corrugated paperboard sheet feeding apparatus of the present invention comprises a mode setting section configured to selectively set one of a one-sheet feeding mode for feeding one corrugated paperboard sheet in a given processing cycle during which a printing cylinder of a printing apparatus is rotated 360 degrees, and a two-sheet feeding mode for sequentially feeding two corrugated paperboard sheets in the given processing cycle, wherein the up-and-down control section is operable to change the up-and-down speed control pattern in conformity to one of the feeding modes set by the mode setting section.

This feature makes it possible to change the up-and-down speed control pattern to thereby switchably perform the one-sheet feeding mode and the two-sheet feeding mode, while preventing an increase in size of the entire apparatus.

Preferably, in the above corrugated paperboard sheet feeding apparatus, the mode setting section comprises an operation section configured to select one of the one-sheet feeding mode and the two-sheet feeding mode, and a display configured to display thereon the selected feeding mode.

This feature makes it possible to operate the operation section of the mode setting section so as to select one of the one-sheet feeding mode and the two-sheet feeding mode, and ascertain the selected feeding mode through a displayed content on the display. Generally, when the feeding mode is changed, it is necessary to perform preparatory works, such as replacement of a printing die member of a printing apparatus, and replacement of a slotter blade. The operator can recognize which of the feeding modes is associated with preparatory works to be performed, through the operation of the operation section and the ascertainment of a displayed content on the display.

According to a second aspect of the present invention, there is provided a corrugated paperboard sheet feeding apparatus which comprises: a plurality of sheet feeding rollers rotatable to feed a bottommost one of a plurality of stacked corrugated paperboard sheets; an up-and-down member movable up and down with respect to the plurality of sheet feeding rollers; a drive motor for causing the up-and-down member to be moved up and down; a motion conversion mechanism configured to convert a unidirectional rotation of the drive motor into a motion for causing the up-and-down member to be moved up and down, and transmit the converted motion to the up-and-down member; an up-and-down control section configured to perform variable speed control for the unidirectional rotation of the drive motor, according to an up-and-down speed control pattern; a roller motor for rotating the plurality of sheet feeding rollers; and a roller control section configured to operate in synchronization with the variable speed control by the up-and-down control section, to perform variable speed control for a rotation of the roller motor, according to a roller speed control pattern, wherein the up-and-down control section is operable to change the up-and-down speed control pattern in conformity to a sheet length of the corrugated paperboard sheet in a feeding direction, and the roller control section is operable to change the roller speed control pattern in conformity to a maximum sheet length of the corrugated paperboard sheet feedable in the feeding direction, and a feeding speed of the corrugated paperboard sheet.

Preferably, in the second aspect of the present invention, the roller control section is operable to set the roller speed control pattern to cause the plurality of sheet feeding rollers to operate to feed one corrugated paperboard sheet, wherein the roller speed control pattern comprises: a stopping region for stopping the rotation of the roller motor; an acceleration region for accelerating the roller motor from a stopped state thereof to a given rotational speed corresponding to the feeding speed; a constant-speed region for rotating the roller motor at a given rotational speed; and a deceleration region for decelerating the roller motor from the given rotational speed to the stopped state.

Preferably, in the above corrugated paperboard sheet feeding apparatus, each of the up-and-down control section and the roller control section is operable to set a respective one of the up-and-down speed control pattern and the roller speed control pattern, in such a manner that the lower-position control region of the up-and-down speed control pattern and a combination of the acceleration region and the constant-speed region of the roller speed control pattern overlap each other in terms of control timing, and the upper-position control region of the up-and-down speed control pattern and the deceleration region of the roller speed control pattern overlap each other in terms of control timing, wherein a rate of change of speed per unit time at which the rotation of the roller motor is accelerated in the acceleration region of the roller speed control pattern is set to be greater than a rate of change of speed per unit time at which the rotation of the roller motor is decelerated in the deceleration region of the roller speed control pattern.

According to a third aspect of the present invention, there is provided a motion conversion mechanism for use in a corrugated paperboard sheet feeding apparatus comprising: a plurality of sheet feeding rollers rotatable to feed a bottommost one of a plurality of stacked corrugated paperboard sheets; an up-and-down member movable up and down with respect to the plurality of sheet feeding rollers; and a drive motor for causing the up-and-down member to be moved up and down, wherein the motion conversion mechanism comprises: a drive shaft configured to receive transmission of a unidirectional rotation of the drive motor to rotate 360 degrees during one cycle of up-and-down motion of the up-and-down member; an eccentric member formed eccentrically with respect to an axis of the drive shaft and fixed to the drive shaft; a support mechanism supporting the up-and-down member in a movable up and down manner; a coupling shaft coupled to the support mechanism; and a swingable member fixed to the coupling shaft and configured to be swung about the coupling shaft while being engaged with the eccentric member, wherein the up-and-down member is configured to undergo the up-and-down motion, according to two contra-directional rotational movements of the coupling shaft along with the swinging motion of the swingable member.

DETAILED DESCRIPTION OF THE PREFERRED EMBODIMENTS

Embodiment

With reference to the accompanying drawings, a corrugated paperboard box making machine 1 equipped with a corrugated paperboard sheet feeding apparatus 2 according to one embodiment of the present invention will now be described. The corrugated paperboard sheet feeding apparatus 2 according to this embodiment is capable of feeding a plurality of stacked corrugated paperboard sheets one-by-one in a selected one of a one-sheet feeding mode for feeding one corrugated paperboard sheet in a given processing cycle during which a printing cylinder of a printing apparatus is rotated 360 degrees, and a two-sheet feeding mode for sequentially feeding two corrugated paperboard sheets in the given processing cycle.

<<Overall Configuration>>

Figure 1:
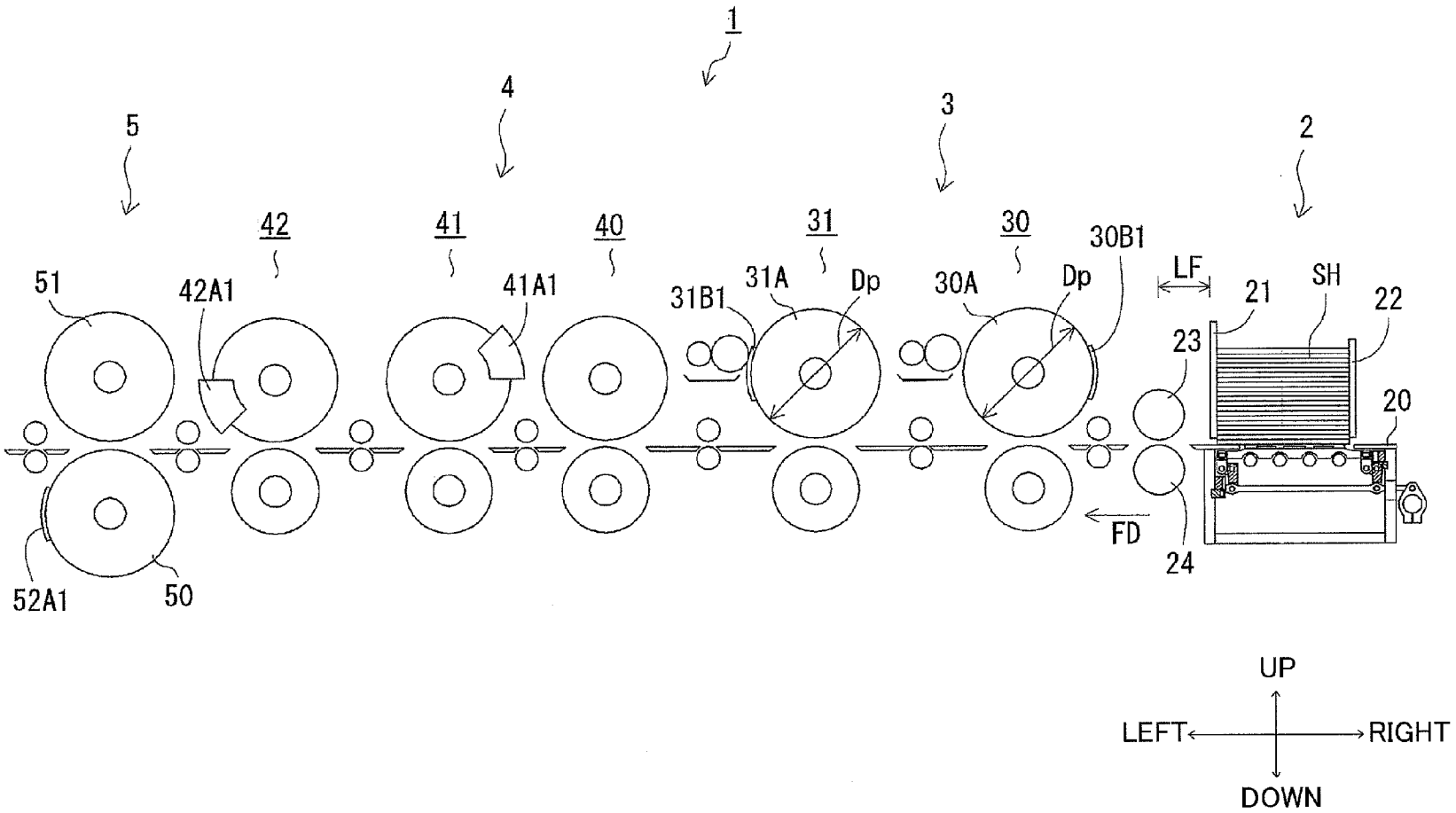
FIG. 1 is a front view illustrating an overall configuration of a corrugated paperboard box making machine with is equipped with a corrugated paperboard sheet feeding apparatus according to one embodiment of the present invention, wherein processing apparatuses of the corrugated paperboard box making machine are prepared for one-sheet feeding mode.

As illustrated in FIG. 1, the corrugated paperboard box making machine 1 is equipped with: the corrugated paperboard sheet feeding apparatus 2 for feeding a plurality of stacked corrugated paperboard sheets SH one-by-one; a printing apparatus 3 for printing the fed corrugated paperboard sheet SH; a creaser-slotter 4 for subjecting the printed corrugated paperboard sheet SH to creasing and slotting and further cutting-out to form a joint flap; and a die cutter 5 for forming a punched-out portion having a given shape in the creased, slotted and cut-out corrugated paperboard sheets SH.

The corrugated paperboard sheet feeding apparatus 2 comprises a table 20. A large number of corrugated paperboard sheets SH are loaded onto the table 20 while being positioned between a front gate 21 and a back guide 22. The front gate 21 is disposed to allow the corrugated paperboard sheets SH to be fed out one-by-one through a gap between the front gate 21 and the table 20. The back guide 22 is configured to be movable with respect to the front gate 21, in a direction parallel to a feeding direction FD, so as to receive a plurality of types of corrugated paperboard sheets having different sheet lengths in the feeding direction FD. The corrugated paperboard sheet feeding apparatus 2 comprises a large number of sheet feeding rollers (124 to 127; see FIG. 2), and a movable up and down grate (141; see FIGS. 2 to 4), and a pair of feed rolls 23, 24. The sheet feeding rollers are configured to, when the grate is moved down below the sheet feeding rollers, come into contact with a bottommost one of the corrugated paperboard sheets SH and feed out the corrugated paperboard sheets SH one-by-one toward the feed rolls 23, 24. The feed rolls 23, 24 are configured to feed the corrugated paperboard sheets SH one-by-one toward the printing apparatus 3. The feed rolls 23, 24 are drivenly coupled to a main drive motor MT. A detailed configuration of the corrugated paperboard sheet feeding apparatus 2 will be described later.

The printing apparatus 3 comprises two printing units 30, 31. Each of the printing units comprises a printing cylinder, a printing die member, an ink applicator, and a press roll. The printing die member is attached to an outer peripheral surface of the printing cylinder. The ink applicator comprises an inking roll for applying ink having a color which is different in each of the printing units. The printing apparatus 3 is configured to subject the fed corrugated paperboard sheet SH to two-color printing by using the two printing units 30, 31, and supply the printed corrugated paperboard sheet SH to the creaser-slotter 4. Each of the printing units 30, 31 is drivenly coupled to the main drive motor MT. The printing cylinders 30A, 31A of the two printing units 30, 31 have the same diameter Dp. The printing die members 30B 1, 31B1 are attached, respectively, to the outer peripheral surfaces of these printing cylinders 30A, 31A. Thus, the printing die members 30B1, 31B1 are operable to subject one corrugated paperboard sheet fed to the printing units 30, 31 in each processing cycle, to two-color printing.

The creaser-slotter 4 comprises one creaser unit 40, and two slotter units 41, 42. The creaser unit 40 comprises a pair of creasing rolls arranged one above the other. Each of the slotter units 41, 42 comprises an upper slotter to which a slotter blade 41A1, 42A1 is attached, and a lower slotter formed with a groove fittable with the slotter blade. The creaser-slotter 4 is configured to subject the printed corrugated paperboard sheet SH to creasing and slotting, and further cutting-out to form a joint flap, by using the creaser unit 40 and the slotter units 41, 42 and supply the creased, slotted and cut-out corrugated paperboard sheet SH to the die cutter 5. Each of the creaser unit 40 and the slotter units 41, 42 is drivenly coupled to the main drive motor MT. The slotter blades 41A1, 42A1 are attached, respectively, to outer peripheral surfaces of the upper slotters of the slotter units 41, 42. Thus, the slotter blade 41A1 is operable to subject a front end of one corrugated paperboard sheet fed to the slotter units 41, 42 in each processing cycle to slotting and cutting-out, and the slotter blade 42A1 is operable to subject a rear end of the corrugated paperboard sheet to slotting and cutting-out.

The die cutter 5 comprises a die cylinder 50, and an anvil cylinder 51 which are disposed across a conveyance path. A punching die 52A1 is attached to a plate-like body made of veneer-core plywood or the like, and the plate-like body with the punching die is wound around an outer peripheral surface of the die cylinder 50. Thus, the punching die 52A1 is operable to subject the creased, slotted and cut-out corrugated paperboard sheet SH being continuously conveyed, to punching to form a hole at a desired position. During order change, the punching die 52A1 can be replaced with another punching die having a punching pattern conforming to a new order. Each of the die cylinder 50 and the anvil cylinder 51 is drivenly coupled to the main drive motor MT. As above, the punching die 52A1 is operable to subject one corrugated paperboard sheet SH fed to the die cutter 5 in each processing cycle, to punching.

<Detailed Configuration of Corrugated Paperboard Sheet Feeding Apparatus 2>

Figure 2:
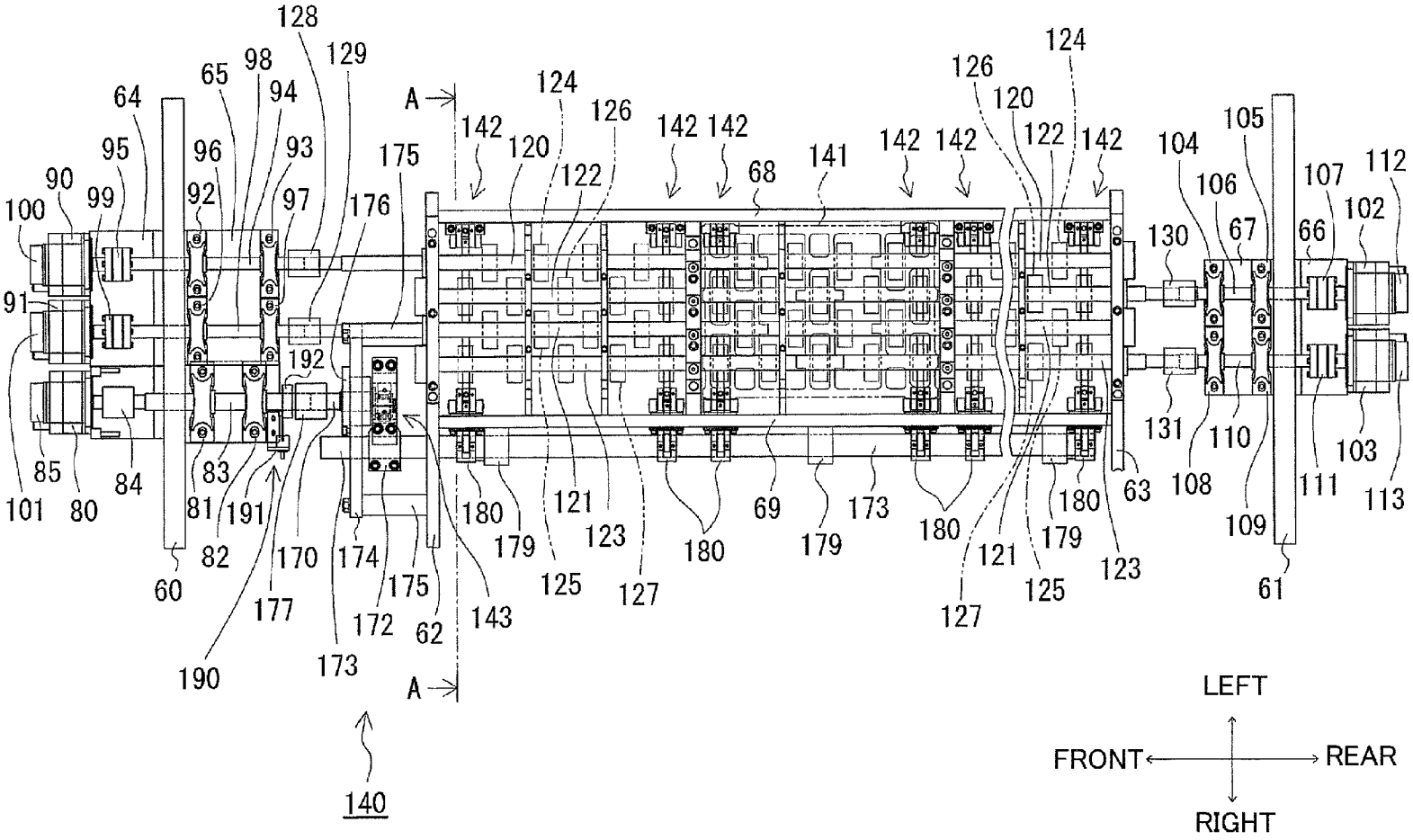
FIG. 2 is a top plan view illustrating an internal structure of the corrugated paperboard sheet feeding apparatus according to this embodiment in a region below a table thereof.
Figure 3:
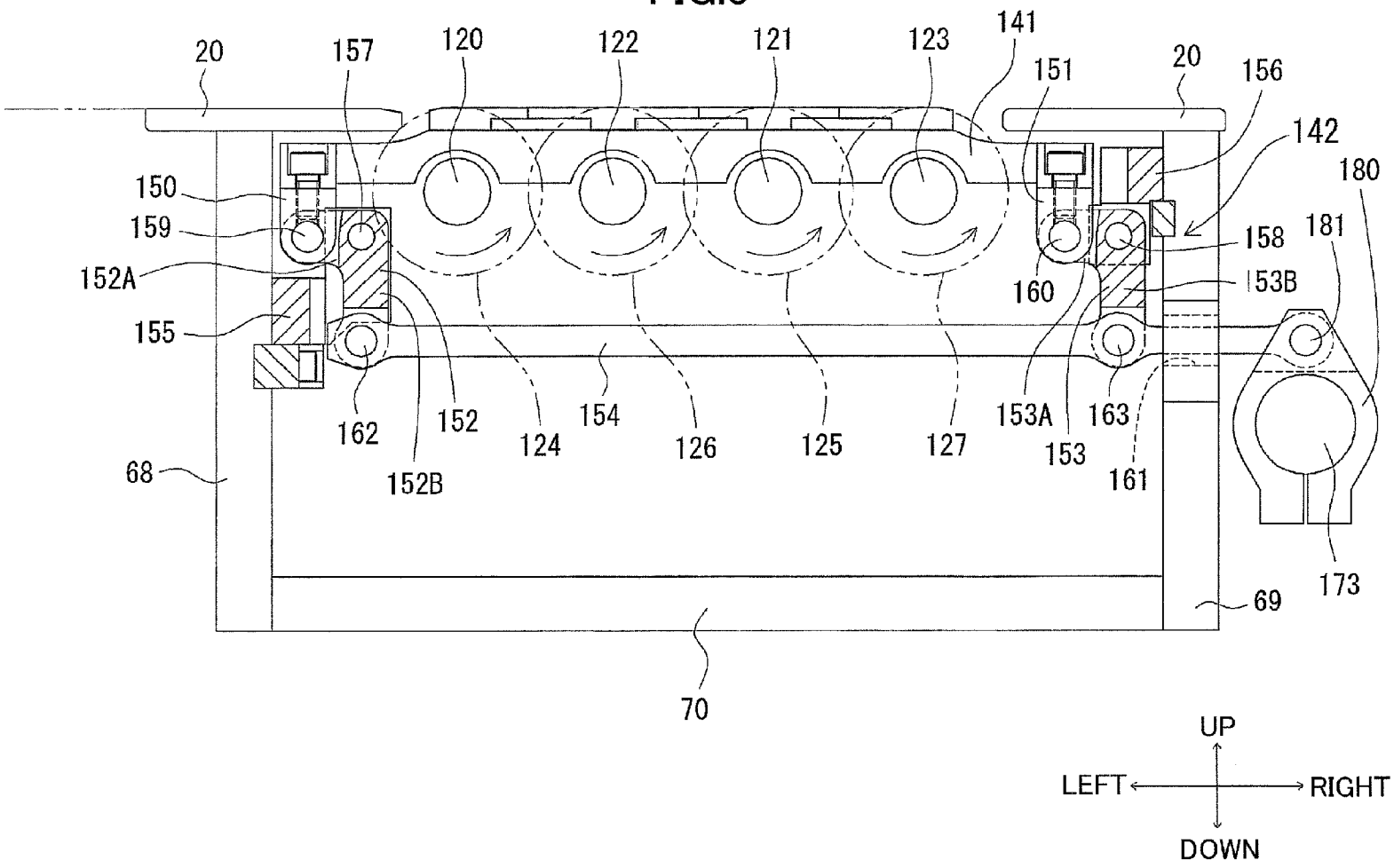
FIG. 3 is an enlarged sectional view of the corrugated paperboard sheet feeding apparatus, taken along the line A-A in FIG. 2.

With reference to FIGS. 2 to 5A, 5B, 5C the detailed configuration of the corrugated paperboard sheet feeding apparatus 2 will be described. As illustrated in FIG. 2, the corrugated paperboard sheet feeding apparatus 2 comprises a front frame 60, a rear frame 61, and a pair of front and rear intermediate frames 62, 63 disposed between the front and rear frames 60, 61. A motor mounting plate 64 is fixed to a front side of the front frame 60, and a bearing mounting plate 65 is fixed to a rear side of the front frame 60. A motor mounting plate 66 is fixed to a rear side of the rear frame 61, and a bearing mounting plate 67 is fixed to a front side of the front frame 61. Each of a left frame 68 and a right frame 69 is fixed between the intermediate frames 62, 63 to extend in a front-rear direction. As illustrated in FIG. 3, a lower frame 70 is fixed between the left frame 68 and the right frame 69.

An up-and-down motor 80 composed of an AC servomotor is fixed to the motor mounting plate 64. A pair of bearings 81, 82 is fixed to the bearing mounting plate 65 to rotatably support an intermediate drive shaft 83. The up-and-down motor 80 has a rotary shaft coupled to the intermediate drive shaft 83 via a coupler 84. An encoder 85 is coupled to the rotary shaft of the up-and-down motor 80.

A first roller motor 90 and a second roller motor 91 each composed of an AC servomotor are fixed to the motor mounting plate 64. A pair of bearings 92, 93 is fixed to the bearing mounting plate 65 to rotatably support a first roller drive shaft 94. The first roller motor 90 has a rotary shaft coupled to the first roller drive shaft 94 via a coupler 95. A pair of bearings 96, 97 are fixed to the bearing mounting plate 65 to rotatably support a second roller drive shaft 98. The second roller motor 91 has a rotary shaft coupled to the second roller drive shaft 98 via a coupler 99. Two encoders 100, 101 are coupled, respectively, to the rotary shafts of the first roller motor 90 and the second roller motor 91.

A third roller motor 102 and a fourth roller motor 103 each composed of an AC servomotor are fixed to the motor mounting plate 66. A pair of bearings 104, 105 is fixed to the bearing mounting plate 67 to rotatably support a third roller drive shaft 106. The third roller motor 102 has a rotary shaft coupled to the third roller drive shaft 106 via a coupler 107. A pair of bearings 108, 109 are fixed to the bearing mounting plate 67 to rotatably support a fourth roller drive shaft 110. The fourth roller motor 103 has a rotary shaft coupled to the fourth roller drive shaft 110 via a coupler 111. Two encoders 112, 113 are coupled, respectively, to the rotary shaft of the third roller motor 102 and the rotary shaft of the fourth roller motor 103.

As illustrated in FIG. 2, first to fourth roller support shafts 120 to 123 are rotatably supported between the intermediate frames 62, 63 to extend parallel to each other in the front-rear direction. A large number of first sheet feeding rollers 124 are fixed to the first roller support shaft 120, and a large number of second sheet feeding rollers 125 are fixed to the second roller support shaft 121. A large number of third sheet feeding rollers 126 are fixed to the third roller support shaft 122, and a large number of fourth sheet feeding rollers 127 are fixed to the fourth roller support shaft 123. The first to fourth sheet feeding rollers 124 to 127 are arranged in a staggered manner so as to prevent interference therebetween. Each of the sheet feeding rollers 124 to 127 has the same diameter Dr.

The first roller drive shaft 94 is coupled to the first roller support shaft 120 via a coupler 128, and the second roller drive shaft 98 is coupled to the second roller support shaft 121 via a coupler 129. The third roller drive shaft 106 is coupled to the third roller support shaft 122 via a coupler 1221, and the fourth roller drive shaft 110 is coupled to the fourth roller support shaft 123 via a coupler 131.

The corrugated paperboard sheet feeding apparatus 2 comprises a motion conversion mechanism 140. The motion conversion mechanism 140 is configured to convert a unidirectional rotation of the up-and-down motor 80 into an up-and-down motion of the grate 141. In FIG. 2, actually, the grate is plurally provided, wherein the plurality of grates are arranged side-by-side in the front-rear direction to cover a region in which the large number of sheet feeding rollers 124 to 127 are arranged. It should be noted that FIG. 2 illustrates only one of the grates 141, without illustrating the remaining grates.

(Detailed Configuration of Motion Conversion Mechanism 140)

The motion conversion mechanism 140 comprises a support mechanism 142 supporting the grates 141 in a movable up and down manner, and a swing mechanism 143. The swing mechanism 143 is configured to convert the unidirectional rotation of the up-and-down motor 80 to a swinging motion, and transmit the swinging motion to the support mechanism 142. In this embodiment, the support mechanism 142 is plurally provided, wherein each of the grates 141 are supported by two of the support mechanisms 142 arranged, respectively, at front and rear ends of the grate 141. Each of the support mechanisms 142 has the same configuration.

With reference to FIG. 3, the configuration of the support mechanism 142 will be described. The support mechanism 142 comprises a pair of left and right coupling blocks 150, 151, a pair of left and right two-arm levers 152, 153, and a coupling rod 154. As illustrated in FIG. 3, a left mounting member 155 is fixed to a right surface of the left frame 68, and a right mounting member 156 fixed to a left surface of the right frame 69. The left two-arm lever 152 is swingably attached to the left mounting member 155 via a pivot shaft 157. The right two-arm lever 153 is swingably attached to the right mounting member 156 via a pivot shaft 158.

As illustrated in FIG. 3, the grate 141 is horizontally disposed above and in adjacent relation to the four roller support shafts 120 to 123. The left coupling block 150 is fixed to a left end of the grate 141 to extend downwardly. The right coupling block 151 is fixed to a right end of the grate 141 to extend downwardly. One arm 152A of the left two-arm lever 152 is coupled to a lower end of the left coupling block 150 via a coupling pin 159. One arm 153A of the right two-arm lever 153 is coupled to a lower end of the right coupling block 151 via a coupling pin 160.

The coupling rod 154 is horizontally disposed below the four roller support shafts 120 to 123. The coupling rod 154 is disposed such that a right end thereof extends through a through-hole 161 formed in the right frame 69. In this state, a left end of the coupling rod 154 is coupled to the other arm 152B the left two-arm lever 152 via a coupling pin 162. An intermediate portion of the coupling rod 154 is coupled to the other arm 153B of the right two-arm lever 153 via a coupling pin 163, at a position adjacent to the right frame 69.

With reference to FIGS. 2 to 5A, 5B, 5C, the configuration of the swing mechanism 143 will be described. The swing mechanism 143 comprises an up-and-down drive shaft 170, an eccentric member 171, a swingable member 172, and an up-and-down coupling shaft 173.

As illustrated in FIG. 2, the auxiliary frame 174 is fixed with respect to a left surface of the left intermediate frame 62 via a plurality of spacers 175, with a given distance therebetween. The up-and-down drive shaft 170 is rotatably supported by the auxiliary frame 174 via a bearing 176. The up-and-down drive shaft 170 is coupled to the intermediate drive shaft 83 via a coupler 177.

Figure 4:
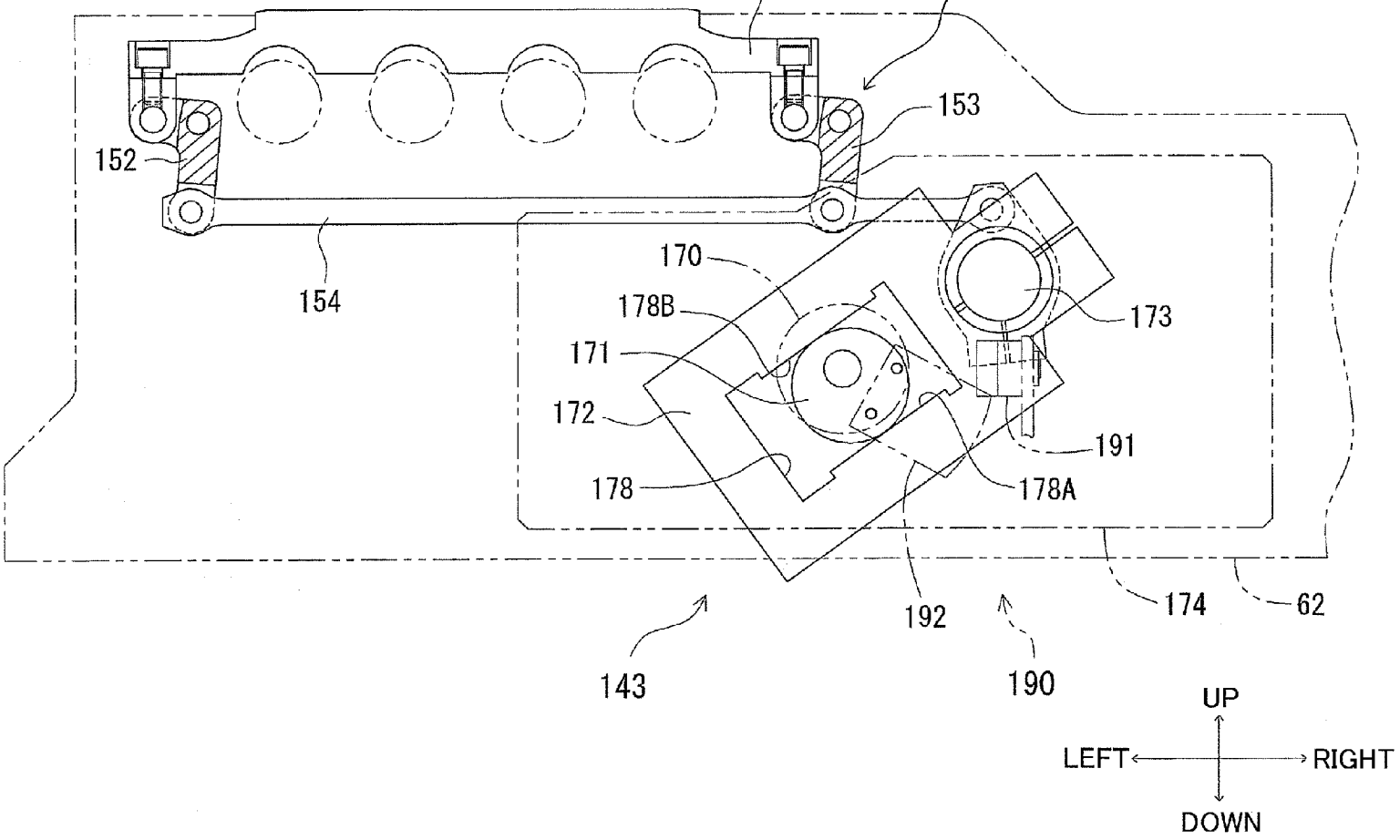
FIG. 4 is a schematic diagram illustrating a coupling relationship between a support mechanism and a swing mechanism of the corrugated paperboard sheet feeding apparatus illustrated in FIG. 2.

FIG. 4 is a schematic diagram illustrating the support and swing mechanisms, when viewed from a left side of the auxiliary frame 174. As illustrated in FIG. 4, the eccentric member 171 is fixed to the up-and-down drive shaft 170. The eccentric member 171 is formed in a cross-sectionally circular shape to have a rotation axis eccentric to a rotation axis of the up-and-down drive shaft 170. The swingable member 172 is fixed to the up-and-down coupling shaft 173 in such a manner as be swingable about the up-and-down coupling shaft 173. The swingable member 172 is formed with an approximately rectangular-shaped fitting groove 178. The fitting groove 178 has a pair of contact surfaces 178A, 178B opposed to each other. Each of the contact surfaces 178A, 178B is formed to extend in a direction parallel to a line connecting a center of a circular profile of the eccentric member 171 and a rotation center of the up-and-down coupling shaft 173. The eccentric member 171 is formed such that an outer peripheral surface thereof is kept in contact with the contact surfaces 178A, 178B of the fitting groove 178.

As illustrated in FIG. 2, the up-and-down coupling shaft 173 is rotatably supported by a right surface of the right frame 69 via a plurality of bearings 179. The up-and-down coupling shaft 173 is disposed parallel to the roller support shafts 120 to 123. A plurality of coupling members 180 are fixed to the up-and-down coupling shaft 173, at respective positions corresponding to the plurality of support mechanisms 142. As illustrated in FIG. 3, each of the coupling members 180 is coupled to the right end of the coupling rod 154 of a corresponding one of the support mechanisms 142, via a coupling pin 181.

Figure 5A:
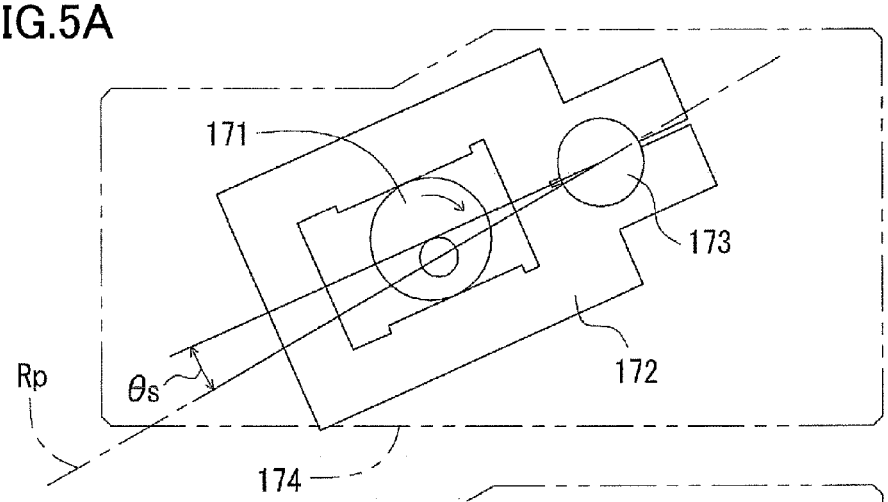
FIG. 5A to FIG. 5C are diagrams illustrating a state in which a swing angle of a swingable member changes along with rotation of an eccentric member of the swing mechanism illustrated in FIG. 4.
Figure 5B:
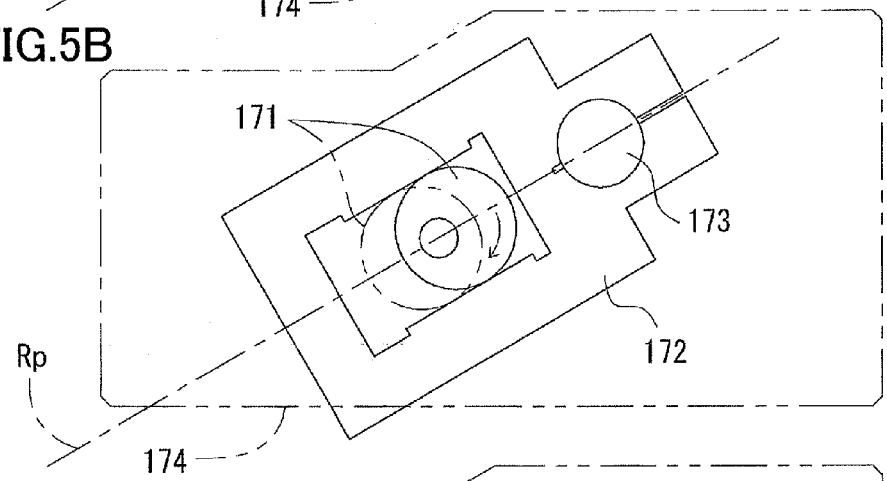
Figure 5C:
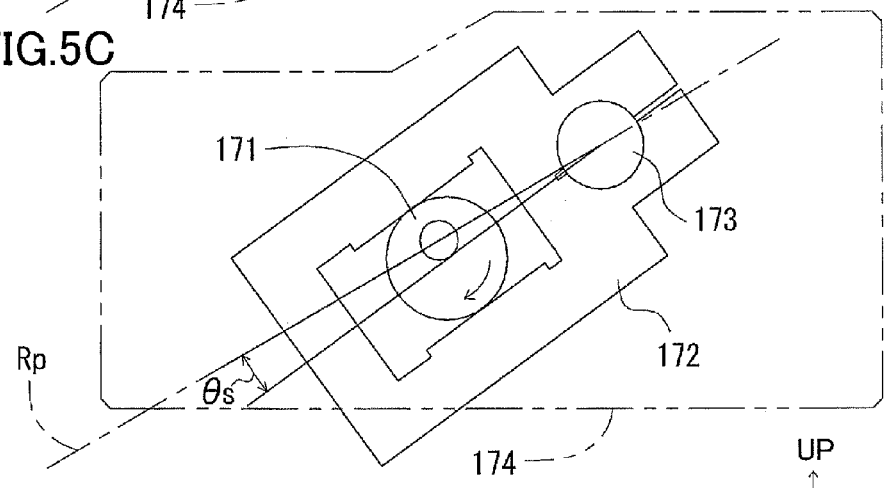
Figure 5C:
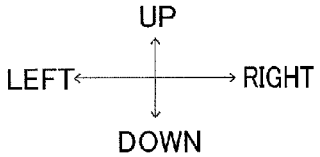

Referring to FIG. 5A to FIG. 5C, a reference angular position Rp is an angular position coincident with a line connecting a rotation center of the eccentric member 171 and the rotation center of the up-and-down coupling shaft 173. It is to be understood that the rotation center of the eccentric member 171 is coincident with a rotation center of the up-and-down drive shaft 170. The angular position of the swingable member 172 illustrated in FIG. 5A corresponds to a state when the swingable member 172 is swung clockwise from the reference angular position Rp by a given angle θs. At the angular position of the swingable member 172 illustrated in FIG. 5A, the grate 141 is located at a lowermost position thereof. The angular position of the swingable member 172 illustrated in FIG. 5C corresponds to a state when the swingable member 172 is swung counterclockwise from the reference angular position Rp by the given angle θs. At the angular position of the swingable member 172 illustrated in FIG. 5C, the grate 141 is located at an uppermost position thereof. The angular position of the swingable member 172 illustrated in FIG. 5B corresponds to a state in which the swingable member 172 is located at the reference angular position Rp. At the angular position of the swingable member 172 illustrated in FIG. 5C, the grate 141 is located at an uppermost position thereof. In this embodiment, the given angle θs is set to 6 degrees. Further, in this embodiment, the swing mechanism 143 is configured such that, when the swingable member 172 is swung to the angular position illustrated in FIG. 5A, the right end of the coupling rod 154 is elastically deformed along with a slight downward movement of the coupling pin 181.

(Configuration of Rotational Position Sensor 190)

A rotational position sensor 190 is provided to detect a given rotational position of the up-and-down drive shaft 170. The rotational position sensor 190 comprises an optical sensor 191, and a light-blocking member 192. The optical sensor 191 is constructed as a conventional configuration comprising a light-emitting section and a light-receiving section, and fixed to the bearing mounting plate 65. As illustrated in FIG. 2, the light-blocking member 192 is fixed to the intermediate drive shaft 83 coupled to the up-and-down drive shaft 170. The light-blocking member 192 is operable, every time the up-and-down drive shaft 170 reaches the given rotational position thereof, to block light from the light-emitting section of the optical sensor 191.

In FIG. 4, the optical sensor 191 and the light-blocking member 192 are indicated by the two-dot chain lines. A rotational position of the light-blocking member 192 illustrated in FIG. 4 corresponds a state just before the light-blocking member 192 passes through the optical sensor 191. In the state illustrated in FIG. 4, the grate 141 is located at a height position just before it reaches the uppermost position. In this embodiment, the rotational position sensor 190 is configured to generate a detection signal SD when the up-and-down drive shaft 170 is rotated to the given rotational position and thereby the grate 141 reaches the uppermost position.

<Configuration of Corrugated Paperboard Box Making Machine 1 Prepared for Two-Sheet Feeding Mode>

As regards a corrugated paperboard box making machine 1 illustrated in FIG. 6, only a difference from the corrugated paperboard box making machine 1 illustrated in FIG. 1 will be described below.

Figure 6:
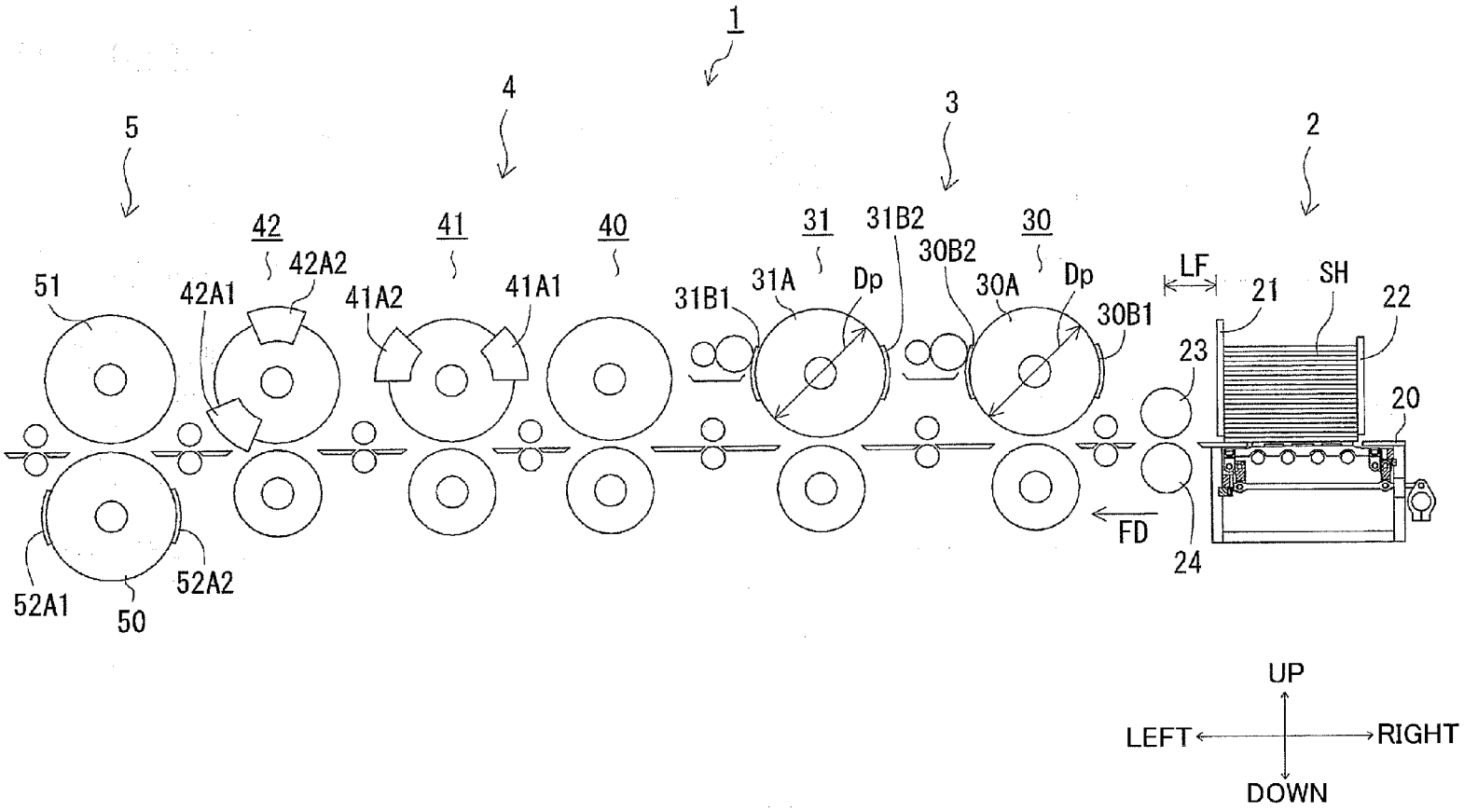
FIG. 6 is a front view illustrating an overall configuration of a corrugated paperboard box making machine with is equipped with the corrugated paperboard sheet feeding apparatus according to this embodiment, wherein processing apparatuses of the corrugated paperboard box making machine are prepared for two-sheet feeding mode.

As illustrated in FIG. 6, two printing die members 30B1, 30B2 are attached to the outer peripheral surface of the printing cylinders 30A in a point symmetrical positional relation. Similarly, two printing die members 31B1, 31B2 are attached to the outer peripheral surface of the printing cylinders 31A in a point symmetrical positional relation. Thus, the printing die members 30B1, 31B1 are operable to subject an initial or first one of two corrugated paperboard sheets SH fed in a processing cycle during which each printing cylinder is rotated 360 degrees, to two-color printing. Further, the printing die members 30B2, 31B2 are operable to subject a next or second one of the two corrugated paperboard sheets SH fed in the processing cycle, to two-color printing.

Two slotter blades 41A1, 41A2 are attached to the outer peripheral surface of the upper slotter of the slotter unit 41. Similarly, two slotter blades 42A1, 42A2 are attached to the outer peripheral surface of the upper slotter of the slotter unit 42. The slotter blades 41A1, 41A2 are operable to subject front and rear ends of an initial or first one of two printed corrugated paperboard sheets SH fed in the processing cycle, to slotting and cutting-out. The slotter blades 42A1, 42A2 are operable to subject front and rear ends of a next or second one of the two printed corrugated paperboard sheets SH fed in the processing cycle, to slotting and cutting-out.

Two punching dies 52A1, 52A2 are attached to the outer peripheral surface of the die cylinder 50 in a point symmetrical positional relation. The punching die 52A1 is operable to subject an initial or first one of two creased, slotted and cut-out corrugated paperboard sheets SH fed in the processing cycle, to punching. The punching die 52A2 is operable to subject a next or second one of the two creased, slotted and cut-out corrugated paperboard sheets SH fed in the processing cycle, to punching.

<<Electrical Configuration>>

Figure 7:
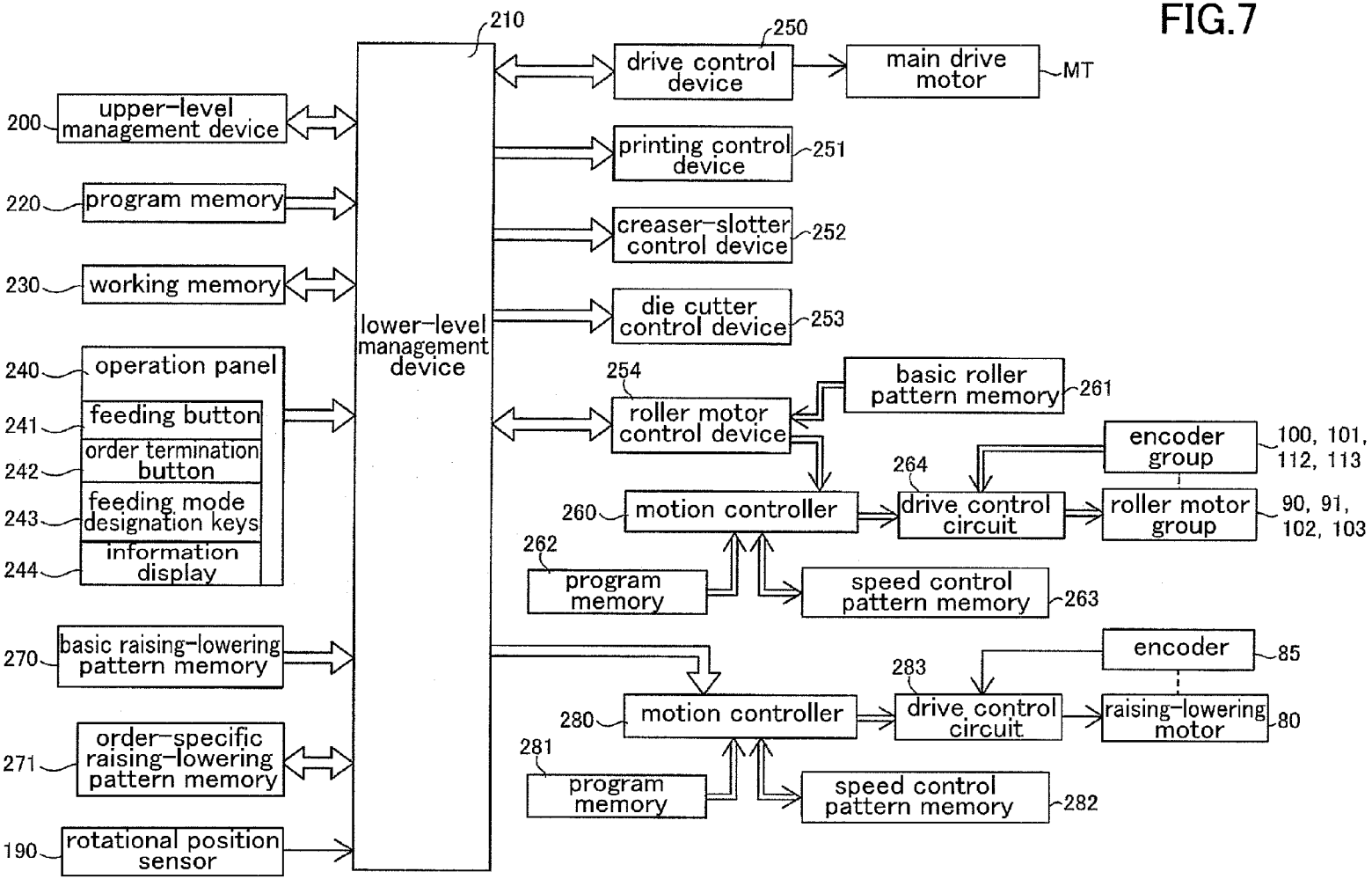
FIG. 7 is a block diagram illustrating an electrical configuration of the corrugated paperboard box making machine in FIG. 1.

With reference to FIG. 7, an electrical configuration of the corrugated paperboard box making machine 1 will be described below.

An upper-level management device 200 and a lower-level management device 210 are provided to generally manage processing of corrugated paperboard sheets in the corrugated paperboard box making machine 1. In this embodiment, the upper-level management device 200 stores therein a production management plan for executing a large number of orders in a predetermined sequence. The upper-level management device 200 is operable to send control instruction information regarding a sheet conveyance speed, a size of a corrugated paperboard sheet SH, a required number of processed products, etc., to the lower-level management device 210, for each order.

The lower-level management device 210 is operable, according to the control instruction information sent from the upper-level management device 200, to control operations of drive sections such as the main drive motor MT, and perform a management control, such as an action of counting the number of processed corrugated paperboard sheets SH and sending the obtained data to the upper-level management device 200. The lower-level management device 210 is connected to a program memory 220 and a working memory 230, thereby making up a computer for controlling the corrugated paperboard box making machine 1 in cooperation with these memories. The program memory 220 is a memory fixedly storing therein a control program for controlling the entire corrugated paperboard box making machine 1, an up-and-down pattern creation program for creating an aftermentioned order-specific up-and-down pattern DGP in conformity to a sheet length and a feeding mode in each order, given set values, etc. The working memory 230 is a memory configured to temporarily store therein a variety of information sent from the upper-level management device 200 and calculation results, during execution of the control program, and temporarily store therein aftermentioned feeding mode designation signal from the operation panel 240, etc.

The lower-level management device 210 is connected to an operation panel 240. The operation panel 240 comprises a feeding button 241, an order termination button 242, feeding mode designation keys 243 and an information display 244. The feeding button 241 is configured to be manipulated to start feeding of corrugated paperboard sheets SH from the corrugated paperboard sheet feeding apparatus 2. The operation panel 240 is operable, upon manipulation of the feeding button 241, to generate a feeding start signal SF. The order termination button 242 is configured to be manipulated to terminate a currently executed order. The feeding mode designation keys 243 are configured to be manipulated to designate one of the one-sheet feeding mode and the two-sheet feeding mode. The operation panel 240 is operable to generate a feeding mode designation signal indicative of the designated feeding mode. The information display 244 is configured to display information indicative of a type of the designated feeding mode, such as a numeral or a symbol.

The lower-level management device 210 is connected to each of a drive control device 250, a printing control device 251, a creaser-slotter control device 252, a die cutter control device 253, and a roller motor control device 254. The drive control device 250 is operable, according to the control instruction information from the lower-level management device 210, to control activation and deactivation of the main drive motor MT, and the rotational speed thereof. The rotational speed of the main drive motor MT is controlled according to the sheet conveyance speed contained in the control instruction information. The printing control device 251 is operable, according to the control instruction information from the lower-level management device 210, to control operations of the printing units 30, 31. The creaser-slotter control device 252 is operable, according to the control instruction information from the lower-level management device 210, to control an operation of the creaser unit 40 and operations of the slotter units 41, 42. The die cutter control device 253 is operable, according to the control instruction information from the lower-level management device 210, to control an operation of the die cutter 5.

The rotational position sensor 190 is connected to the lower-level management device 210. The lower-level management device 210 is operable, upon manipulation of the feeding button 241, to send control instruction information containing a feeding start instruction to the roller motor control device 254. After sending the feeding start instruction, the lower-level management device 210 is also operable, every time it receives the detection signal SD from the rotational position sensor 190, to send control instruction information containing a synchronization instruction to the roller motor control device 254.

The roller motor control device 254 is operable, according to the above control instruction information from the lower-level management device 210, to control a sequence of operations of a first motion controller 260. A basic roller drive pattern memory 261 is connected to the roller motor control device 254. The basic roller drive pattern memory 261 stores therein a basic roller drive pattern BRP1 preliminarily set for the one-sheet feeding mode, and a basic roller drive pattern BRP2 preliminarily set for the two-sheet feeding mode, in order to control the rotational speed of each of the roller motors 90, 91, 102, 103. The lower-level management device 210 is operable, upon receiving control instruction information for carrying out preparation for execution of a processing order, from the upper-level management device 200, to send control instruction information containing an order preparation instruction to the roller motor control device 254. The roller motor control device 254 is operable, upon receiving the control instruction information containing the order preparation instruction, from the lower-level management device 210, to read out one of the basic roller drive patterns BRP1, BRP2 from the basic roller drive pattern memory 261 to generate a roller speed control pattern creation instruction. The roller motor control device 254 is operable to send the roller speed control pattern creation instruction to the first motion controller 260. The roller speed control pattern creation instruction contains the sheet conveyance speed in the control instruction information from the lower-level management device 210, and the read-out basic roller drive pattern BRP. The roller motor control device 254 is operable, in response to the feeding start instruction or the synchronization instruction contained in the control instruction information from the lower-level management device 210, to send a motion start instruction to the first motion controller 260.

Figure 8:
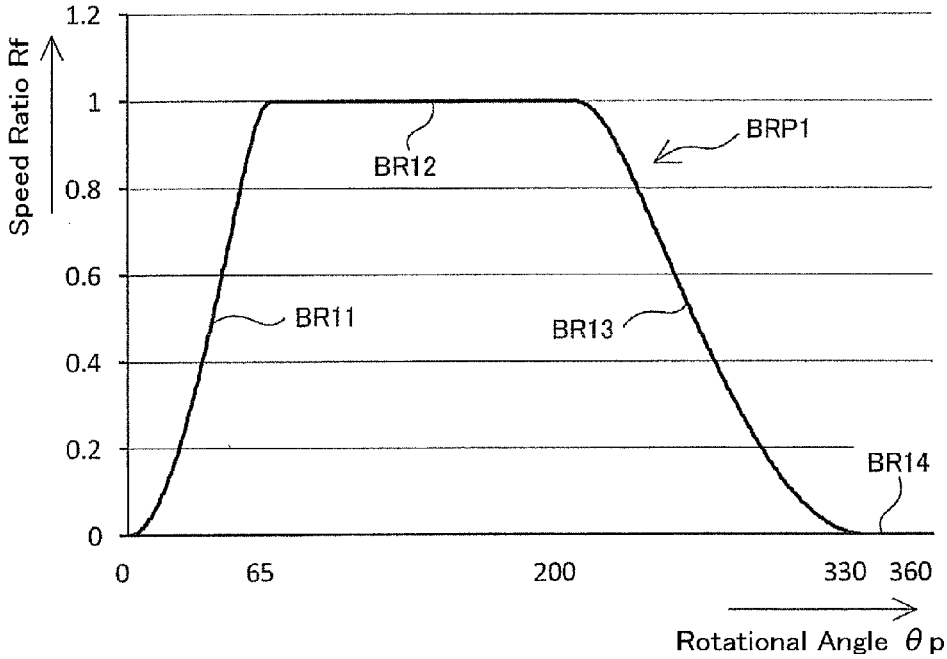
FIG. 8 is a graph illustrating one example of a basic roller drive pattern BRP1 for the one-sheet feeding mode, in the corrugated paperboard sheet feeding apparatus according to this embodiment.
Figure 9:
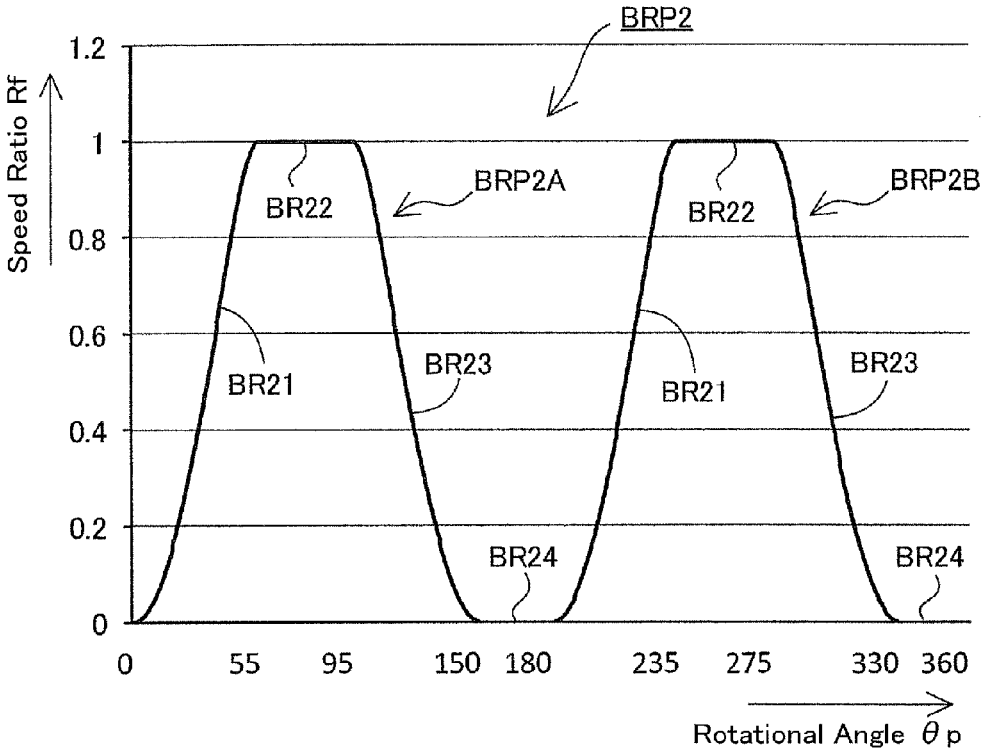
FIG. 9 is a graph illustrating one example of a basic roller drive pattern BRP2 for the two-sheet feeding mode, in the corrugated paperboard sheet feeding apparatus according to this embodiment.

The first motion controller 260 comprises a built-in motion CPU, and is connected to a program memory 262 and a speed control pattern memory 263. The program memory 262 preliminarily stores therein a roller speed control pattern creation program for creating a roller speed control pattern RT, and a phase-difference set value DPP. The phase-difference set value DPP is a value for setting a phase difference by which a start phase of an acceleration region (BR11, BR21) in each of the basic roller drive patterns BRP1, BRP2 illustrated in FIGS. 8 and 9 is displaced, in a direction of the horizontal axis representing rotational angle θp, from a start phase of an acceleration region (BS11A, BL11A, BS21A, BL21A) in corresponding one of aftermentioned four basic up-and-down patterns BGS1, BGL1, BGS2, BGL2 illustrated in FIGS. 10 to 17. In this embodiment, the phase-difference set value DPP is set to an angle of 71 degrees in terms of a rotational angle θp of each of the printing cylinders. The speed control pattern memory 263 is operable to temporarily store therein a roller speed control pattern RT created by the first motion controller 260. The roller speed control pattern RT contains a series, large number of speed control instructions for provide instructions on the rotational speed of each of the roller motors. The first motion controller 260 is operable, upon receiving the roller speed control pattern creation instruction from the roller motor control device 254, to execute the roller speed control pattern creation program. According to the execution of the roller speed control pattern creation program, the first motion controller 260 is operable, based on the sheet conveyance speed and the read-out basic roller drive pattern BRP contained in the roller speed control pattern creation instruction, to create a roller speed control pattern RT and temporarily store the roller speed control pattern RT in the speed control pattern memory 263.

Then, the first motion controller 260 is operable, upon receiving the motion start instruction from the roller motor control device 254, to read out each of the speed control instructions from the speed control pattern memory 263 with a given control cycle, and sequentially send the read-out speed control instructions to a drive control circuit 264. For example, the given control cycle is 1 msec, which is a time period during which the first 260 can reliably perform processing such as readout of the speed control instructions even in a situation where the sheet conveyance speed is set to a maximum sheet conveyance speed in the corrugated paperboard box making machine 1. A basic configuration of the first motion controller 260 is disclosed, for example, in JP 2006-072399A, JP 11-272312A and JP 05-050329A, and commonly known. This, detailed description thereof will be omitted.

The drive control circuit 264 is operable to receive the speed control instructions from the first motion controller 260, and rotation pulses from the group of encoders 100, 101, 112, 113, to control the rotational speed and the activation-deactivation of the roller motors 90, 91, 102, 103. That is, the drive control circuit 264 is operable to control supply of electricity to the roller motors in such a manner as to allow the rotational speed of each of the roller motors to become equal to a rotational speed conforming to the speed control instruction, during the given control cycle. According to the rotation of the roller motors 90, 91, 102, 103, the sheet feeding rollers 124 to 127 are rotated counterclockwise as indicated by the arrowed lines in FIG. 3. In this embodiment, each of the encoders is capable of generating a large number of rotation pulses, e.g., 1000 pulses/msec or more, during the given control cycle.

A basic up-and-down pattern memory 270 and an order-specific up-and-down pattern memory 271 are connected to the lower-level management device 210. The basic up-and-down pattern memory 270 stores therein a basic up-and-down pattern BGS1 preliminarily set in conformity to a minimum sheet length in the one-sheet feeding mode, a basic up-and-down pattern BGL1 preliminarily set in conformity to a maximum sheet length in the one-sheet feeding mode, a basic up-and-down pattern BGS2 preliminarily set for the two-sheet feeding mode in conformity to a minimum sheet length, and a basic up-and-down pattern BGL2 preliminarily set for the two-sheet feeding mode in conformity to a maximum sheet length, in order to control the rotational speed of the up-and-down motor 80. The order-specific up-and-down pattern memory 271 is operable to temporarily store an order-specific up-and-down pattern DGP, as mentioned below.

The lower-level management device 210 is operable, upon receiving control instruction information for carrying out preparation for execution of a processing order, from the upper-level management device 200, to execute the up-and-down pattern creation program stored in the program memory 220. According to the execution of the up-and-down pattern creation program, the lower-level management device 210 is operable, based on one of the basic up-and-down patterns BGS1, BGL1, BGS2, BGL2 stored in the basic up-and-down pattern memory 270, to create an order-specific up-and-down pattern DGP in conformity to a sheet length of the processing order, and temporarily store the order-specific up-and-down pattern DGP in the order-specific up-and-down pattern memory 271. Subsequently, the lower-level management device 210 is operable to read out the order-specific up-and-down pattern DGP from the order-specific up-and-down pattern memory 271 to generate an up-and-down speed control pattern creation instruction. The up-and-down speed control pattern creation instruction contains the sheet conveyance speed contained in the control instruction information from the upper-level management device 200, and the read-out order-specific up-and-down pattern DGP.

The lower-level management device 210 is operable, upon manipulation of the feeding button 241, to receive the feeding start signal SF from the operation panel 240, and send, as the motion start instruction, control instruction information containing the feeding start instruction, to a second motion controller 280. After sending the feeding start instruction, the lower-level management device 210 is operable, every time it receives the detection signal SD from the rotational position sensor 190, to send, as the motion start instruction, control instruction information containing the synchronization instruction to the roller motor control device 280.

The second motion controller 280 is connected to the lower-level management device 210. The second motion controller 280 comprises a built-in motion CPU, and is connected to a program memory 281 storing therein a program and a speed control pattern memory 282. The program memory 281 preliminarily stores therein an up-and-down speed control pattern creation program for creating an up-and-down speed control pattern GT. The speed control pattern memory 282 is operable to temporarily store therein an up-and-down speed control pattern GT created by the second motion controller 280. The up-and-down speed control pattern GT contains a series, large number of speed control instructions for providing instructions on the rotational speed of the up-and-down motor 80. The second motion controller 280 is operable, upon receiving the up-and-down speed control pattern creation instruction from the lower-level management device 210, to execute the up-and-down speed control pattern creation program. According to the execution of the up-and-down speed control pattern creation program, the second motion controller 280 is operable, based on the sheet conveyance speed and the order-specific up-and-down pattern DGP contained in the up-and-down speed control pattern creation instruction, to create an up-and-down speed control pattern GT and temporarily store the up-and-down speed control pattern GT in the speed control pattern memory 282.

Then, the second motion controller 280 is operable, upon receiving the motion start instruction from the lower-level management device 210, to read out each of the speed control instructions from the speed control pattern memory 282 with a given control cycle, and sequentially send the read-out speed control instructions to a drive control circuit 283. For example, the given control cycle is 1 msec, which is a time period during which the second motion controller 280 can reliably perform processing such as readout of the speed control instructions even in a situation where the sheet conveyance speed is set to a maximum sheet conveyance speed in the corrugated paperboard box making machine 1. The second motion controller 280 has the same basic configuration as that of the first motion controller 260.

The drive control circuit 283 is operable to receive the speed control instructions from the second motion controller 280, and rotation pulses from the encoder 85, to control the rotational speed and the activation-deactivation of the up-and-down motor 80. That is, the drive control circuit 283 is operable to control supply of electricity to the up-and-down motor in such a manner as to allow the rotational speed of the up-and-down motor 80 to become equal to a rotational speed conforming to the speed control instruction, during the given control cycle. While the rotary shaft of the up-and-down motor 80 is rotated 360 degrees, the eccentric member 171 is rotated 360 degrees clockwise as indicated by the arrowed lines in FIG. 4 and FIG. 5A to FIG. 5C, and thus each of the grates 141 undergoes one cycle of up-and-down motion. In this embodiment, the encoder 85 is capable of generating a large number of rotation pulses, e.g., 1000 pulses/msec or more, during the given control cycle.

<Basic Roller Drive Pattern BRP>

With reference to FIGS. 8 and 9, the basic roller drive patterns BRP1, BRP2 will be described. Each of the basic roller drive patterns BRP1, BRP2 is a pattern serving as a basis for creating a roller speed control pattern RT. FIGS. 8 and 9 illustrate, respectively, one example of the basic roller drive pattern BRP1 for the one-sheet feeding mode, and one example of the basic roller drive pattern BRP2 for the two-sheet feeding mode, in this embodiment. In FIGS. 8 and 9, the horizontal axis represents a rotational angle θp of each of the printing cylinders of the printing apparatus, and the vertical axis represents a speed ratio Rf of a circumferential speed Vr of each of the sheet feeding rollers to a circumferential speed Vp of each of the printing cylinders.

(Basic Roller Drive Pattern BRP1 for One-Sheet Feeding Mode)

As illustrated in FIG. 8, the basic roller drive pattern BRP1 comprises: an acceleration region BR11 in which the rotational angle θp changes from 0 degree to 65 degrees; a constant-speed region BR12 in which the rotational angle θp changes from 65 degree to 200 degrees; a deceleration region BR13 in which the rotational angle θp changes from 200 degree to 330 degrees; and a stop region BR14 in which the rotational angle θp changes from 330 degree to 360 degrees.

A rate of change of speed per unit time (speed change rate per unit time) at which each of the roller motors 90, 91, 102, 103 is rotationally accelerated in the acceleration region BR11 is preliminarily set based on a maximum speed change rate per unit time for each of the roller motors, so as to allow an amount of change of the rotational angle θp in the acceleration region BR11 to be minimized. In particular, the speed change rate per unit time in acceleration region BR11 needs to be set such that the circumferential speed Vr of each of the sheet feeding rollers is accelerated from the stopped state to a value equal to the circumferential speed Vp of each of the printing cylinders, within a time period after a leading edge of a corrugated paperboard sheet SH passes through the front gate 21 through until the corrugated paperboard sheet SH is fed by a distance LF illustrated in FIG. 1. The distance LF is a distance between the front gate 2 and a nip position between the feed rolls 23, 24 in the feeding direction FD.

A maximum time period during which one corrugated paperboard sheet SH is fed by the sheet feeding rollers 124 to 127, in a processing cycle where each of the printing cylinders is rotated 360 degrees, i.e., in a time period during which the rotational angle θp changes from 0 degree to 360 degrees, is a sum of a duration of the acceleration region BR11 and a duration of the constant-speed region BR12. Thus, an amount of change of the rotational angle θp in the acceleration region BR11 and the constant-speed region BR12 is preliminarily set based on a maximum sheet length processable by the corrugated paperboard box making machine 1 under setting of the one-sheet feeding mode. In the constant-speed region BR12, the circumferential speed Vp of each of the printing cylinders and the circumferential speed Vr of each of the sheet feeding rollers need to become equal to each other and set to a value corresponding to the sheet conveyance speed, i.e., the speed ratio Rf needs to be 1. In order to reliably stop the roller motors in the stop region BR14, a rate of change of speed per unit time (speed change rate per unit time) at which each of the roller motors is decelerated in the deceleration region BR13 is set to be less than the speed change rate per unit time in the acceleration region BR11.

An upper surface of each of the grates 141 undergoes wear due to frictional contact with corrugated paperboard sheets SH. When the upper surface of the grate 141 is worn away, a height position of the upper surface of the grate 141 is moved down by a distance corresponding to an amount of the wear, and a timing at which a lower surface of a corrugated paperboard sheet SH comes into contact with the sheet feeding rollers is changed according to the wear amount. In order to allow the corrugated paperboard sheet SH to reliably come into contact with the sheet feeding rollers in the stopped state, at a start time point of the processing cycle, a duration of the stop region BR14 is preliminarily set by taking into account a predetermined allowable wear amount. In this embodiment, the allowable wear amount is set to 0.4 mm.

(Basic Roller Drive Pattern BRP2 for Two-Sheet Feeding Mode)

As illustrated in FIG. 9, the basic roller drive pattern BRP1 is composed of two basic roller drive pattern sections BRP2A, BRP2B each having the same pattern shape. The basic roller drive pattern section BRP2A is generated in a time period during which the rotational angle θp changes from 0 degree to 180 degrees, and the basic roller drive pattern section BRP2B is generated in a time period during which the rotational angle θp changes from 180 degree to 360 degrees. The basic roller drive pattern section BRP2A comprises: an acceleration region BR21 in which the rotational angle θp changes from 0 degree to 55 degrees; a constant-speed region BR22 in which the rotational angle θp changes from 55 degree to 95 degrees; a deceleration region BR23 in which the rotational angle θp changes from 95 degree to 150 degrees; and a stop region BR24 in which the rotational angle θp changes from 150 degree to 180 degrees. The basic roller drive pattern section BRP2B comprises: an acceleration region BR21 in which the rotational angle θp changes from 180 degree to 235 degrees; a constant-speed region BR22 in which the rotational angle θp changes from 235 degree to 275 degrees; a deceleration region BR23 in which the rotational angle θp changes from 275 degree to 330 degrees; and a stop region BR24 in which the rotational angle θp changes from 330 degree to 360 degrees.

A speed change rate per unit time at which each of the roller motors 90, 91, 102, 103 is rotationally accelerated in the acceleration region BR21 is preliminarily set based on a maximum speed change rate per unit time for each of the roller motors, so as to allow an amount of change of the rotational angle θp in the acceleration region BR21 to be minimized. In particular, the speed change rate per unit time in acceleration region BR21 needs to be set such that the circumferential speed Vr of each of the sheet feeding rollers is accelerated from the stopped state to a value equal to the circumferential speed Vp of each of the printing cylinders, within a time period after a leading edge of a corrugated paperboard sheet SH passes through the front gate 21 through until the corrugated paperboard sheet SH is fed by the distance LF illustrated in FIG. 1.

Two corrugated paperboard sheets SH need to be sequentially fed in a processing cycle where each of the printing cylinders is rotated 360 degrees, i.e., in a time period during which the rotational angle θp changes from 0 degree to 360 degrees. Thus, a maximum time period during which each of two corrugated paperboard sheets SH is fed by the sheet feeding rollers 124 to 127 is a sum of a duration of the acceleration region BR21 and a duration of the constant-speed region BR22, so that an amount of change of the rotational angle θp in the acceleration region BR21 and the constant-speed region BR22 is preliminarily set based on a maximum sheet length processable by the corrugated paperboard box making machine 1 under setting of the two-sheet feeding mode. In the constant-speed region BR22, the circumferential speed Vp of each of the printing cylinders and the circumferential speed Vr of each of the sheet feeding rollers need to become equal to each other and set to a value corresponding to the sheet conveyance speed, i.e., the speed ratio Rf needs to be 1. In order to reliably stop the roller motors in the stop region BR24, a speed change rate per unit time at which each of the roller motors is decelerated in the deceleration region BR23 is set to be less than the speed change rate per unit time in the acceleration region BR21.

In order to allow the corrugated paperboard sheet SH to reliably come into contact with the sheet feeding rollers in the stopped state, at a start time point of the processing cycle, a duration of the stop region BR24 is preliminarily set by taking into account the predetermined allowable wear amount.

The basic roller drive pattern section BRP2B has the same pattern shape as that of the basic roller drive pattern section BRP2A, as illustrated in FIG. 9. Thus, detailed description thereof will be omitted.

<Basic Up-and-Down Pattern>

With reference to FIGS. 10 to 17, the basic up-and-down patterns BGS1, BGL1, BGS2, BGL2 will be described. Each of these basic up-and-down patterns is a pattern serving as a basis for creating an up-and-down speed control pattern GT. FIGS. 10 to 13 illustrate, respectively, one example of the basic up-and-down pattern BGS1 conforming to a minimum sheet length in the one-sheet feeding mode, and one example of the basic up-and-down pattern BGL1 conforming to a maximum sheet length in the one-sheet feeding mode, in this embodiment. FIGS. 14 to 17 illustrate, respectively, one example of the basic up-and-down pattern BGS1 conforming to a minimum sheet length in the two-sheet feeding mode, and one example of the basic up-and-down pattern BGL1 conforming to a maximum sheet length in the two-sheet feeding mode, in this embodiment. For example, in the one-sheet feeding mode, the minimum sheet length is 280 mm, and the maximum sheet length is 1160 mm. On the other hand, in the two-sheet feeding mode, the minimum sheet length is 280 mm, and the maximum sheet length is 500 mm. In FIGS. 10, 12, 14 and 16, the horizontal axis represents the rotational angle θp of each of the printing cylinders of the printing apparatus 3, and the left vertical axis and the right vertical axis represent, respectively, a speed ratio Rg of an angular speed ωg of the up-and-down drive shaft 170 to an angular speed ωp of each of the printing cylinders, and a rotational angle θg of the up-and-down drive shaft 170. Each of four curves AS1, AL1, AS2, AL2 indicated by the broken lines in FIGS. 10, 12, 14 and 16 represents a change in the rotational angle θg of the up-and-down drive shaft 170. In FIGS. 11, 13, 15 and 17, the horizontal axis represents the rotational angle θp of each of the printing cylinders of the printing apparatus 3, and the left vertical axis and the right vertical axis represent, respectively, the speed ratio Rg of the angular speed ωg of the up-and-down drive shaft 170 to the angular speed ωp of each of the printing cylinders, and a height position Hg of the upper surface of each of the grates 141 measured on the basis of the upper surface of the table 20 and expressed by mm. Each of four curves HS1, HL1, HS2, HL2 indicated by the broken lines in FIGS. 11, 13, 15 and 17 represents a change in the height position Hg of the upper surface of each of the grates 141. In this embodiment, each of the grates 141 is moved up and down between an uppermost position located above an upper surface of the table 20 by 2 mm, and a lowermost position located below the upper surface of the table 20 by 2 mm. Each of the sheet feeding rollers 124 to 127 is disposed such that an uppermost point of an outer peripheral surface thereof is located above the upper surface of the table 2 by 0.9 mm. A position PR indicated by the broken line in FIGS. 11, 13, 15 and 17 presents a position of the uppermost point of the outer peripheral surface of each of the sheet feeding rollers.

(Basic Up-and-Down Pattern BGS1 Set in Conformity to Minimum Sheet Length in One-Sheet Feeding Mode)

Figure 10:
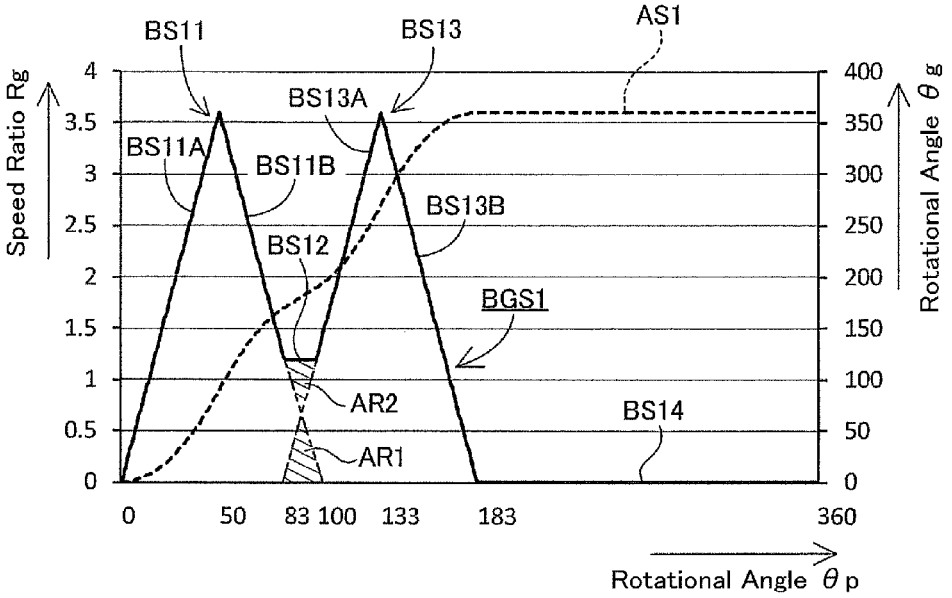
FIG. 10 is a graph illustrating one example of a basic up-and-down pattern BGS1 conforming to a minimum sheet length in the one-sheet feeding mode, and a curve AS1 representing a change in rotational angle θg of an up-and-down drive shaft, in the corrugated paperboard sheet feeding apparatus according to this embodiment.
Figure 11:
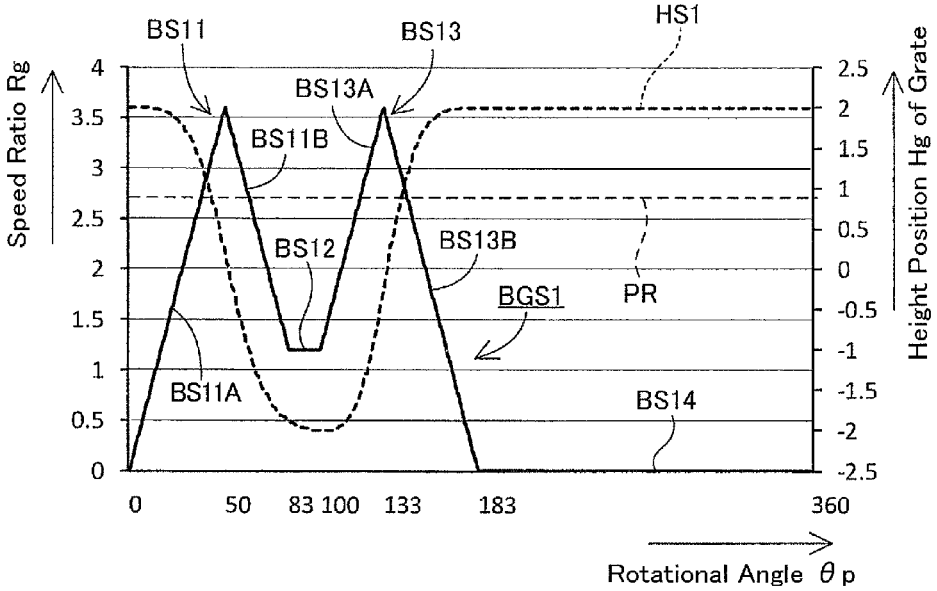
FIG. 11 is a graph illustrating one example of the basic up-and-down pattern BGS1 conforming to the minimum sheet length in the one-sheet feeding mode, and a curve HS1 representing a change in height position Hg of an upper surface of a grate, in the corrugated paperboard sheet feeding apparatus according to this embodiment.

With reference to FIGS. 10 and 11, the basic up-and-down pattern BGS1 will be described. The basic up-and-down pattern BGS1 is one of two basic up-and-down patterns serving as a basis for creating an up-and-down speed control pattern GT for the one-sheet feeding pattern. FIGS. 10 and 11 is one example of the basic up-and-down pattern BGS1 preliminarily set in conformity to the minimum sheet length in the one-sheet feeding pattern, in the embodiment.

As illustrated in FIG. 10, the basic up-and-down pattern BGS1 comprises: a first region BSI 1 in which the rotational angle θp changes from 0 degree to 83 degrees; a second region BS12 in which the rotational angle θp changes from 83 degree to 100 degrees; a third region BS13 in which the rotational angle θp changes from 100 degree to 183 degrees; and a fourth region BS14 in which the rotational angle θp changes from 183 degree to 360 degrees. The first region BS11 is composed of an acceleration sub-region BS11A and a deceleration sub-region BS11B. The third region BS13 is composed of an acceleration sub-region BS13A and a deceleration sub-region BS13B. In this embodiment, a speed change rate per unit time at which the up-and-down motor 80 is accelerated in the acceleration sub-regions BS11A, BS13A is set to be equal to a speed change rate per unit time at which the up-and-down motor 80 is decelerated in the deceleration sub-regions BS11B, BS13B. The first region BS11 and the third region BS13 are arranged at a time interval conforming to the minimum sheet length, in a direction causing an increase in the rotational angle θp, i.e., in the arrowed direction along the horizontal axis in FIG. 10.

As the smaller an amount of change (change of angular rate) of the rotational angle θp in the acceleration sub-regions BSI 1A, BS13A and the deceleration sub-regions BS11B, BS13B is, the smaller value the minimum sheet length can be set to. Thus, each of the speed change rate per unit time in the acceleration sub-regions BS11A, BS13A and the speed change rate per unit time in the deceleration sub-regions BS11B, BS13B is preliminarily set based on a maximum speed change rate per unit time for the up-and-down motor 8.

In FIG. 10, an area AR1 is an area of a shaded region surrounded by an extension line of an oblique line indicative of the deceleration sub-region BS11B, an extension line of an oblique line representing the acceleration sub-region BS13A, and the horizontal axis on which the speed ratio Rg is 0. Further, an area AR2 is an area of a shaded area surrounded by the above two extension lines, and a horizontal line indicative of the second region BS12. The second region BS12 is set to allow the two areas AR1, AR2 to become equal to each other.

As illustrated in FIG. 10, the rotational angle θg of the up-and-down drive shaft 170 is increased to reach 360 degrees when the rotational angle θp reaches 183 degrees, and subsequently, kept at 360 degrees in the fourth region BS14. As illustrated in FIG. 11, the height position Hg of the upper surface of each of the grates 141 becomes lower than the position PR in mid-course of the acceleration sub-region BS11A, and then becomes higher than the position PR in mid-course of the deceleration sub-region BS13B.

(Basic Up-and-Down Pattern BGL1 Set in Conformity to Maximum Sheet Length in One-Sheet Feeding Mode)

Figure 12:
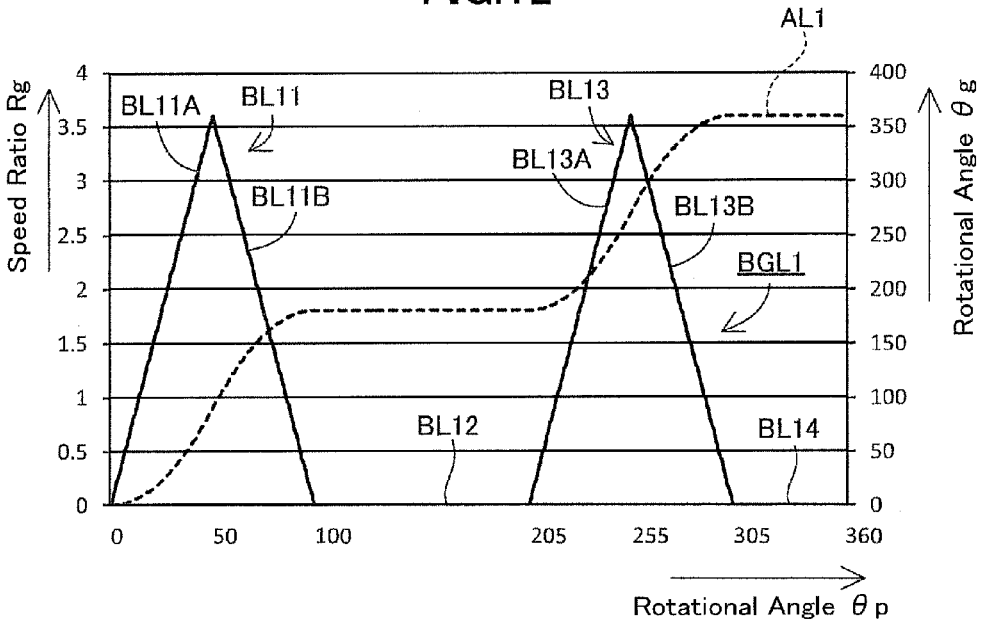
FIG. 12 is a graph illustrating one example of a basic up-and-down pattern BGL1 conforming to a maximum sheet length in the one-sheet feeding mode, and a curve AL1 representing a change in rotational angle θg of the up-and-down drive shaft, in the corrugated paperboard sheet feeding apparatus according to this embodiment.
Figure 13:
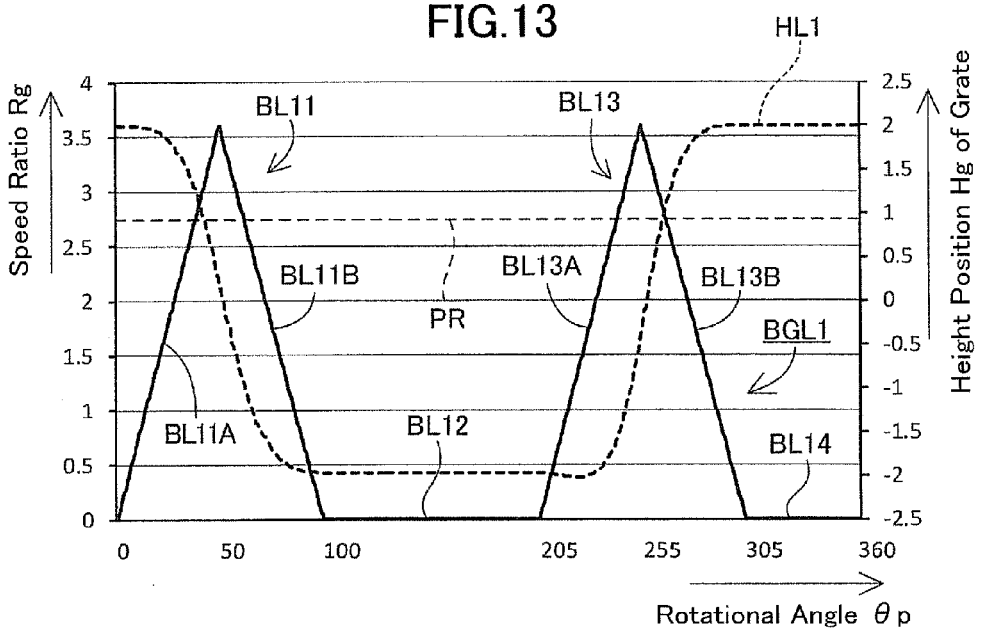
FIG. 13 is a graph illustrating one example of the basic up-and-down pattern BGL1 conforming to the maximum sheet length in the one-sheet feeding mode, and a curve HL1 representing a change in height position Hg of the upper surface of the grate, in the corrugated paperboard sheet feeding apparatus according to this embodiment.

With reference to FIGS. 12 and 13, the basic up-and-down pattern BGL1 will be described. The basic up-and-down pattern BGL1 is the remaining one of the two basic up-and-down patterns serving as a basis for creating an up-and-down speed control pattern GT for the one-sheet feeding pattern. FIGS. 12 and 13 is one example of the basic up-and-down pattern BGL1 preliminarily set in conformity to the maximum sheet length in the one-sheet feeding pattern, in the embodiment.

As illustrated in FIG. 12, the basic up-and-down pattern BGL1 comprises: a first region BL11 in which the rotational angle θp changes from 0 degree to 100 degrees; a second region BL12 in which the rotational angle θp changes from 100 degree to 205 degrees; a third region BL13 in which the rotational angle θp changes from 205 degree to 305 degrees; and a fourth region BL14 in which the rotational angle θp changes from 305 degree to 360 degrees. The first region BL11 is composed of an acceleration sub-region BL11A and a deceleration sub-region BL11B. The third region BL13 is composed of an acceleration sub-region BL13A and a deceleration sub-region BL13B. In this embodiment, a speed change rate per unit time at which the up-and-down motor 80 is accelerated in the acceleration sub-regions BL11A, BL13A is set to be equal to a speed change rate per unit time at which the up-and-down motor 80 is decelerated in the deceleration sub-regions BL11B, BL13B. Further, each of the speed change rate per unit time in the acceleration sub-regions BL11A, BL13A and the speed change rate per unit time in the deceleration sub-regions BL11B, BL13B is set to be equal to each of the speed change rate per unit time in the acceleration sub-regions BS11A, BS13A and the speed change rate per unit time in the deceleration sub-regions BS11B, BS13B. The first region BS11 and the third region BS13 are arranged at a time interval conforming to the maximum sheet length, in a direction causing an increase in the rotational angle θp, i.e., in the allowed direction along the horizontal axis in FIG. 12.

The maximum sheet length can be set to a larger value, as an amount of change of the rotational angle θp in the acceleration sub-regions BL11A, BL13A and the deceleration sub-regions BL11B, BL13B is set to a smaller value as much as possible. Thus, each of the speed change rate per unit time in the acceleration sub-regions BL11A, BL13A and the speed change rate per unit time in the deceleration sub-regions BL11B, BL13B is preliminarily set based on the maximum speed change rate per unit time for the up-and-down motor 8.

As illustrated in FIG. 12, the rotational angle θg of the up-and-down drive shaft 170 is increased to reach 360 degrees when the rotational angle θp reaches 305 degrees, and, subsequently, kept at 360 degrees in the fourth region BL14. As illustrated in FIG. 13, the height position Hg of the upper surface of each of the grates 141 becomes lower than the position PR in mid-course of the acceleration sub-region BL11A, and then becomes higher than the position PR in mid-course of the deceleration sub-region BL13B.

(Basic Up-and-Down Pattern BGS2 Set in Conformity to Minimum Sheet Length in Two-Sheet Feeding Mode)

Figure 14:
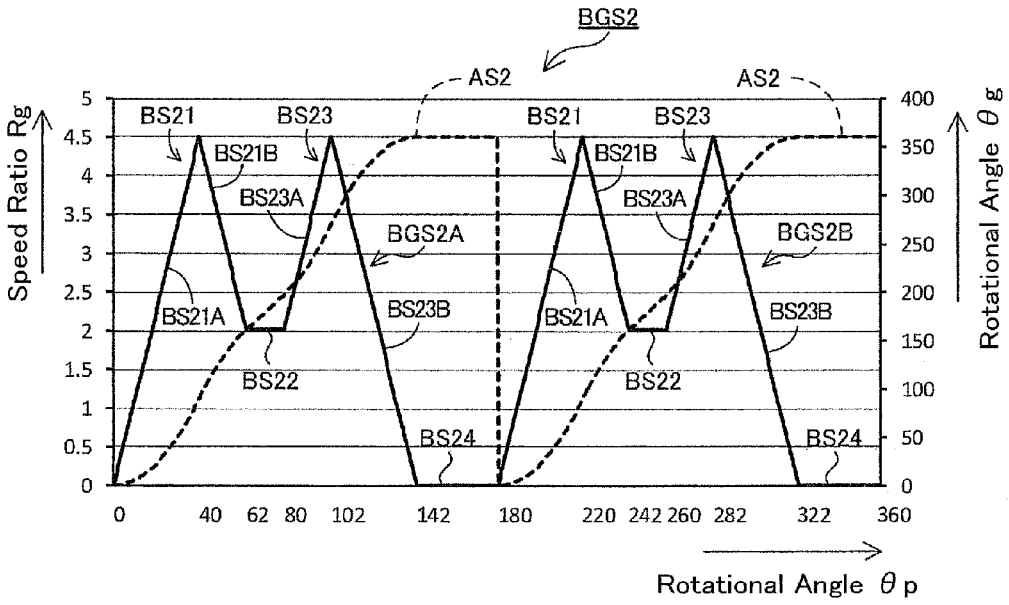
FIG. 14 is a graph illustrating one example of a basic up-and-down pattern BGS2 conforming to a minimum sheet length in the two-sheet feeding mode, and a curve AS2 representing a change in rotational angle θg of the up-and-down drive shaft, in the corrugated paperboard sheet feeding apparatus according to this embodiment.
Figure 15:
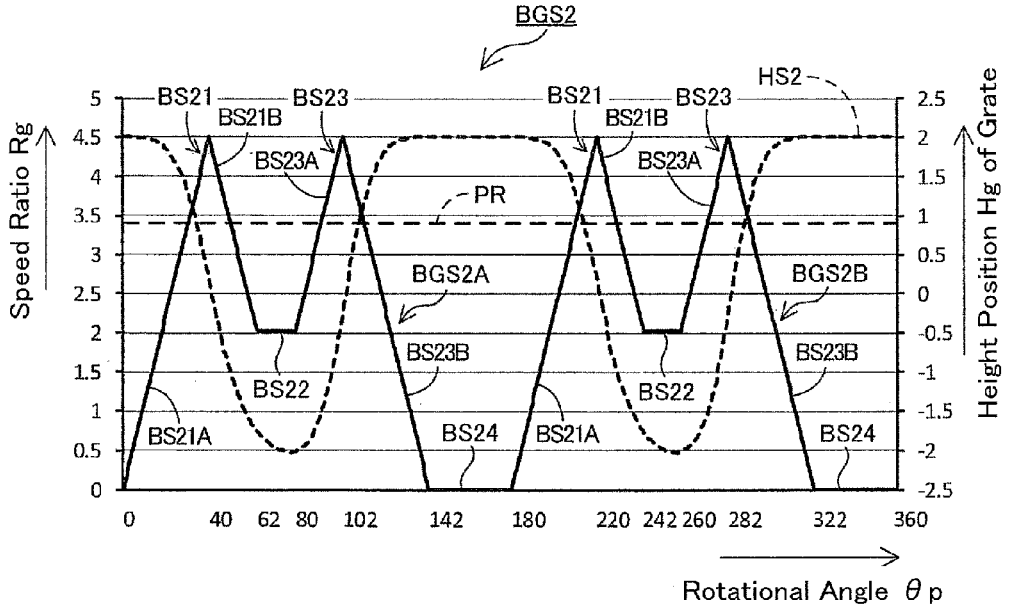
FIG. 15 is a graph illustrating one example of the basic up-and-down pattern BGS2 conforming to the minimum sheet length in the two-sheet feeding mode, and a curve HS2 representing a change in height position Hg of the upper surface of the grate, in the corrugated paperboard sheet feeding apparatus according to this embodiment.

With reference to FIGS. 14 and 15, the basic up-and-down pattern BGS2 will be described. The basic up-and-down pattern BGS2 is one of two basic up-and-down patterns serving as a basis for creating an up-and-down speed control pattern GT for the two-sheet feeding pattern. FIGS. 14 and 15 is one example of the basic up-and-down pattern BGS2 preliminarily set in conformity to the minimum sheet length in the two-sheet feeding pattern, in the embodiment.

As illustrated in FIG. 14, the basic up-and-down pattern BGS2 is composed of two basic up-and-down pattern sections BGS2A, BGS2B each having the same pattern shape. The basic up-and-down pattern section BGS2A is generated in a time period during which the rotational angle θp changes from 0 degree to 180 degrees, and the basic up-and-down pattern section BGS2B is generated in a time period during which the rotational angle θp changes from 180 degree to 360 degrees. The basic up-and-down pattern section BGS2A comprises: a first region BS21 in which the rotational angle θp changes from 0 degree to 62 degrees; a second region BS22 in which the rotational angle θp changes from 62 degree to 80 degrees; a third region BS23 in which the rotational angle θp changes from 80 degree to 142 degrees; and a fourth region BS24 in which the rotational angle θp changes from 142 degree to 180 degrees. The basic up-and-down pattern section BGS2B comprises: a first region BS21 in which the rotational angle θp changes from 180 degree to 242 degrees; a second region BS22 in which the rotational angle θp changes from 242 degree to 260 degrees; a third region BS23 in which the rotational angle θp changes from 260 degree to 322 degrees; and a fourth region BS24 in which the rotational angle θp changes from 322 degree to 360 degrees.

Each of the variable-speed moving down regions BS21 of the basic up-and-down pattern sections BGS2A, BGS2B is composed of an acceleration sub-region BS21A and a deceleration sub-region BS21B. Similarly, each of the third regions BS23 of the basic up-and-down pattern sections BGS2A, BGS2B is composed of an acceleration sub-region BS23A and a deceleration sub-region BS23B. In this embodiment, a speed change rate per unit time at which the up-and-down motor 80 is accelerated in the acceleration sub-regions BS21A, BS23A is set to be equal to a speed change rate per unit time at which the up-and-down motor 80 is decelerated in the deceleration sub-regions BS21B, BS23B. The first region BS21 and the third region BS23 in each of the basic up-and-down pattern sections BGS2A, BGS2B are arranged at a time interval conforming to the minimum sheet length, in a direction causing an increase in the rotational angle θp, i.e., in the arrowed direction along the horizontal axis in FIG. 14.

The minimum sheet length can be set to a smaller value, as an amount of change of the rotational angle θp in the acceleration sub-regions BS21A, BS23A and the deceleration sub-regions BS21B, BS23B is set to a smaller value as much as possible. Thus, each of the speed change rate per unit time in the acceleration sub-regions BS21A, BS23A and the speed change rate per unit time in the deceleration sub-regions BS21B, BS23B is preliminarily set based on the maximum speed change rate per unit time for the up-and-down motor 8. The speed change rate per unit time in the acceleration sub-regions and the deceleration sub-regions, and a maximum value of the speed ratio Rg in the acceleration sub-regions, are set such that a total area of two regions surrounded by two polygonal lines indicative of respective shapes of the basic up-and-down pattern sections BGS2A, BGS2B and the horizontal axis representing the rotational angle θp in FIG. 14 becomes equal to an area of a region surrounded by a polygonal line indicative of a shape of the basic up-and-down pattern BGS1 and the horizontal axis representing the rotational angle θp in FIG. 10. That is, each of the speed change rate per unit time in the acceleration sub-regions BS21A, BS23A and the speed change rate per unit time in the deceleration sub-regions BS21B, BS23B is set to be greater than each of the speed change rate per unit time in the acceleration sub-regions BS11A, BS13A and the speed change rate per unit time in the deceleration sub-regions BS11B, BS13B in the basic up-and-down pattern BGS1. Further, the maximum value of the speed ratio Rg in the acceleration sub-regions BS21A, BS23A is set to be greater than a maximum value of the speed ratio Rg in the acceleration sub-regions BS11A, BS13A.

The second region BS22 is set in the same manner as that for the second region BS12 of the basic up-and-down pattern BGS1. As illustrated in FIG. 14, the rotational angle θg of the up-and-down drive shaft 170 is increased to reach 360 degrees when the rotational angle θp reaches 142 degrees and when the rotational angle θp reaches 322 degrees, and, subsequently, kept at 360 degrees in the fourth region BS24. As illustrated in FIG. 15, the height position Hg of the upper surface of each of the grates 141 becomes lower than the position PR in mid-course of the acceleration sub-region BS21A, and then becomes higher than the position PR in mid-course of the deceleration sub-region BS23B.

The basic up-and-down pattern section BGS2B has the same pattern shape as that of the basic up-and-down pattern section BGS2A, as illustrated in FIG. 14. Thus, detailed description thereof will be omitted.

(Basic Up-and-Down Pattern BGL2 Set in Conformity to Maximum Sheet Length in Two-Sheet Feeding Mode)

Figure 16:
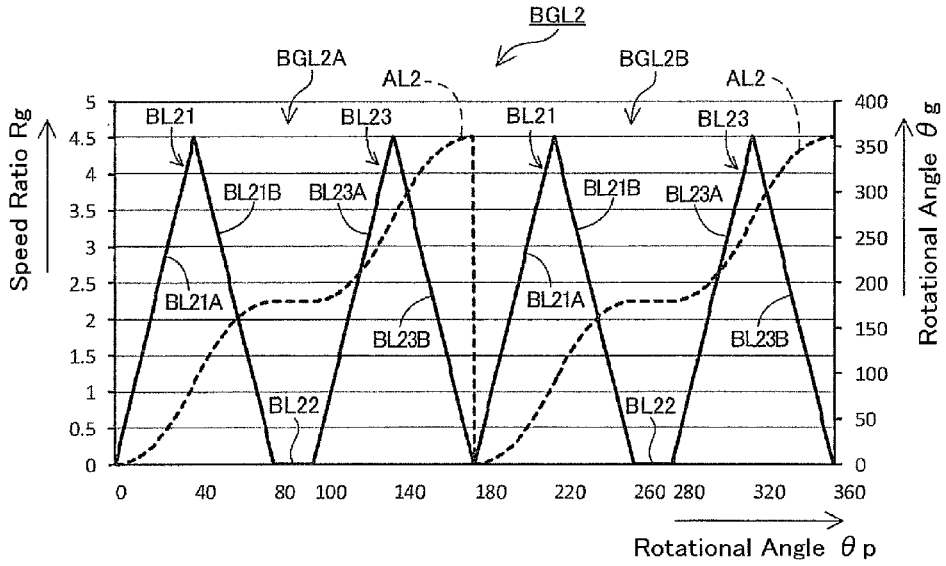
FIG. 16 is a graph illustrating one example of a basic up-and-down pattern BGL2 conforming to a maximum sheet length in the two-sheet feeding mode, and a curve AL2 representing a change in rotational angle θg of the up-and-down drive shaft, in the corrugated paperboard sheet feeding apparatus according to this embodiment.
Figure 17:
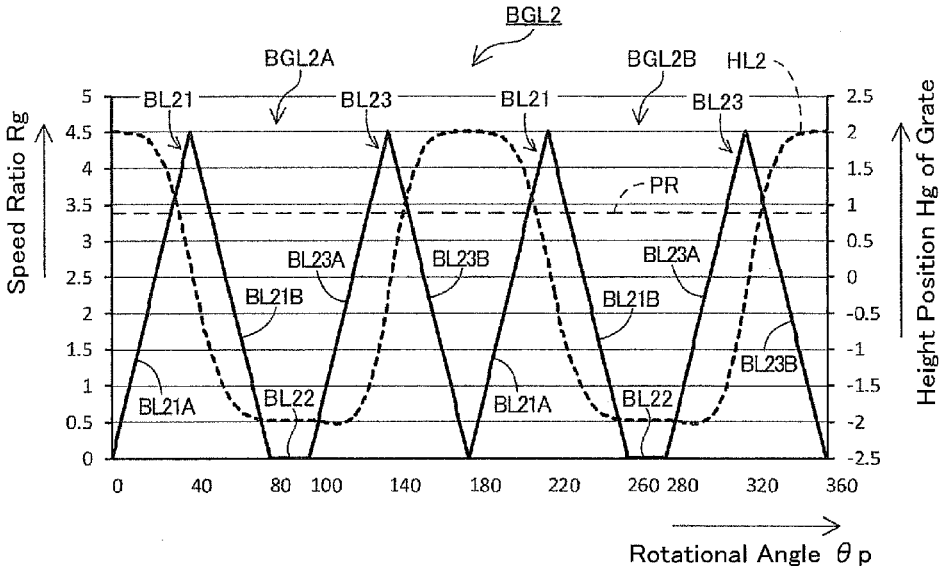
FIG. 17 is a graph illustrating one example of the basic up-and-down pattern BGL2 conforming to the maximum sheet length in the two-sheet feeding mode, and a curve HL2 representing a change in height position Hg of the upper surface of the grate, in the corrugated paperboard sheet feeding apparatus according to this embodiment.

With reference to FIGS. 16 and 17, the basic up-and-down pattern BGL2 will be described. The basic up-and-down pattern BGL2 is the remaining one of the two basic up-and-down patterns serving as a basis for creating an up-and-down speed control pattern GT for the two-sheet feeding pattern. FIGS. 16 and 17 is one example of the basic up-and-down pattern BGS2 preliminarily set in conformity to the maximum sheet length, in the embodiment.

As illustrated in FIG. 16, the basic up-and-down pattern BGL2 is composed of two basic up-and-down pattern sections BGL2A and BGL2B each having the same pattern shape. The basic up-and-down pattern section BGL2A is generated in a time period during which the rotational angle θp changes from 0 degree to 180 degrees, and the basic up-and-down pattern section BGL2B is generated in a time period during which the rotational angle θp changes from 180 degree to 360 degrees. The basic up-and-down pattern section BGL2A comprises: a first region BL21 in which the rotational angle θp changes from 0 degree to 80 degrees; a second region BL22 in which the rotational angle θp changes from 80 degree to 100 degrees; and a third region BL23 in which the rotational angle θp changes from 100 degree to 180 degrees. The basic up-and-down pattern section BGL2B comprises: a first region BL21 in which the rotational angle θp changes from 180 degree to 260 degrees; a second region BL22 in which the rotational angle θp changes from 260 degree to 280 degrees; and a third region BL23 in which the rotational angle θp changes from 280 degree to 360 degrees. Each of the basic up-and-down pattern sections BGL2A, BGL2B is devoid of a region corresponding to the fourth region BL14 of the basic up-and-down pattern BGL1.

Each of the variable-speed moving down regions BL21 of the basic up-and-down pattern sections BGL2A, BGL2B is composed of an acceleration sub-region BL21A and a deceleration sub-region BL21B. Similarly, each of the variable-speed moving-up regions BL23 of the basic up-and-down pattern sections BGL2A, BGL2B is composed of an acceleration sub-region BL23A and a deceleration sub-region BL23B. In this embodiment, a speed change rate per unit time at which the up-and-down motor 80 is accelerated in the acceleration sub-regions BL21A, BL23A is set to be equal to a speed change rate per unit time at which the up-and-down motor 80 is decelerated in the deceleration sub-regions BL21B, BL23B. The first region BL21 and the third region BL23 in each of the basic up-and-down pattern sections BGL2A, BGL2B are arranged at a time interval conforming to the maximum sheet length, in a direction causing an increase in the rotational angle θp, i.e., in the horizontal axis in FIG. 16.

The maximum sheet length can be set to a larger value, as an amount of change of the rotational angle θp in the acceleration sub-regions BL21A, BL23A and the deceleration sub-regions BL21B, BL23B is set to a smaller value as much as possible. Thus, each of the speed change rate per unit time in the acceleration sub-regions BL21A, BL23A and the speed change rate per unit time in the deceleration sub-regions BL21B, BL23B is preliminarily set based on the maximum speed change rate per unit time for the up-and-down motor 8. The speed change rate per unit time in the acceleration sub-regions and the deceleration sub-regions, and a maximum value of the speed ratio Rg in the acceleration sub-regions, are set such that a total area of four regions surrounded by four polygonal lines indicative of respective shapes of the basic up-and-down pattern sections BGL2A, BGL2B and the horizontal axis representing the rotational angle θp in FIG. 16 becomes equal to a total area of two region surrounded by two polygonal lines indicative of a shape of the basic up-and-down pattern BGS1 and the horizontal axis representing the rotational angle θp in FIG. 12. That is, each of the speed change rate per unit time in the acceleration sub-regions BL21A, BL23A and the speed change rate per unit time in the deceleration sub-regions BL21B, BL23B is set to be greater than each of the speed change rate per unit time in the acceleration sub-regions BL11A, BL13A and the speed change rate per unit time in the deceleration sub-regions BL11B, BL13B in the basic up-and-down pattern BGL1. Further, the maximum value of the speed ratio Rg in the acceleration sub-regions BL21A, BL23A is set to be greater than a maximum value of the speed ratio Rg in the acceleration sub-regions BL11A, BL13A.

As illustrated in FIG. 16, the rotational angle θg of the up-and-down drive shaft 170 reaches 360 degrees when the rotational angle θp reaches 180 degrees and when the rotational angle θp reaches 360 degrees. As illustrated in FIG. 17, the height position Hg of the upper surface of each of the grates 141 becomes lower than the position PR in mid-course of the acceleration sub-region BL21A, and then becomes higher than the position PR in mid-course of the deceleration sub-region BL23B.

The basic up-and-down pattern section BGL2B has the same pattern shape as that of the basic up-and-down pattern section BGL2A, as illustrated in FIG. 16. Thus, detailed description thereof will be omitted.

<<Operation and Functions of Embodiment>>

With reference to the drawings, an operation and functions of the corrugated paperboard box making machine 1 equipped with the corrugated paperboard sheet feeding apparatus 2 according to the above embodiment will be described below. As regards the operation and functions of the corrugated paperboard box making machine 1, a feeding operation of the corrugated paperboard sheet feeding apparatus 2 will be described in detail. On the other hand, because respective control operations of the printing control device 251, the creaser-slotter control device 252 and the die cutter control device 253 are well known, detailed description thereof will be omitted.

When an operator manipulates the order termination button 242 or when a processing of a given number of sheets is completed in a previous order, the lower-level management device 210 sends a stop instruction to the control devices 250 to 254. Subsequently, the lower-level management device 210 receives the order preparation instruction for instructing an operator to prepare for execution of a new processing order.

<Feeding Operation in Two-Sheet Feeding Mode>

A feeding operation of the corrugated paperboard sheet feeding apparatus 2 will be described, on the assumption that an operator designates the two-sheet feeding mode as a feeding mode in advance of execution of a processing order. In order to process corrugated paperboard sheets SH according to a feeding operation based on the two-sheet feeding mode, preparatory works, such as replacement of a printing die member, replacement of a slotter blade and replacement of a punching die, are performed. FIG. 6 illustrates the corrugated paperboard box making machine 1 in a state after the preparatory works for the two-sheet feeding mode are completed. After completion of the preparatory works, when an operator manipulates the feeding mode designation keys 243 of the operation panel 240 to designate the two-sheet feeding mode, the information display 244 displays a numeral, a symbol or the like corresponding to the two-sheet feeding mode.

The operation panel 240 sends a feeding mode designation signal indicative of the two-sheet feeding mode to the lower-level management device 210. The lower-level management device 210 temporarily stores the received feeding mode designation signal in a given storage area of the working memory 230. Further, according to an order preparation instruction and the feeding mode designation signal, the lower-level management device 210 issues an instruction for adjusting a rotational phase of each of the printing cylinders 30A, 31A, an instruction for positioning the slotter blades, and an instruction for adjusting a rotational phase of each of the punching dies 52A1, 52A2, respectively, to the printing control device 251, the creaser-slotter control device 252 and the die cutter control device 253.

(Creation of Roller Speed Control Pattern RT)

Upon detecting an input manipulation complete signal from the operation panel 240 after receiving from the upper-level management device 200 the order preparation instruction for preparing for execution of a processing order, the lower-level management device 210 reads out the feeding mode designation signal from the working memory 230 and sends the read-out feeding mode designation signal and the received order preparation instruction to the roller motor control device 254. According to a sheet length of the processing order contained in the order preparation instruction, and the feeding mode designation signal, the roller motor control device 254 reads out, from the basic roller drive pattern memory 261, the basic roller drive pattern BRP2 designed for the two-sheet feeding mode in conformity to the sheet length to generate a roller speed control pattern creation instruction. The roller motor control device 254 sends the roller speed control pattern creation instruction to the first motion controller 260.

Upon receiving the roller speed control pattern creation instruction from the roller motor control device 254, the first motion controller 260 reads out the roller speed control pattern creation program from the program memory 262, and executes the read-out roller speed control pattern creation program. According to the execution of the roller speed control pattern creation program, the first motion controller 260 creates a roller speed control pattern RT2 for the two-sheet feeding mode, based on a sheet conveyance speed contained in the roller speed control pattern creation instruction, and the basic roller drive pattern BRP2, and temporarily stores the roller speed control pattern RT2 in the speed control pattern memory 263.

Figure 18:
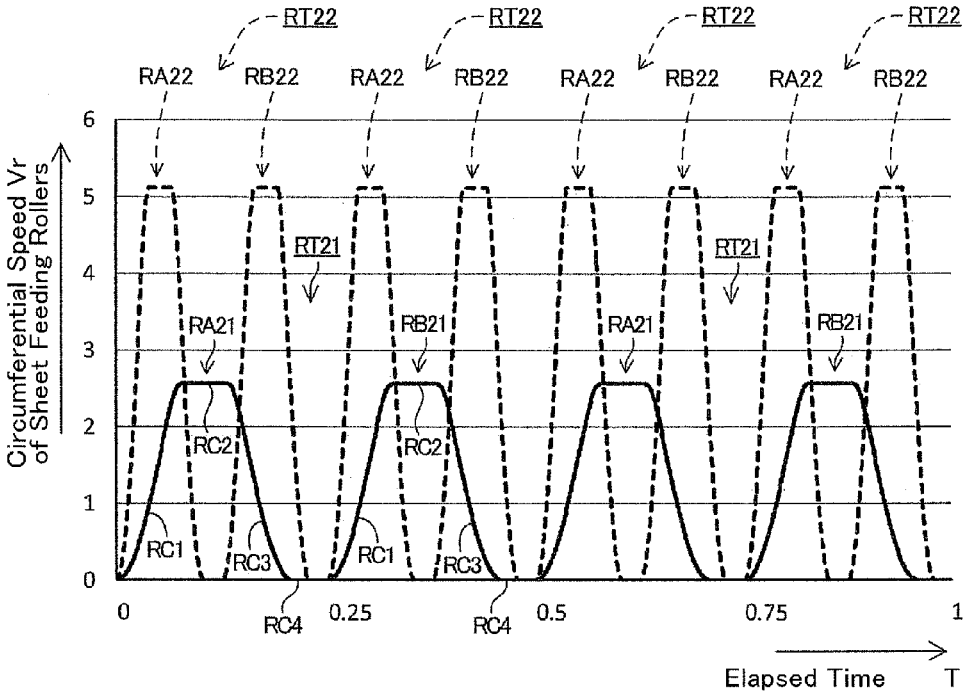
FIG. 18 is a graph illustrating a change in circumferential speed Vr of each sheet feeding roller according to a roller speed control pattern (RT21, RT22), in the corrugated paperboard sheet feeding apparatus according to this embodiment.

With reference to FIG. 18, the creation of the roller speed control pattern RT2 will be described in more detail. FIG. 18 illustrates a change in circumferential speed Vr of each of the sheet feeding rollers. In FIG. 18, the horizontal axis represents an elapsed time T by seconds, and the vertical axis represents the circumferential speed Vr of each of the sheet feeding rollers by m/sec. In FIG. 18, a roller speed control pattern RT21 indicated by the solid lines is a pattern for providing instructions on the circumferential speed Vr of each of the sheet feeding rollers in the case where a feeding speed of corrugated paperboard sheets SH is 240 sheets/min. In FIG. 18, a roller speed control pattern RT22 indicated by the broken lines is a pattern for providing instructions on the circumferential speed Vr of each of the sheet feeding rollers in the case where the feeding speed of corrugated paperboard sheets SH is 480 sheets/min.

In the case where the sheet conveyance speed contained in the roller speed control pattern creation instruction corresponds to the designated feeding speed of corrugated paperboard sheets SH, 240 sheets/min, the first motion controller 260 creates the roller speed control pattern RT21 based on the designated feeding speed, 240 sheets/min, and the basic roller drive pattern BRP2 illustrated in FIG. 9. More specifically, in the case where the feeding speed is 240 sheets/min, i.e., the rotational speed of each of the cylinders is 120 rpm, each of the printing cylinders 30A, 31A requires 0.5 sec for rotating 360 degrees, i.e. one revolution, to complete one processing cycle. Based on the designated feeding speed, 240 sheets/min, the first motion controller 260 converts the rotational angle θp in FIG. 9 to the elapsed time T. Further, based on the diameter Dp of each of the printing cylinders, and the designated feeding speed, 240 sheets/min, the first motion controller 260 converts the speed ratio Rf in FIG. 9 to the circumferential speed Vr (=Rf×Dp×π×120/60) of each of the sheet feeding rollers. Through these conversions, the first motion controller 260 creates the roller speed control pattern RT21 illustrated in FIG. 18.

The roller speed control pattern RT21 is composed of two roller speed control pattern sections RA21, RB21 each having the same pattern shape, in one processing cycle. Each of the two roller speed control pattern sections RA21, RB21 comprises, within 0.25 sec, an acceleration region RC1, a constant-speed region RC2, a deceleration region RC3, and a stop region RC4. The acceleration region RC1, the constant-speed region RC2, the deceleration region RC3 and the stop region RC4 in each of the two roller speed control pattern sections correspond, respectively, to the acceleration region BR21, the constant-speed region BR22, the deceleration region BR23, and the stop region BR24 in each of the basic roller drive pattern sections BRP2A, BRP2B.

(Creation of Order-Specific Up-and-Down Pattern DGP)

Upon receiving from the upper-level management device 200 the order preparation instruction for preparing for execution of the processing order, the lower-level management device 210 reads out the up-and-down pattern creation program stored in the program memory 220 and executes the read-out up-and-down pattern creation program. According to the execution of the up-and-down pattern creation program, the lower-level management device 210 creates an order-specific up-and-down pattern DGP conforming to the sheet length of the processing order, based on one of the four basic up-and-down patterns BGS1, BGL1, BGS2, BGL2 stored in the basic up-and-down pattern memory 270, and temporarily stores the created order-specific up-and-down pattern DGP in the order-specific up-and-down pattern memory 271. The sheet length of the processing order is designated in a range of a minimum sheet length to a maximum sheet length processable in the two-sheet feeding mode. The minimum sheet length processable in the two-sheet feeding mode is set based on the distance LF in FIG. 1, and the maximum sheet length processable in the two-sheet feeding mode is set based on one-half of an outer peripheral length of each of the printing cylinders.

Figure 19:
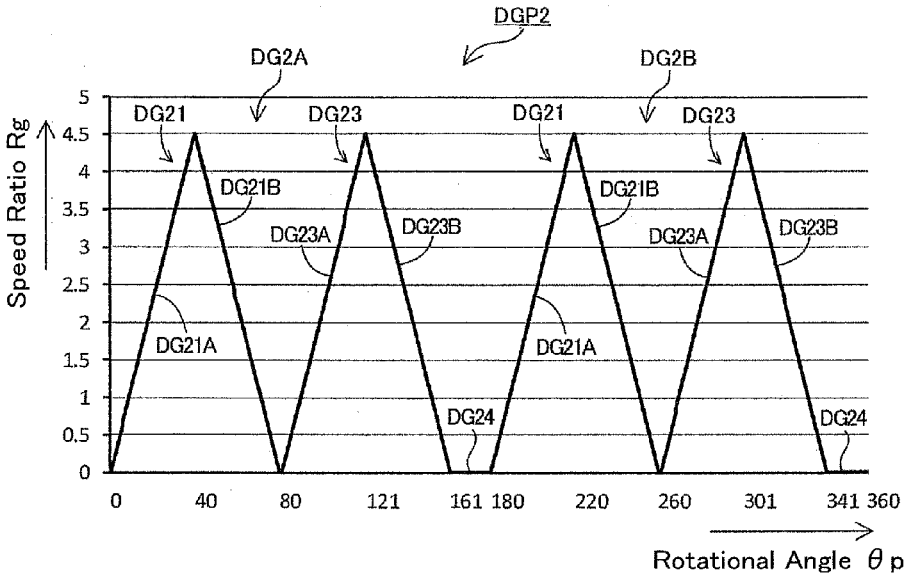
FIG. 19 is a graph illustrating one example of an order-specific up-and-down pattern DGP2 set in conformity to a sheet length of a processing order, in the corrugated paperboard sheet feeding apparatus according to this embodiment.

With reference to FIG. 19, the creation of the order-specific up-and-down pattern DGP conforming to the sheet length of the processing order will be described in more detail. FIG. 19 illustrates one example of the order-specific up-and-down pattern DGP2 conforming to the sheet length of the processing order, in the two-sheet feeding mode. For example, the sheet length of the processing order is 390 mm. In FIG. 19, the horizontal axis represents the rotational angle θp of each of the printing cylinders of the printing apparatus 3, and the vertical axis represents the speed ratio Rg of the angular speed cog of the up-and-down drive shaft 170 to the angular speed cop of each of the printing cylinders.

As illustrated in FIG. 19, an order-specific up-and-down pattern DGP2 is composed of two up-and-down pattern sections DG2A, DG2B each having the same pattern shape, in one processing cycle. Each of the roller speed control pattern sections of the up-and-down pattern sections DG2A, DG2B comprises: a first region DG21, a third region DG23 and a fourth region DG24, in a time period during which the rotational angle θp changes by 180 degrees. More specifically, the up-and-down pattern section DG2A comprises: a first region DG21 in which the rotational angle θp changes from 0 degree to 80 degrees; a third region DG23 in which the rotational angle θp changes from 80 degree to 161 degrees; and a fourth region DG24 in which the rotational angle θp changes from 161 degree to 180 degrees. The up-and-down pattern section DG2B comprises: a first region DG21 in which the rotational angle θp changes from 180 degree to 260 degrees; a third region DG23 in which the rotational angle θp changes from 260 degree to 341 degrees; and a fourth region DG24 in which the rotational angle θp changes from 341 degree to 360 degrees. Each of the first regions DG21 is composed of an acceleration sub-region DG21A and a deceleration sub-region DG21B. Similarly, each of the third regions DG23 is composed of an acceleration sub-region DG23A and a deceleration sub-region DG23B. A speed change rate per unit time in the acceleration sub-regions DG21A, DG23A and a speed change rate per unit time in the deceleration sub-regions DG21B, DG23B are set to be equal, respectively, to the speed change rate per unit time in the acceleration sub-regions BS21A, BS23A, BL21A, BL23A, and the speed change rate per unit time in the deceleration sub-regions BS21B, BS23B, BL21B, BL23B, in the basic up-and-down pattern BGP2.

In FIG. 19, the first region DG21 and the third region DG23 are arranged at a time interval set in conformity to the sheet length of the processing order, in a direction causing an increase in the rotational angle θp, i.e., in the horizontal axis in FIG. 19. Specifically, the lower-level management device 210 performs processing of moving the third region BL23 toward the first region BL21 in each of the basic up-and-down pattern sections of the basic up-and-down pattern BCL2, to create the order-specific up-and-down pattern DGP2.

(Creation of Up-and-Down Speed Control Pattern GT)

After creating the order-specific up-and-down pattern DGP2, the lower-level management device 210 generates an up-and-down speed control pattern creation instruction and sends the generated up-and-down speed control pattern creation instruction to the second motion controller 280. Upon receiving the up-and-down speed control pattern creation instruction from the lower-level management device 210, the second motion controller 280 reads out the up-and-down speed control pattern creation program from the program memory 281, and executes the read-out up-and-down speed control pattern creation program. According to the execution of the up-and-down speed control pattern creation program, the second motion controller 280 creates an up-and-down speed control pattern GT, based on a sheet conveyance speed contained in the up-and-down speed control pattern creation instruction, and the order-specific up-and-down pattern DGP2, and temporarily stores the created up-and-down speed control pattern GT in the speed control pattern memory 282.

Figure 20:
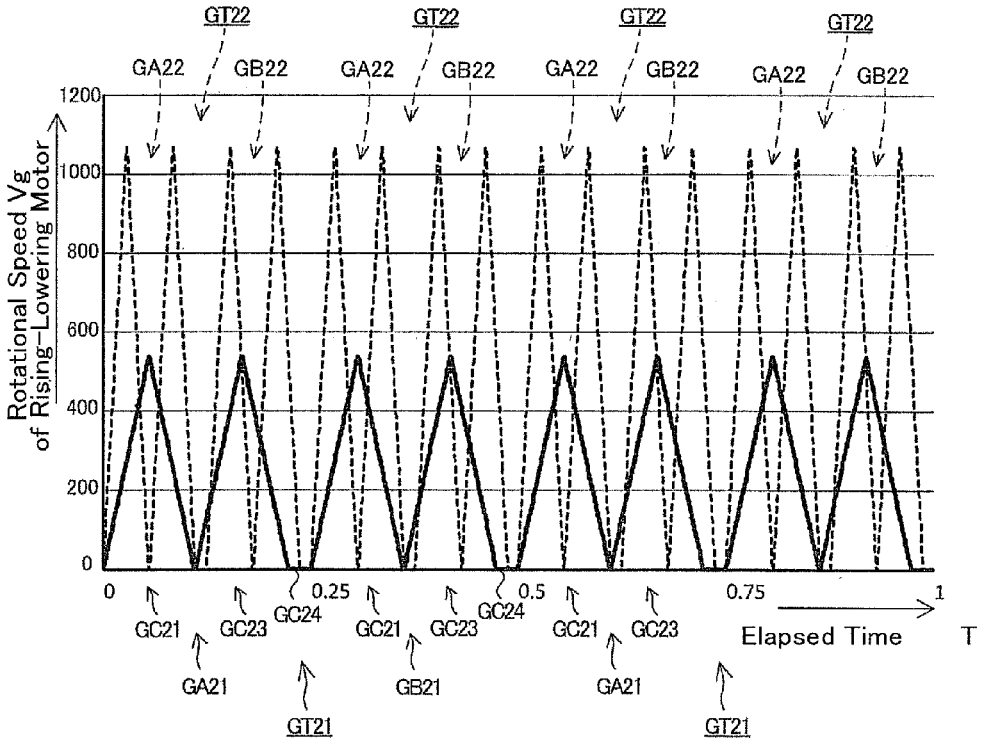
FIG. 20 is a graph illustrating one example of an up-and-down speed control pattern GT21 set in conformity to a sheet length of a processing order, one example of an up-and-down speed control pattern GT22 set in conformity to a sheet length of a processing order, in the corrugated paperboard sheet feeding apparatus according to this embodiment.
Figure 21:
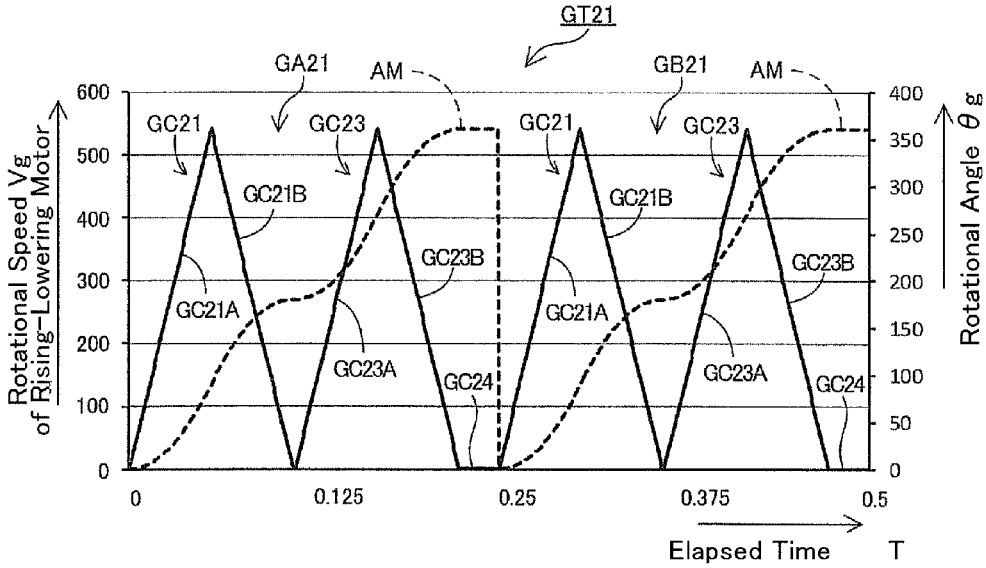
FIG. 21 is a graph illustrating one example of the up-and-down speed control pattern GT21, and a curve AM representing a change in rotational angle θg of the up-and-down drive shaft, in the corrugated paperboard sheet feeding apparatus according to this embodiment.
Figure 22:
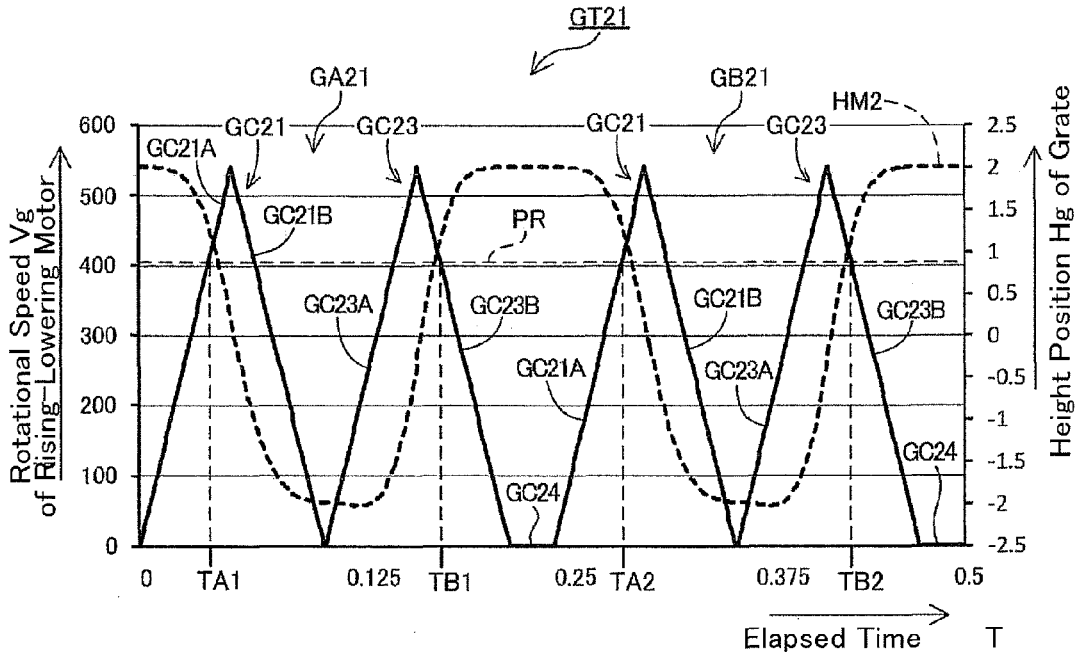
FIG. 22 is a graph illustrating one example of the up-and-down speed control pattern GT21, and a curve HM2 representing a change in height position Hg of the grate, in the corrugated paperboard sheet feeding apparatus according to this embodiment.

With reference to FIGS. 20 to 22, the creation of the up-and-down speed control pattern GT will be described in more detail. FIG. 20 illustrates a change in rotational speed Vg of the up-and-down motor 80, during feeding of corrugated paperboard sheets each having the sheet length of the processing order. In FIG. 20, the horizontal axis represents the elapsed time T by seconds, and the vertical axis represents the rotational speed Vg of the up-and-down motor 80 by m/sec. In FIG. 20, an up-and-down speed control pattern GT21 indicated by the solid lines is a pattern for providing instructions on the rotational speed Vg of the up-and-down motor 80 in the case where the rotational speed of each of the printing cylinders is 120 rpm, i.e., the feeding speed of corrugated paperboard sheets SH is 240 sheets/min in the two-sheet feeding mode. In FIG. 20, an up-and-down speed control pattern GT22 indicated by the broken lines is designed to provide instructions on the rotational speed Vg of the up-and-down motor 80 in the case where the rotational speed of each of the printing cylinders is 240 rpm, i.e., the feeding speed of corrugated paperboard sheets SH is 480 sheets/min in the two-sheet feeding mode.

In the case where the sheet conveyance speed contained in the up-and-down speed control pattern creation instruction corresponds to the designated feeding speed of corrugated paperboard sheets SH, 240 sheets/min, the second motion controller 280 creates the up-and-down speed control pattern GT21 based on 240 sheets/min as the feeding speed and the order-specific up-and-down pattern DGP2 illustrated in FIG. 19. More specifically, in the case where the feeding speed is 240 sheets/min, each of the printing cylinders 30A, 31A requires 0.5 sec for rotating 360 degrees, i.e. one revolution. Based on the designated feeding speed, 240 sheets/min, the second motion controller 280 converts the rotational angle θp in FIG. 19 to the elapsed time T. Further, based on the designated feeding speed, 240 sheets/min, i.e., the designated rotational speed of each of the printing cylinders, 120 rpm, the second motion controller 280 converts the speed ratio Rf in FIG. 19 to the rotational speed Vg (=Rg×120) of the up-and-down motor. Through these conversions, the second motion controller 280 creates the up-and-down speed control pattern GT21 illustrated in FIG. 20. On the other hand, in the case where the feeding speed of corrugated paperboard sheets SH in the two-sheet feeding mode is 480 sheets/min, the second motion controller 280 creates the up-and-down speed control pattern GT22, based on the feeding speed "480 sheets/min" and the order-specific up-and-down pattern DGP2 illustrated in FIG. 19.

As illustrated in FIG. 20, the up-and-down speed control pattern GT21 is composed of two up-and-down speed control pattern sections GA21, GB21 each having the same pattern shape, in one processing cycle. Each of the two up-and-down speed control pattern sections GA21, GB21 comprises, within 0.25 sec, a first region GC21, a third region GC23, and a fourth region GC24.

FIGS. 21 and 22 enlargedly illustrate the up-and-down speed control pattern GT21 in a time period during which each of the printing cylinders rotates 360 degrees, i.e., in one processing cycle. In FIG. 21, the horizontal axis represents the elapsed time T by seconds, and the left vertical axis and the right vertical axis represent, respectively, the rotational speed Vg of the up-and-down motor 80 by rpm, and the rotational angle θg of the up-and-down drive shaft 170. A curve AM indicated by the broken line in FIG. 21 represents a change in the rotational angle θg of the up-and-down drive shaft 170. In FIG. 22, the horizontal axis represents the elapsed time T by seconds, and the left vertical axis and the right vertical axis represent, respectively, the rotational speed Vg of the up-and-down motor 80 by rpm, and the height position Hg of the upper surface of each of the grates 141 by mm, on the basis of the upper surface of the table 20. A curve HAM indicated by the broken line in FIG. 22 represents a change in the height position Hg of the upper surface of each of the grates 141. A position PR indicated by the broken line in FIG. 22 represents a position of the uppermost point of the outer peripheral surface of each of the sheet feeding rollers.

Specifically, as illustrated in FIG. 21, the up-and-down speed control pattern section GA21 comprises: a first region GC21, a second region GC23 and a fourth region GC24, in a time period during which the elapsed time T changes from 0 sec to 0.25 sec. As with the up-and-down speed control pattern section GA21, the up-and-down speed control pattern section GB21 comprises: a first region GC21, a third region GC23 and a fourth region GC24, in a time period during which the elapsed time T changes from 0.25 sec to 0.5 sec. The first region GC21 comprises an acceleration sub-region GC21A and a deceleration sub-region GC21B. The third region GC23 comprises an acceleration sub-region GC23A and a deceleration sub-region GC23B. The first region GC21, the third region GC23 and the fourth region GC24 correspond, respectively, to the first region DG21, the third region DG23 and the fourth region DG24 each illustrated in FIG. 19.

As illustrated in FIG. 21, the rotational angle θg of the up-and-down drive shaft 170 is increased to reach 360 degrees at a time point of termination of the deceleration sub-region GC23B of the third region GC23, and subsequently, kept at 360 degrees in the fourth region GC24. As illustrated in FIG. 22, the height position Hg of the upper surface of each of the grates 141 becomes lower than the position PR in mid-course of the acceleration sub-region GC21A, and then becomes higher than the position PR in mid-course of the deceleration sub-region GC23B.

(Feeding Operation of Corrugated Paperboard Sheet SH)

Figure 23:
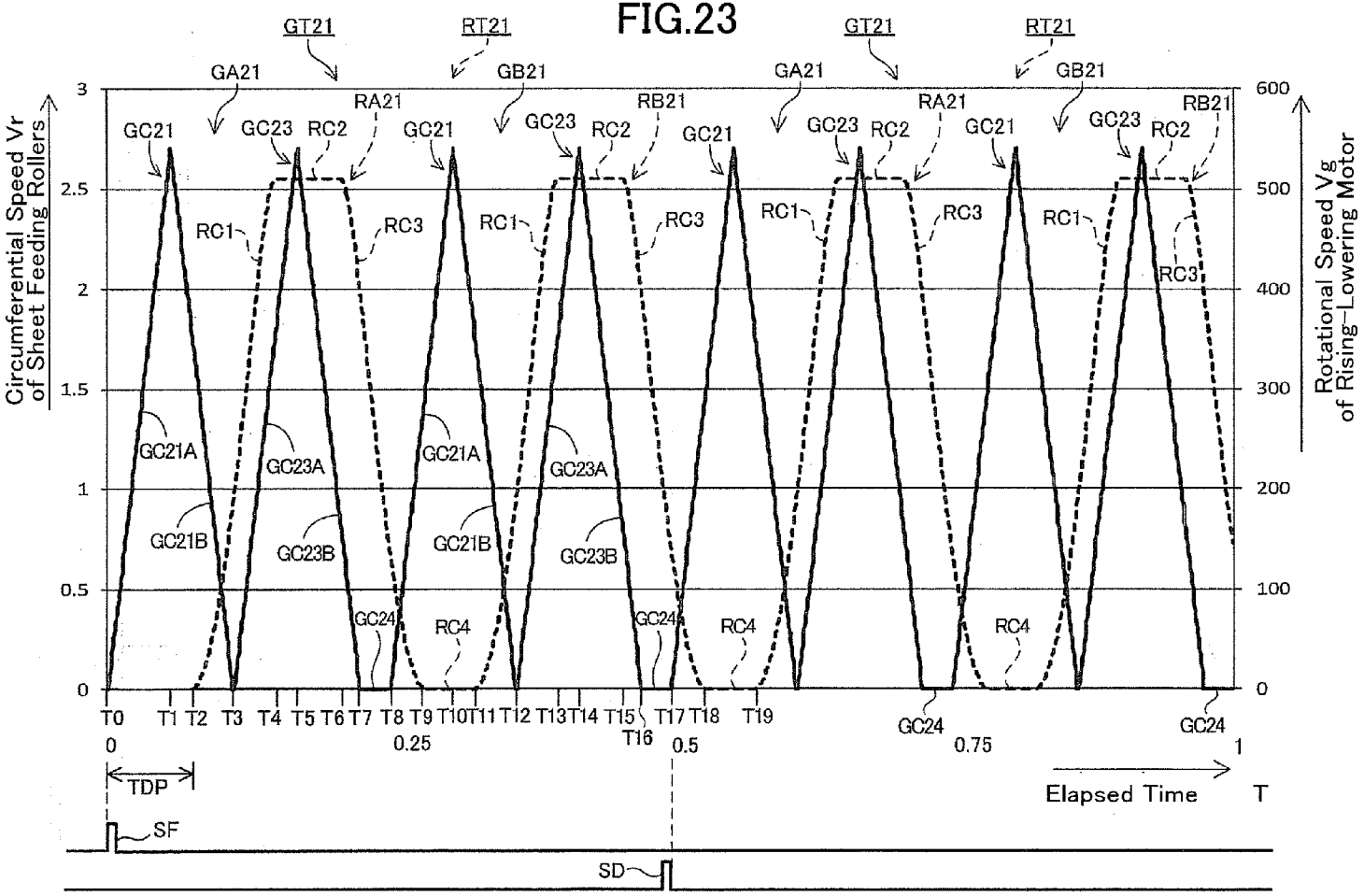
FIG. 23 is a timing chart presenting a temporal relationship between respective ones of a roller speed control pattern RT21, an up-and-down speed control pattern GT21, a feeding start signal SF and a detection signal SD each set for the two-sheet feeding mode, in the corrugated paperboard sheet feeding apparatus according to this embodiment.
Figure 24:
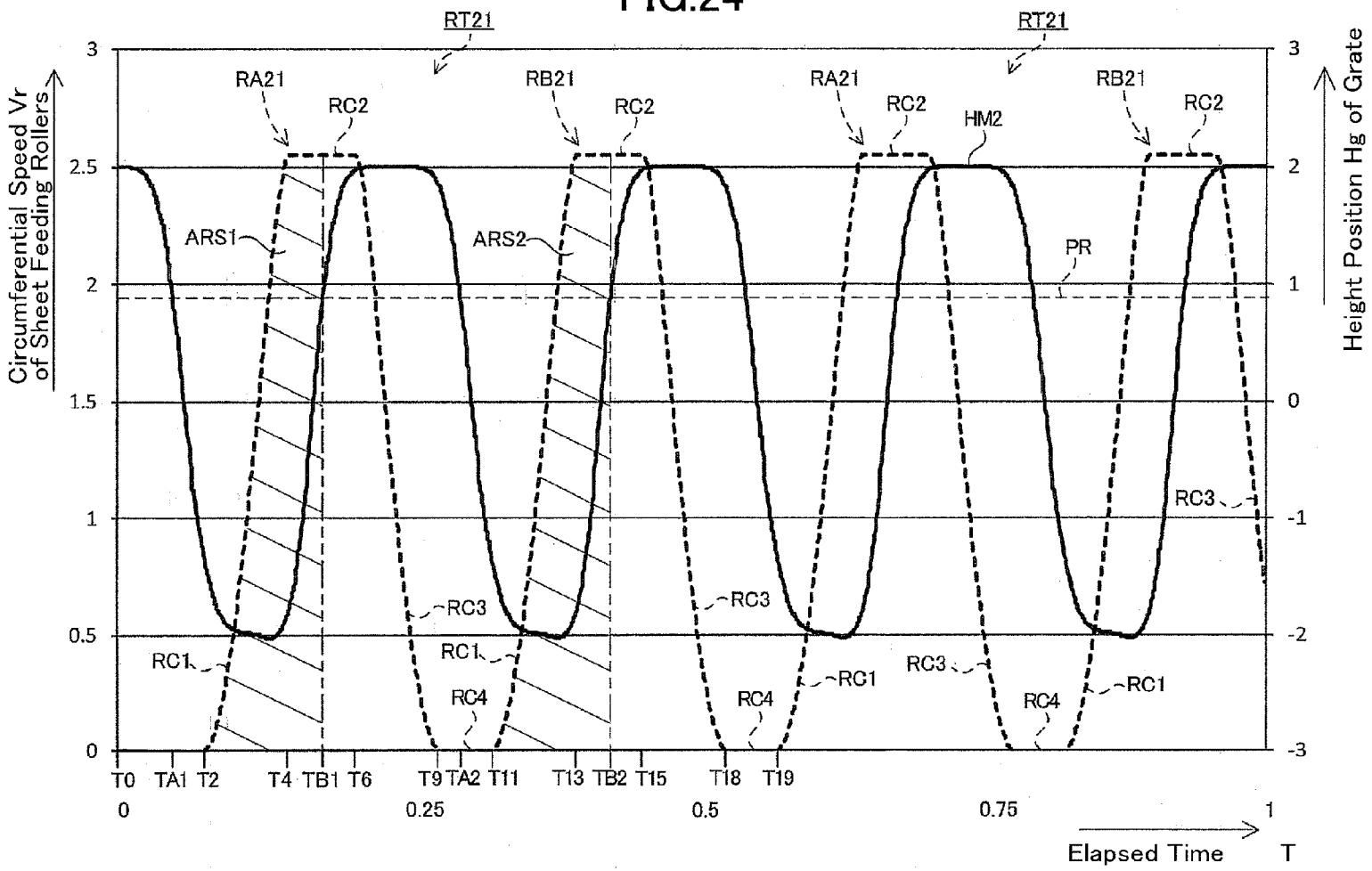
FIG. 24 is a timing chart presenting a temporal relationship between the roller speed control pattern RT21 and the curve HM2 representing a change in height position Hg of the upper surface of the grate 141 each set for the two-sheet feeding mode, in the corrugated paperboard sheet feeding apparatus according to this embodiment.

With reference to FIGS. 23 and 24, an operation of feeding corrugated paperboard sheets SH under the condition that the feeding speed is 240 sheets/min in the two-sheet feeding mode will be described. FIG. 23 is a timing chart presenting a temporal relationship between respective ones of the roller speed control pattern RT21, the up-and-down speed control pattern GT21, the feeding start signal SF from the operation panel 240, and the detection signal SD from the rotational position sensor 190. In FIG. 23, the horizontal axis represents the elapsed time T by seconds, and the left vertical axis and the right vertical axis represent, respectively, the circumferential speed Vr of each of the sheet feeding rollers by m/sec, and the rotational speed Vg of the up-and-down motor 80 by rpm. FIG. 24 is a timing chart presenting a temporal relationship between the roller speed control pattern RT21 and the curve HM2 representing a change in the height position Hg of the upper surface of each of the grates 141, in the corrugated paperboard sheet feeding apparatus according to this embodiment. In FIG. 24, the horizontal axis represents the elapsed time T by seconds, and the left vertical axis and the right vertical axis represent, respectively, the circumferential speed Vr of each of the sheet feeding rollers by m/sec, and the height position Hg of the upper surface of each of the grates 141 by mm.

After completion of the preparation for execution of the processing order, when an operator manipulates the feeding button 241, the lower-level management device 210 receives the feeding start signal SF from the operation panel 240. In response to the received feeding start signal SF, the lower-level management device 210 sends control instruction information containing the feeding start instruction and the sheet conveyance speed to each of the drive control device 250 and the roller motor control device 254, and sends, as the motion start instruction, the control instruction information to the second motion controller 280.

In conformity to the sheet conveyance speed contained in the control instruction information, the drive control device 250 rotationally drives the main drive motor MT at a rotational speed corresponding to the sheet conveyance speed. Along with the rotation of the main drive motor MT, the printing cylinders 30A, 31A of the printing units 30, 31, the upper slotters of the slotter units 41, 42 and others are rotated at a feeding speed corresponding to the sheet conveyance speed, e.g., at the designated feeding speed, 240 sheets/min, in the two-sheet feeding mode.

In response to the motion start instruction, the second motion controller 280 reads out each of the speed control instructions of the up-and-down speed control pattern GT21 from the speed control pattern memory 282 with a given control cycle, and sequentially send the read-out speed control instructions to the drive control circuit 283. Based on the speed control instructions, and a frequency of the rotation pulses from the encoder 85, the drive control circuit 283 controls the rotational speed of the up-and-down motor 80 to allow the rotational speed of the up-and-down motor 80 to become equal to a rotational speed Vg according to the up-and-down speed control pattern section GA21 illustrated in FIG. 23.

As illustrated in FIG. 23, the rotational speed of the up-and-down motor 80 is accelerated from a time point T0 just after the generation of the feeding start signal SF at the speed change rate per unit time in the acceleration sub-region GC21A of the up-and-down speed control pattern section GA21. When the elapsed time T reaches a time point T1, the rotational speed of the up-and-down motor 80 is decelerated at the speed change rate per unit time in the deceleration sub-region GC21B. When the elapsed time T reaches a time point T3, the rotation of the up-and-down motor 80 is stopped. In a time period from the time point T0 to the time point T3, each of the grates 141 is moved down from the uppermost position and moved to the lowermost position. The upper surface of each of the grates 141 is moved down to reach the position PR of the uppermost point of the outer peripheral surface of each of the sheet feeding rollers, at a time point TA1 illustrated in FIG. 24, and, subsequently, further moved down toward the lowermost position.

In order to set a start time point T2 of the acceleration region RC1 of roller speed control pattern RT21, the roller motor control device 254 calculates a time period TDP from the time point T0 to the time point T2, based on the feeding speed corresponding to the sheet conveyance speed contained in the control instruction information, and the phase-difference set value DPP stored in the program memory 262. Until the elapsed time T becomes equal to the time period TDP, the roller motor control device 254 does not generate any motion start instruction. Thus, the drive control circuit 264 keeps the roller motors 90, 91, 102, 103 in the stopped state, in the time period TDP from the time point T0 just after the generation of the feeding start signal SF.

When the elapsed time T becomes equal to the time period TDP, the roller motor control device 254 generates the motion start instruction and sends it to the first motion controller 260. In response to the received motion start instruction, the first motion controller 260 reads out each of the speed control instructions of the roller speed control pattern RT21 from the speed control pattern memory 263 with a given control cycle, and, after converting the read-out speed control instructions to rotational speed control instructions to each of the roller motors, sequentially send the rotational speed control instructions to the drive control circuit 264. Specifically, the read-out speed control instructions are converted to rotational speed control instructions to each of the roller motors, based on the diameter Dr of each of the sheet feeding rollers. Based on the rotational speed control instructions, and the frequency of the rotation pulses from each of the group of encoders 100, 106, 112, 113, the drive control circuit 264 controls the rotational speed of each of the roller motors 90, 91, 102, 103 to allow the rotational speed of each of the roller motors to become equal to a rotational speed a rotational speed according to the roller speed control pattern RT21 illustrated in FIG. 23.

As illustrated in FIG. 23, the elapsed time T reaches the time point T2, the rotational speed of each of the roller motors is accelerated at the speed change rate per unit time in the acceleration region RC1 of the roller speed control pattern RT21. Thus, each of the sheet feeding rollers in the stopped state starts rotating. The time point T2 is later than the time point TA1 as illustrated in FIG. 24. Therefore, when each of the sheet feeding rollers starts rotating, the lower surface of a bottommost one of the stacked corrugated paperboard sheets SH is in contact with the sheet feed rollers, so that the bottommost corrugated paperboard sheet SH is fed out in the feeding direction FD.

Among the speed control instructions for providing instructions on the rotational speed Vg of the up-and-down motor 80, one speed control instruction at the time point T3 designates a rotation speed of "0", so that the up-and-down motor 80 is in an approximately stopped state or in a rotating state at an extremely low speed, in a given time range around the time point T3. Two or more of the speed control instructions generated in the given time range around the time point T3 correspond to those for the second region in which the rotational speed of the up-and-down motor 80 is controlled to allow the upper surface of each of the grates 141 to be located below the position PR of the uppermost point of the outer peripheral surface of each of the sheet feeding rollers 124 to 127. The up-and-down motor 80 is accelerated in a time period from the time point T3 to a time point T5, according to the speed control instructions in the acceleration sub-region GC23A of the third region GC23, and decelerated in a time period from the time point T5 to a time point T7, according to the speed control instructions in the deceleration sub-region GC23B of the third region GC23. In a time period from the time point T3 to the time point T7, each of the grates 141 is moved up from the lowermost position and moved to the uppermost position. The upper surface of each of the grates 141 is moved up to reach the position PR of the uppermost point of the outer peripheral surface of each of the sheet feeding rollers, at a time point TB1 illustrated in FIG. 24, and, subsequently, further moved up toward the uppermost position. In a time period from the time point T7 to a time point T8, the up-and-down motor 80 is kept in the stopped state according to the speed control instructions in the fourth region GC24.

When the elapsed time T reaches the time point T8, the rotational speed of the up-and-down motor 80 is accelerated at the speed change rate per unit time in the acceleration sub-region GC21A of the up-and-down speed control pattern section GA21. When the elapsed time T reaches a time point T10, the rotational speed of the up-and-down motor 80 is decelerated at the speed change rate per unit time in the deceleration sub-region GC21B. When the elapsed time T reaches a time point T12, the rotation of the up-and-down motor 80 is stopped. In a time period from the time point T8 to the time point T13, each of the grates 141 is moved down from the uppermost position and moved to the lowermost position. The upper surface of each of the grates 141 is moved down to reach the position PR of the uppermost point of the outer peripheral surface of each of the sheet feeding rollers, at a time point TA2 illustrated in FIG. 24, and, subsequently, further moved down toward the lowermost position.

Among the speed control instructions for providing instructions on the rotational speed Vg of the up-and-down motor 80, one speed control instruction at the time point T12 designates a rotation speed of "0", so that the up-and-down motor 80 is in an approximately stopped state or in a rotating state at an extremely low speed, in a given time range around the time point T12. Two or more of the speed control instructions generated in the given time range around the time point T12 correspond to those for the second region in which the rotational speed of the up-and-down motor 80 is controlled to allow the upper surface of each of the grates 141 to be located below the position PR of the uppermost point of the outer peripheral surface of each of the sheet feeding rollers 124 to 127. The up-and-down motor 80 is accelerated in a time period from the time point T12 to a time point T14, according to the speed control instructions in the acceleration sub-region GC23A of the third region GC23, and decelerated in a time period from the time point T14 to a time point T16, according to the speed control instructions in the deceleration sub-region GC23B of the third region GC23. In a time period from the time point T12 to the time point T16, each of the grates 141 is moved up from the lowermost position and moved to the uppermost position. The upper surface of each of the grates 141 is moved up to reach the position PR of the uppermost point of the outer peripheral surface of each of the sheet feeding rollers, at a time point TB2 illustrated in FIG. 24, and, subsequently, further moved up toward the uppermost position. In a time period from the time point T16 to a time point T17, the up-and-down motor 80 is kept in the stopped state according to the speed control instructions in the fourth region GC24.

In order to generate the speed control instructions in a time period from the time point T0 to the time point T17, as a first readout operation, the second motion controller 280 reads out all of the speed control instructions in the three regions GC21, GC23, GC24 of the up-and-down speed control pattern section GA21 and in three regions GC21, GC23, GC24 of the up-and-down speed control pattern section GB21, from the speed control pattern memory 282. The speed control instructions in the three regions GC21, GC23, GC24 of the up-and-down speed control pattern section GA21 are used to feed a first one of two corrugated paperboard sheets SH in one processing cycle, and the speed control instructions in three regions GC21, GC23, GC24 of the up-and-down speed control pattern section GB21 are used to feed a second one of the two corrugated paperboard sheets SH in the same processing cycle. In this embodiment, the feeding speed in the two-sheet feeding mode is 240 sheets/min. Thus, the time period from the time point T0 to the time point T17 is 0.5 sec.

When the elapsed time T reaches the time point 17, the lower-level management device 210 receives a first detection signal SD from the rotational position sensor 190. In response to receiving the detection signal SD, the lower-level management device 210 sends control instruction information containing the synchronization instruction and the sheet conveyance speed, to each of the drive control device 250 and the roller motor control device 254, and sends, as the motion start instruction, the control instruction information to the second motion controller 280. According to the sheet conveyance speed contained in the control instruction information, the drive control device 250 continues to rotationally drive the main drive motor MT at a rotational speed corresponding to the sheet conveyance speed.

In response to the motion start instruction, the second motion controller 280 reads out each of the speed control instructions of the up-and-down speed control pattern GT21 from the speed control pattern memory 282 with a given control cycle, and sequentially send the read-out speed control instructions to the drive control circuit 283. As a second readout operation, the second motion controller 280 reads out all of the speed control instructions in the three regions GC21, GC23, GC24 of the up-and-down speed control pattern sections GA21, GB21 in the same up-and-down speed control pattern GT21, from the speed control pattern memory 282. The speed control instructions in the three regions GC21, GC23, GC24 of the up-and-down speed control pattern section GA21 are used to feed a first one of two corrugated paperboard sheets SH in the next processing cycle, and the speed control instructions in three regions GC21, GC23, GC24 of the up-and-down speed control pattern section GB21 are used to feed a second one of the two corrugated paperboard sheets SH in the same processing cycle. After the time point T17, in response to each motion start instruction based on the detection signal SD, the second motion controller 280 repeatedly performs the same control processing as that in the time period from the time point T0 to the time point T17.

In a time period from the time point T2 to a time point T4, each of the roller motors is accelerated at the speed change rate per unit time in the acceleration region RC1 of the roller speed control pattern section RA21, to a rotational speed corresponding to the designated feeding speed in the two-sheet feeding mode, 240 sheets/min. Subsequently, in a time period from the time point T4 to a time point T6, each of the roller motors is kept at a rotational speed corresponding to the designated feeding speed, in the constant-speed region RC2. In a time period from the time point T6 to a time point T9, each of the roller motors is decelerated from the designated feeding speed, at the speed change rate per unit time the deceleration region RC3. In a time period from the time point T9 to a time point T11, each of the roller motors is kept in the stopped state, in the stop region RC4.

When the elapsed time T reaches the time point T11, in a time period from the time point T11 to a time point T13, each of the roller motors is accelerated at the speed change rate per unit time in the acceleration region RC1 of the roller speed control pattern section RA21, to the rotational speed corresponding to the designated feeding speed in the two-sheet feeding mode, 240 sheets/min. Subsequently, in a time period from the time point T13 to a time point T15, each of the roller motors is kept at a rotational speed corresponding to the designated feeding speed, in the constant-speed region RC2. In a time period from the time point T15 to a time point T18, each of the roller motors is decelerated from the designated feeding speed, at the speed change rate per unit time the deceleration region RC3. In a time period from the time point T18 to a time point T19, each of the roller motors is kept in the stopped state, in the stop region RC4.

In order to generate the speed control instructions in a time period from the time point T2 to the time point T19, as a first readout operation, the first motion controller 260 reads out all of the speed control instructions in the four regions RC1 to RC4 of each of the roller speed control pattern sections RA21, RB21 of the roller speed control pattern RT21, from the speed control pattern memory 263. The speed control instructions in the four regions RC1 to RC4 of the roller speed control pattern section RA21 are used to feed a first one of two corrugated paperboard sheets SH in one processing cycle, and the speed control instructions in the four regions RC1 to RC4 of the roller speed control pattern section RB21 are used to feed a second one of the two corrugated paperboard sheets SH in the same processing cycle. In this embodiment, the feeding speed in the two-sheet feeding mode is 240 sheets/min. Thus, the time period from the time point T2 to the time point T19 is 0.5 sec.

At the time point T19 after the elapse of the time period TDP from the time point T17 when receiving the synchronization instruction based on the detection signal SD, the roller motor control device 254 generates the motion start instruction and sends it to the first motion controller 260.

In response to the received motion start instruction, the first motion controller 260 reads out each of the speed control instructions of the roller speed control pattern RT21 from the speed control pattern memory 263 with a given control cycle, and sequentially send the read-out speed control instructions to the drive control circuit 264. As a second readout operation, the first motion controller 260 reads out all of the speed control instructions in the four regions RC1 to RC4 of each of the roller speed control pattern sections RA21, RB21 of the roller speed control pattern RT21, from the speed control pattern memory 263. The speed control instructions in the four regions RC1 to RC4 of the roller speed control pattern section RA21 are used to feed a first one of two corrugated paperboard sheets SH in the next processing cycle, and the speed control instructions in the four regions RC1 to RC4 of the roller speed control pattern section RB21 are used to feed a second one of the two corrugated paperboard sheets SH in the same processing cycle. After the time point T19, in response to each motion start instruction based on the synchronization instruction, the first motion controller 260 repeatedly performs the same control processing as that in the time period from the time point T2 to the time point T19.

A first one on two corrugated paperboard sheets SH in one processing cycle starts to be fed from the time point T2, and is released from the sheet feeding rollers at the time point TB1 illustrated in FIG. 24. A distance by which the first corrugated paperboard sheet SH is fed by the sheet feeding rollers corresponds to an area ARS1 of the shaded region in FIG. 24, and depends on the sheet length. A second one of the two corrugated paperboard sheets SH in the same processing cycle starts to be fed from the time point T11, and is released from the sheet feeding rollers at the time point TB2 which is later than the time point T11. A distance by which the second corrugated paperboard sheet SH is fed by the sheet feeding rollers corresponds to an area ARS2 of the shaded region in FIG. 24, and depends on the sheet length.

<Up-and-Down Speed Control Pattern GT21-1 Set in Conformity to Minimum Sheet Length>

Figure 25:
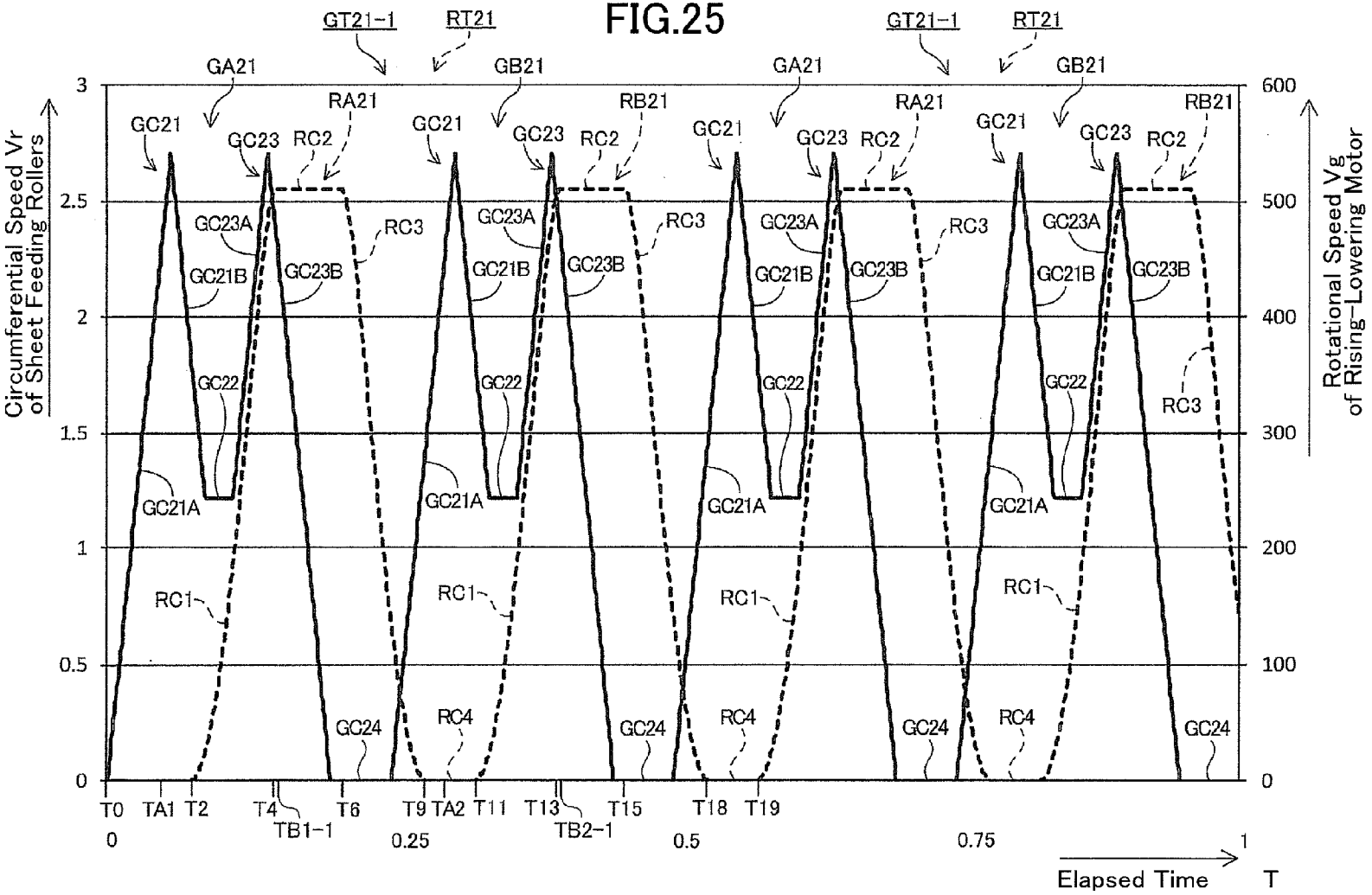
FIG. 25 is a timing chart presenting a temporal relationship between the roller speed control pattern RT21 and an up-and-down speed control pattern GT21-1 in the case where corrugated paperboard sheets SH each having the minimum sheet length are fed in the two-sheet feeding mode, in the corrugated paperboard sheet feeding apparatus according to this embodiment.

With reference to FIG. 25, an up-and-down speed control pattern GT21-1 set in conformity to the minimum sheet length will be described. FIG. 25 is a timing chart presenting a temporal relationship between the roller speed control pattern RT21 and the up-and-down speed control pattern GT21-1, in the case where corrugated paperboard sheets SH to be fed in the two-sheet feeding mode have the minimum sheet length. In the up-and-down speed control pattern GT21-1 illustrated in FIG. 25, the same or corresponding portion or region as/to that in the up-and-down speed control pattern GT21 illustrated in FIG. 23 will be described by assigning the same reference sign. A roller speed control pattern RT21 illustrated in FIG. 25 is the same as the roller speed control pattern RT21 illustrated in FIG. 23.

In the up-and-down speed control pattern GT21-1 illustrated in FIG. 25, the upper surface of each of the grates 141 is moved down to reach the position PR of the uppermost point of the outer peripheral surface of each of the sheet feeding rollers at the time point TA1, and, subsequently, further moved down toward the lowermost position, as with the up-and-down speed control pattern GT21 illustrated in FIG. 23. However, differently from the up-and-down speed control pattern section GA21 of the up-and-down speed control pattern GT21 illustrated in FIG. 23, in an up-and-down speed control pattern section GA21 of the up-and-down speed control pattern GT21-1 illustrated in FIG. 25, the upper surface of each of the grates 141 is moved up to reach the position PR of the uppermost point of the outer peripheral surface of each of the sheet feeding rollers at a time point TB1-1 which is earlier than the time point TB1 in FIG. 24, and, subsequently, further moved up toward the uppermost position. A time point of termination of a deceleration sub-region GC23B of the up-and-down speed control pattern section GA21 of the up-and-down speed control pattern GT21-1 becomes earlier than the time point T7 in FIG. 23.

<Up-and-Down Speed Control Pattern GT21-2 Set in Conformity to Maximum Sheet Length>

Figure 26:
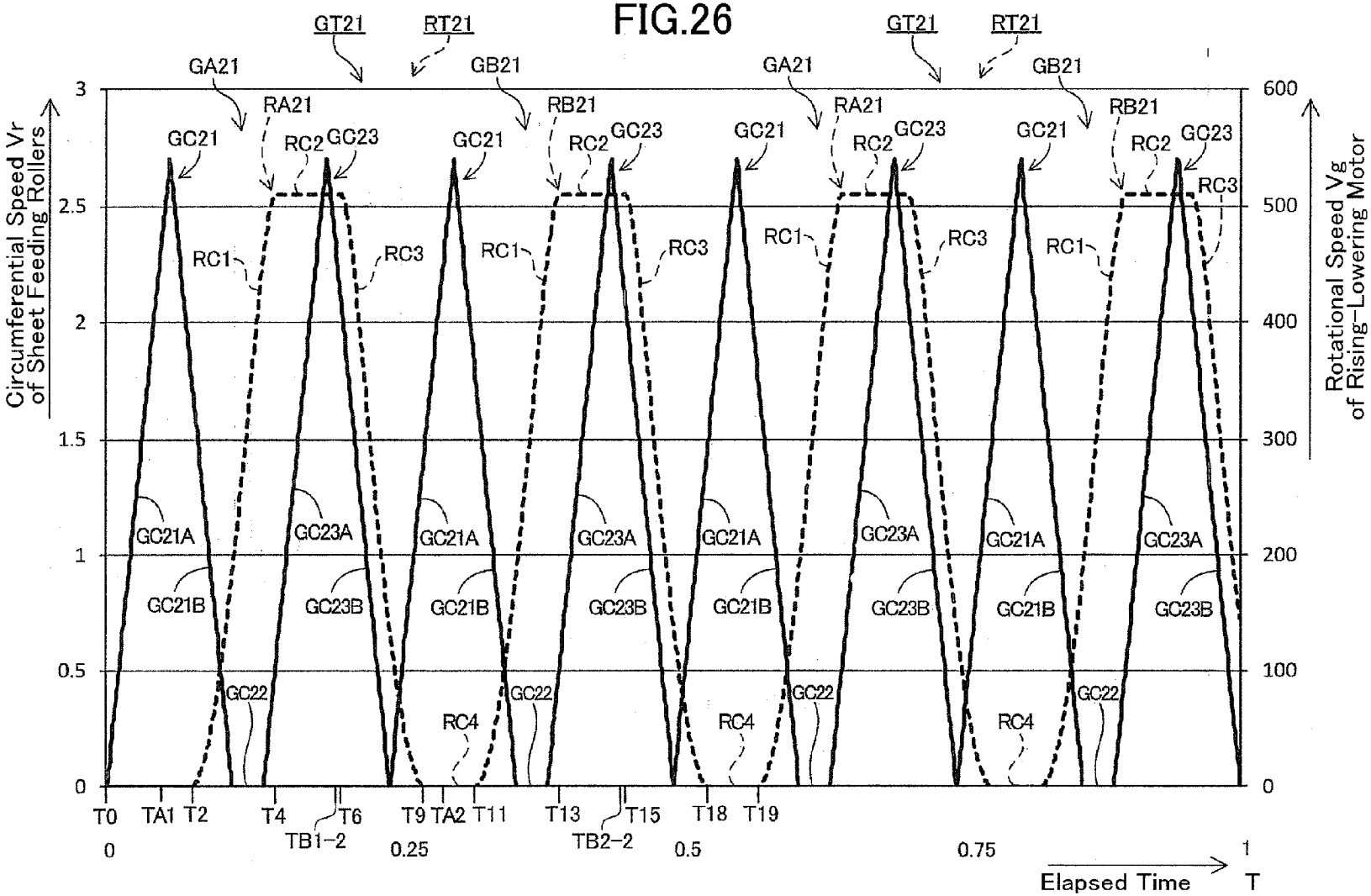
FIG. 26 is a timing chart presenting a temporal relationship between the roller speed control pattern RT21 and an up-and-down speed control pattern GT21-2 in the case where corrugated paperboard sheets SH each having the maximum sheet length are fed in the two-sheet feeding mode, in the corrugated paperboard sheet feeding apparatus according to this embodiment.

With reference to FIG. 26, an up-and-down speed control pattern GT21-2 set in conformity to the maximum sheet length will be described. FIG. 26 is a timing chart presenting a temporal relationship between the roller speed control pattern RT21 and the up-and-down speed control pattern GT21-2, in the case where corrugated paperboard sheets SH to be fed in the two-sheet feeding mode have the maximum sheet length. In the up-and-down speed control pattern GT21-2 illustrated in FIG. 26, the same or corresponding portion or region as/to that in the up-and-down speed control pattern GT21 illustrated in FIG. 23 will be described by assigning the same reference sign. A roller speed control pattern RT21 illustrated in FIG. 26 is the same as the roller speed control pattern RT21 illustrated in FIG. 23.

In the up-and-down speed control pattern GT21-2 illustrated in FIG. 26, the upper surface of each of the grates 141 is moved down to reach the position PR of the uppermost point of the outer peripheral surface of each of the sheet feeding rollers at the time point TA1, and, subsequently, further moved down toward the lowermost position, as with the up-and-down speed control pattern GT21 illustrated in FIG. 23. However, differently from the up-and-down speed control pattern section GA21 of the up-and-down speed control pattern GT21 illustrated in FIG. 23, in an up-and-down speed control pattern section GA21 of the up-and-down speed control pattern GT21-2 illustrated in FIG. 26, the upper surface of each of the grates 141 is moved up to reach the position PR of the uppermost point of the outer peripheral surface of each of the sheet feeding rollers at a time point TB1-2 which is later than the time point TB1 in FIG. 24, and, subsequently, further moved up toward the uppermost position. A time point of termination of a deceleration sub-region GC23B of the up-and-down speed control pattern section GA21 of the up-and-down speed control pattern GT21-2 becomes later than the time point T6 which is a time point of termination of the constant-speed region RC2 of the roller speed control pattern section RA21 of the roller speed control pattern RT21. That is, the constant-speed region RC2 of the roller speed control pattern section RA21 of the roller speed control pattern RT21 is continued after the time point TB1-2 at which the upper surface of each of the grates 141 is moved up to reach the position PR, and terminated at the time point 6 which is earlier than the time point of termination of the deceleration sub-region GC23B of the up-and-down speed control pattern section GA21 of the up-and-down speed control pattern GT21-2.

<Feeding Operation in One-Sheet Feeding Mode>

A feeding operation of the corrugated paperboard sheet feeding apparatus 2 will be described, on the assumption that an operator designates the one-sheet feeding mode as a feeding mode in advance of execution of a processing order. In order to process corrugated paperboard sheets SH according to a feeding operation based on the one-sheet feeding mode, preparatory works, such as replacement of a printing die member, replacement of a slotter blade and replacement of a punching die, are performed. FIG. 1 illustrates the corrugated paperboard box making machine 1 in a state after the preparatory works for the one-sheet feeding mode are completed. After completion of the preparatory works, when an operator manipulates the feeding mode designation keys 243 of the operation panel 240 to designate the one-sheet feeding mode, the information display 244 displays a numeral, a symbol or the like corresponding to the one-sheet feeding mode.

The operation panel 240 sends a feeding mode designation signal indicative of the one-sheet feeding mode to the lower-level management device 210. The lower-level management device 210 temporarily stores the received feeding mode designation signal in a given storage area of the working memory 230. Further, according to an order preparation instruction and the feeding mode designation signal, the lower-level management device 210 issues an instruction for adjusting a rotational phase of each of the printing cylinders 30A, 31A, an instruction for positioning the slotter blades, and an instruction for adjusting a rotational phase of each of the punching dies 52A1, 52A2, respectively, to the printing control device 251, the creaser-slotter control device 252 and the die cutter control device 253.

(Creation of Roller Speed Control Pattern RT)

Upon detecting an input manipulation complete signal from the operation panel 240 after receiving from the upper-level management device 200 the order preparation instruction for preparing for execution of a processing order, the lower-level management device 210 reads out the feeding mode designation signal from the working memory 230 and sends the read-out feeding mode designation signal and the received order preparation instruction to the roller motor control device 254. In response to the feeding mode designation signal, the roller motor control device 254 reads out, from the basic roller drive pattern memory 261, the basic roller drive pattern BRP1 for the one-sheet feeding mode, and generates a roller speed control pattern creation instruction. The roller motor control device 254 sends the roller speed control pattern creation instruction to the first motion controller 260.

Upon receiving the roller speed control pattern creation instruction from the roller motor control device 254, the first motion controller 260 reads out the roller speed control pattern creation program from the program memory 262, and executes the read-out roller speed control pattern creation program. According to the execution of the roller speed control pattern creation program, the first motion controller 260 creates a roller speed control pattern RT1 for the one-sheet feeding mode, based on a sheet conveyance speed contained in the roller speed control pattern creation instruction, and the basic roller drive pattern BRP1, and temporarily stores the roller speed control pattern RT1 in the speed control pattern memory 263.

Figure 27:
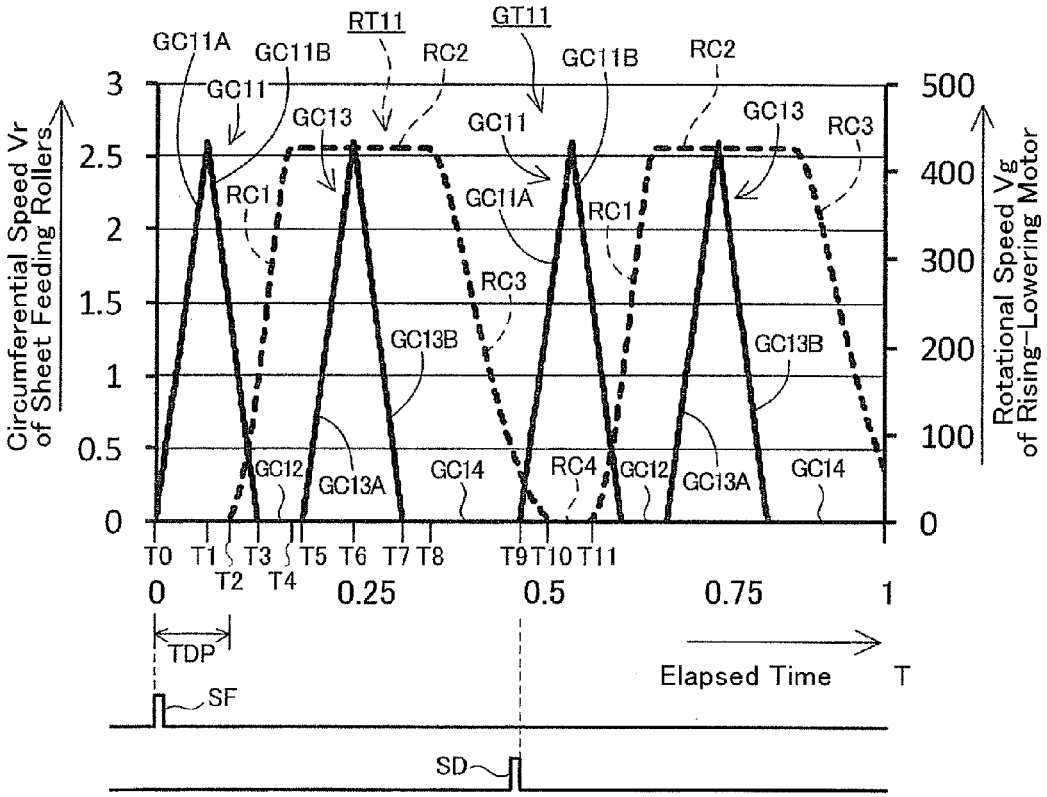
FIG. 27 is a timing chart presenting a temporal relationship between respective ones of a roller speed control pattern RT11, an up-and-down speed control pattern GT11, the feeding start signal SF and the detection signal SD each set for the one-sheet feeding mode, in the corrugated paperboard sheet feeding apparatus according to this embodiment.

A process for creating the roller speed control pattern RT1 for the one-sheet feeding mode is the same as that for creating the roller speed control pattern RT2 for the two-sheet feeding mode, and therefore its description will be omitted. In the case where the designated feeding speed of corrugated paperboard sheets SH in the one-sheet feeding mode is 120 sheets/min, a roller speed control pattern RT11 illustrated in FIG. 27 is created. FIG. 27 is a timing chart presenting a temporal relationship between respective ones of the roller speed control pattern RT11 indicated by the broken lines, an up-and-down speed control pattern GT11 indicated by the solid lines, the feeding start signal SF from the operation panel 240, and the detection signal SD from the rotational position sensor 190. In FIG. 27, the horizontal axis represents the elapsed time T by seconds, and the left vertical axis and the right vertical axis represent, respectively, the circumferential speed Vr of each of the sheet feeding rollers by m/sec, and the rotational speed Vg of the up-and-down motor 80 by rpm.

The roller speed control pattern RT11 is formed for each processing cycle. The roller speed control pattern RT11 comprises, within 0.5 sec, an acceleration region RC1, a constant-speed region RC2, a deceleration region RC3, and a stop region RC4. The acceleration region RC1, the constant-speed region RC2, the deceleration region RC3 and the stop region RC4 in the roller speed control pattern RT11 correspond, respectively, to the acceleration region BR11, the constant-speed region BR12, the deceleration region BR13 and the stop region BR14 in the basic roller drive pattern BRP1 illustrated in FIG. 8.

(Creation of Order-Specific Up-and-Down Pattern DGP)

Upon receiving from the upper-level management device 200 the order preparation instruction for preparing for execution of the processing order, the lower-level management device 210 reads out the up-and-down pattern creation program stored in the program memory 220 and executes the read-out up-and-down pattern creation program. According to the execution of the up-and-down pattern creation program, the lower-level management device 210 creates an order-specific up-and-down pattern DGP conforming to the sheet length of the processing order, based on one of the four basic up-and-down patterns BGS1, BGL1, BGS2, BGL2 stored in the basic up-and-down pattern memory 270, and temporarily stores the created order-specific up-and-down pattern DGP in the order-specific up-and-down pattern memory 271. The sheet length of the processing order is designated in a range of a minimum sheet length to a maximum sheet length processable in the one-sheet feeding mode. The minimum sheet length processable in the one-sheet feeding mode is set based on the distance LF in FIG. 1, and the maximum sheet length processable in the one-sheet feeding mode is set based on an overall outer peripheral length of each of the printing cylinders. In this embodiment, the lower-level management device 210 reads out a basic up-and-down pattern designed for the one-sheet feeding mode in conformity to the sheet length of the processing order, according to the sheet length of the processing order contained in the order preparation instruction, and the feeding mode designation signal, and creates an order-specific up-and-down pattern DGP.

In the case where the sheet length of the processing order is an intermediate length between the minimum sheet length and the maximum sheet length, e.g., 720 mm, an order-specific up-and-down pattern DGP1 is formed in conformity to the sheet length of the processing order, based on the basic up-and-down pattern BGL1 for the one-sheet feeding mode. A process for creating the order-specific up-and-down pattern DGP in the one-sheet feeding mode is the same as that for creating the order-specific up-and-down pattern DGP in the two-sheet feeding mode, and therefore its description will be omitted.

(Creation of Up-and-Down Speed Control Pattern GT)

After creating the order-specific up-and-down pattern DGP1, the lower-level management device 210 generates an up-and-down speed control pattern creation instruction and sends the generated up-and-down speed control pattern creation instruction to the second motion controller 280. Upon receiving the up-and-down speed control pattern creation instruction from the lower-level management device 210, the second motion controller 280 reads out the up-and-down speed control pattern creation program from the program memory 281, and executes the read-out up-and-down speed control pattern creation program. According to the execution of the up-and-down speed control pattern creation program, the second motion controller 280 creates an up-and-down speed control pattern GT, based on a sheet conveyance speed contained in the up-and-down speed control pattern creation instruction, and the order-specific up-and-down pattern DGP1, and temporarily stores the created up-and-down speed control pattern GT in the speed control pattern memory 282.

In FIG. 27, the up-and-down speed control pattern GT11 indicated by the solid lines is designed to provide instructions on the rotational speed Vg of the up-and-down motor 80 in the case where the designated feeding speed of corrugated paperboard sheets SH in the one-sheet feeding mode is 120 sheets/min. The up-and-down speed control pattern GT11 is created for each processing cycle. The up-and-down speed control pattern GT11 comprises, within 0.5 sec, a first region GC11, a second region GC12, a third region GC13, and a fourth region GC14. A process for creating the up-and-down speed control pattern GT11 for the one-sheet feeding mode is the same as that for creating the up-and-down speed control pattern GT21 for the two-sheet feeding mode, and therefore its description will be omitted.

(Feeding Operation of Corrugated Paperboard Sheet SH)

Figure 28:
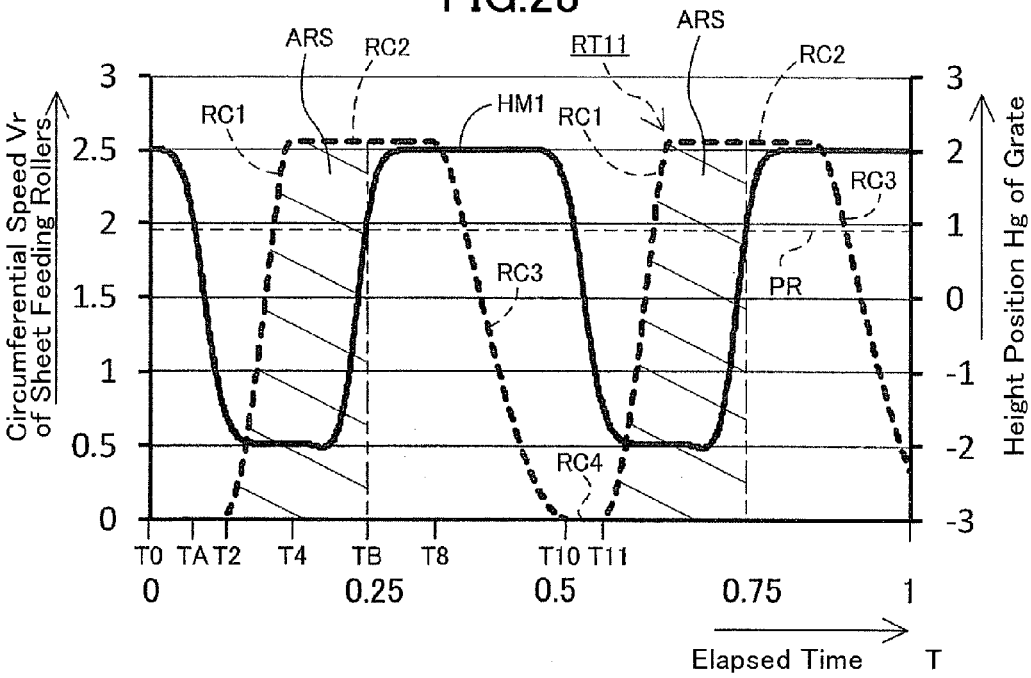
FIG. 28 is a timing chart presenting a temporal relationship between the roller speed control pattern RT11 and a curve HM1 representing a change in height position Hg of the grate each set for the one-sheet feeding mode, in the corrugated paperboard sheet feeding apparatus according to this embodiment.

With reference to FIGS. 27 and 28, an operation of feeding corrugated paperboard sheets SH under the condition that the feeding speed is 120 sheets/min in the one-sheet feeding mode will be described. FIG. 28 is a timing chart presenting a temporal relationship between respective ones of the roller speed control pattern RT11, and a curve HM1 representing a change in height position Hg of each of the grates 141. In FIG. 28, the horizontal axis represents the elapsed time T by seconds, and the left vertical axis and the right vertical axis represent, respectively, the circumferential speed Vr of each of the sheet feeding rollers by m/sec, and the height position Hg of the upper surface of each of the grates 141 by mm.

After completion of the preparation for execution of the processing order, when an operator manipulates the feeding button 241, the lower-level management device 210 receives the feeding start signal SF from the operation panel 240. In response to the received feeding start signal SF, the lower-level management device 210 sends control instruction information containing the feeding start instruction and the sheet conveyance speed to each of the drive control device 250 and the roller motor control device 254, and sends, as the motion start instruction, the control instruction information to the second motion controller 280.

In conformity to the sheet conveyance speed contained in the control instruction information, the drive control device 250 rotationally drives the main drive motor MT at a rotational speed corresponding to the sheet conveyance speed. Along with the rotation of the main drive motor MT, the printing cylinders 30A, 31A of the printing units 30, 31, the upper Blotters of the slotter units 41, 42 and others are rotated at a feeding speed corresponding to the sheet conveyance speed, e.g., at the designated feeding speed, 120 sheets/min.

In response to the motion start instruction, the second motion controller 280 reads out each of the speed control instructions of the up-and-down speed control pattern GT11 from the speed control pattern memory 282 with a given control cycle, and sequentially send the read-out speed control instructions to the drive control circuit 283. Based on the speed control instructions, and a frequency of the rotation pulses from the encoder 85, the drive control circuit 283 controls the rotational speed of the up-and-down motor 80.

As illustrated in FIG. 27, the rotational speed of the up-and-down motor 80 is accelerated from a time point T0 just after the generation of the feeding start signal SF at the speed change rate per unit time in an acceleration sub-region GC11A. When the elapsed time T reaches a time point T1, the rotational speed of the up-and-down motor 80 is decelerated at the speed change rate per unit time in a deceleration sub-region GC11B. When the elapsed time T reaches a time point T3, the rotation of the up-and-down motor 80 is stopped. In a time period from the time point T0 to the time point T3, each of the grates 141 is moved down from the uppermost position and moved to the lowermost position. The upper surface of each of the grates 141 is moved down to reach the position PR of the uppermost point of the outer peripheral surface of each of the sheet feeding rollers, at a time point TA illustrated in FIG. 28, and, subsequently, further moved down toward the lowermost position.

In order to set a start time point T2 of the acceleration region RC1 of roller speed control pattern RT11, the roller motor control device 254 calculates a time period TDP from the time point T0 to the time point T2, based on the feeding speed corresponding to the sheet conveyance speed contained in the control instruction information, and the phase-difference set value DPP stored in the program memory 262. Until the elapsed time T becomes equal to the time period TDP, the roller motor control device 254 does not generate any motion start instruction. Thus, the drive control circuit 264 keeps the roller motors 90, 91, 102, 103 in the stopped state, in the time period TDP from the time point T0 just after the generation of the feeding start signal SF.

When the elapsed time T becomes equal to the time period TDP, the roller motor control device 254 generates the motion start instruction and sends it to the first motion controller 260. In response to the received motion start instruction, the first motion controller 260 reads out each of the speed control instructions of the roller speed control pattern RT11 from the speed control pattern memory 263 with a given control cycle, and, after converting the read-out speed control instructions to rotational speed control instructions to each of the roller motors, sequentially send the rotational speed control instructions to the drive control circuit 264. Specifically, the read-out speed control instructions are converted to rotational speed control instructions to each of the roller motors, based on the diameter Dr of each of the sheet feeding rollers. Based on the rotational speed control instructions, and the frequency of the rotation pulses from each of the group of encoders 100, 106, 112, 113, the drive control circuit 264 controls the rotational speed of each of the roller motors.

As illustrated in FIG. 27, the elapsed time T reaches the time point T2, the rotational speed of each of the roller motors is accelerated at the speed change rate per unit time in the acceleration region RC1. Thus, each of the sheet feeding rollers in the stopped state starts rotating. The time point T2 is later than the time point TA as illustrated in FIG. 28. Therefore, when each of the sheet feeding rollers starts rotating, the lower surface of a bottommost one of the stacked corrugated paperboard sheets SH is in contact with the sheet feed rollers, so that the bottommost corrugated paperboard sheet SH is fed out in the feeding direction FD.

According to the speed control instructions in the second region GC12, the up-and-down motor 80 is kept in the stopped state in a time period from the time point T3 to a time point 15. Subsequently, the up-and-down motor 80 is accelerated in a time period from the time point T5 to a time point T6, according to the speed control instructions in an acceleration sub-region GC13A of the third region GC13, and decelerated in a time period from the time point T6 to a time point T7, according to the speed control instructions in a deceleration sub-region GC13B of the third region GC13. In a time period from the time point T5 to the time point T7, each of the grates 141 is moved up from the lowermost position and moved to the uppermost position. The upper surface of each of the grates 141 is moved up to reach the position PR of the uppermost point of the outer peripheral surface of each of the sheet feeding rollers, at a time point TB illustrated in FIG. 28, and, subsequently, further moved up toward the uppermost position. In a time period from the time point T7 to a time point T9, the up-and-down motor 80 is kept in the stopped state according to the speed control instructions in the fourth region GC14. In order to generate the speed control instructions in a time period from the time point T0 to the time point T9, as a first readout operation, the second motion controller 280 reads out all of the speed control instructions in the four regions GC11 to GC14 of the up-and-down speed control pattern GT11, from the speed control pattern memory 282. All of the speed control instructions in the four regions GC11 to GC14 are used to feed a first corrugated paperboard sheet SH. In this embodiment, the feeding speed is 120 sheets/min. Thus, the time period from the time point T0 to the time point T9 is 0.5 sec.

When the elapsed time T reaches the time point 9, the lower-level management device 210 receives a first detection signal SD from the rotational position sensor 190. In response to receiving the detection signal SD, the lower-level management device 210 sends control instruction information containing the synchronization instruction and the sheet conveyance speed, to each of the drive control device 250 and the roller motor control device 254, and sends, as the motion start instruction, the control instruction information to the second motion controller 280. According to the sheet conveyance speed contained in the control instruction information, the drive control device 250 continues to rotationally drive the main drive motor MT at a rotational speed corresponding to the sheet conveyance speed.

In response to the motion start instruction, the second motion controller 280 reads out each of the speed control instructions of the up-and-down speed control pattern GT11 from the speed control pattern memory 282 with a given control cycle, and sequentially send the read-out speed control instructions to the drive control circuit 283. As a second readout operation, the second motion controller 280 reads out all of the speed control instructions in the four regions GC11 to GC14 of the up-and-down speed control pattern GT11, from the speed control pattern memory 282. All of the speed control instructions in the four regions GC11 to GC14 are used to feed a second corrugated paperboard sheet SR After the time point T9, in response to each motion start instruction based on the detection signal SD, the second motion controller 280 repeatedly performs the same control processing as that in the time period from the time point T0 to the time point T9.

In a time period from the time point T2 to a time point T4, each of the roller motors is accelerated at the speed change rate per unit time in an acceleration region RC1, to a rotational speed corresponding to the designated feeding speed, 120 sheets/min. Subsequently, in a time period from the time point T4 to a time point T8, each of the roller motors is kept at a rotational speed corresponding to the designated feeding speed, in a constant-speed region RC2. In a time period from the time point T8 to a time point T10, each of the roller motors is decelerated from the designated feeding speed, at the speed change rate per unit time a deceleration region RC3. In a time period from the time point T10 to a time point T11, each of the roller motors is kept in the stopped state, in a stop region RC4. In order to generate the speed control instructions in a time period from the time point T2 to the time point T11, as a first readout operation, the first motion controller 260 reads out all of the speed control instructions in the four regions RC1 to RC4 of the roller speed control pattern RT11, from the speed control pattern memory 263. All of the speed control instructions in the four regions RC1 to RC4 are used to feed the first corrugated paperboard sheet SH. In this embodiment, the feeding speed is 120 sheets/min. Thus, the time period from the time point T2 to the time point T11 is 0.5 sec.

At the time point T11 after the elapse of the time period TDP from the time point T9 when receiving the synchronization instruction based on the detection signal SD, the roller motor control device 254 generates the motion start instruction and sends it to the first motion controller 260.

In response to the received motion start instruction, the first motion controller 260 reads out each of the speed control instructions of the roller speed control pattern RT11 from the speed control pattern memory 263 with a given control cycle, and sequentially send the read-out speed control instructions to the drive control circuit 264. As a second readout operation, the first motion controller 260 reads out all of the speed control instructions in the four regions RC1 to RC4 of the roller speed control pattern RT11, from the speed control pattern memory 263. All of the speed control instructions in the four regions RC1 to RC4 are used to feed the second corrugated paper board sheet. After the time point T11, in response to each motion start instruction based on the synchronization instruction, the first motion controller 260 repeatedly performs the same control processing as that in the time period from the time point T2 to the time point T11.

The first corrugated paperboard sheet SH starts to be fed from the time point T2, and is released from the sheet feeding rollers at the time point TB. A distance by which the first corrugated paperboard sheet SH is fed by the sheet feeding rollers corresponds to an area ARS of the shaded region in FIG. 28, and depends on the sheet length.

Advantageous Effects of Embodiment

In the corrugated paperboard sheet feeding apparatus according to the above embodiment, it is only necessary to control the unidirectional rotation of the up-and-down motor 80, without any need to control a rotational position of the up-and-down motor in two different rotational directions, so that it becomes possible to accurately control a feeding timing and a feeding amount of each corrugated paperboard sheet SH.

In the above embodiment, as compared to a corrugated paperboard sheet feeding apparatus configured to preliminarily store in a storage section various up-and-down control pattern set in conformity to desired sheet lengths, feeding speeds and feeding modes, it becomes possible to cope with various orders different in sheet length and feeding speed, and create various up-and-down speed control pattern using a relatively small amount of data and a relatively small number of control instructions.

In the above embodiment, as compared to a conventional corrugated paperboard sheet feeding apparatus configured to adjust a position of a mechanical element such as an up-and-down control cam, it becomes possible to change an up-and-down motion of each of the grates 141 easily and accurately in conformity to a sheet length of a processing order by changing respective durations of the second region and the fourth region during creation of the up-and-down speed control pattern GT21.

In the above embodiment, it becomes possible to exactly synchronize a timing at which the up-and-down drive shaft 170 reaches a given rotational position with a timing at which each speed control instruction of the up-and-down speed control pattern GT21 is generated. In the above embodiment, the given rotational position of the up-and-down drive shaft 170 is a rotational position of the up-and-down drive shaft 170 at a time when each of the grates 141 reaches the uppermost position. Thus, it becomes possible to allow each of the grates 141 to be moved down exactly from the uppermost position according to the up-and-down speed control pattern GT21.

In the above embodiment, the large number of sheet feeding rollers 124 to 127 are in the stopped state in the stop region RC4 of the roller speed control pattern RT21, and each of the grates 141 is moved down below the large number of sheet feeding rollers 124 to 127 being in the stopped state, in the first region GC21 of the up-and-down speed control pattern GT21. Thus, in a situation where a bottommost one of the stacked corrugated paperboard sheets SH initially comes into contact with the large number of sheet feeding rollers 124 to 127, it becomes possible to prevent the occurrence of slipping therebetween. Thus, each corrugated paperboard sheet SH can be more accurately fed.

In the above embodiment, a phase relationship between each region of the roller speed control pattern RT21 and each region of the up-and-down speed control pattern GT21 can be maintained in a certain relationship, irrespective of a change in the feeding speed, so that it becomes possible to accurately perform the feeding operation for corrugated paperboard sheets SH.

Generally, when the feeding mode is changed between the one-sheet feeding mode and the two-sheet feeding mode, it is necessary to perform preparatory works, such as replacement of a printing die member, replacement of a slotter blade and replacement of a punching die. The corrugated paperboard sheet feeding apparatus according to the above embodiment is configured to allow an operator to manipulate the feeding mode designation keys 243 so as to designate the feeding mode. Thus, when the operator performs the manipulation for designating the feeding mode, he/she becomes aware of required preparatory works such as replacement of a printing die member, so that it becomes possible to reassure completion of preparatory works required for the designated feeding mode.

MODIFICATIONS

An advantageous embodiment of the present invention has been shown and described. It is obvious to those skilled in the art that various changes and modifications may be made therein without departing from the spirit and scope thereof as set forth in appended claims.

In the above embodiment, the up-and-down speed control pattern GT21 is configured such that respective rates of change of speed per unit time in the acceleration sub-region GC21A, the deceleration sub-region GC21B, the acceleration sub-region GC23A and the deceleration sub-region GC23B are set to the same value. However, the rates of change of speed per unit time in the four sub-regions need not be the same. For example, the speed change rate per unit time in each of the acceleration sub-regions GC21A, GC23A may be set to become different from the speed change rate per unit time in each of the deceleration sub-regions GC21B, GC23B. Alternatively, the speed change rate per unit time in each of the acceleration sub-region GC21A and the deceleration sub-regions GC21B may be set to become different from the speed change rate per unit time in each of the acceleration sub-region GC23A and the deceleration sub-region GC23B.

The invention claimed is:

1. A corrugated paperboard sheet feeding apparatus comprising:

a plurality of sheet feeding rollers rotatable to feed a bottommost one of a plurality of stacked corrugated paperboard sheets;

an up-and-down member movable up and down with respect to the plurality of sheet feeding rollers;

a drive motor for causing the up-and-down member to be moved up and down;

a motion conversion mechanism configured to convert a unidirectional rotation of the drive motor into a motion for causing the up-and-down member to be moved up and down, and transmit the converted motion to the up-and-down; and an up-and-down control section configured to perform variable speed control for the unidirectional rotation of the drive motor, according to a given up-and-down speed control pattern, wherein the up-and-down control section is operable to change the up-and-down speed control pattern in conformity to a sheet length of the corrugated paperboard sheet in a feeding direction, wherein the up-and-down speed control pattern is set to cause the up-and-down member to undergo one cycle of up-and-down motion, the up-and-down speed control pattern comprising:

a first region for moving down the up-and-down member which is located above the plurality of sheet feeding rollers, the first region comprising sub-regions for acceleration and deceleration of the drive motor;

a second region for controlling the rotation of the drive motor to allow the up-and-down member to be located below the plurality of sheet feeding rollers;

a third region for moving up the up-and-down member which is located below the plurality of sheet feeding rollers, the third region comprising sub-regions for acceleration and deceleration of the drive motor; and a fourth region for controlling the rotation of the drive motor to allow the up-and-down member to be located above the plurality of sheet feeding rollers.

2. The corrugated paperboard sheet feeding apparatus according to claim 1, wherein the up-and-down control section is operable to change a time interval between the first region and the third region of the up-and-down speed control pattern, in conformity to the sheet length, in such a manner that, as the sheet length of the corrugated paperboard sheet in the feeding direction becomes longer, a duration of the second region becomes longer, and a duration of the fourth region becomes shorter.

3. The corrugated paperboard sheet feeding apparatus according to claim 1, which further comprises:

a roller motor for rotating the plurality of sheet feeding rollers; and a roller control section configured to operate in synchronization with the variable speed control by the up-and-down control section, to perform variable speed control for a rotation of the roller motor, according to a roller speed control pattern, wherein the roller control section is operable to change the roller speed control pattern in conformity to a maximum sheet length of the corrugated paperboard sheet feedable in the feeding direction, and a feeding speed of the corrugated paperboard sheet, and wherein the roller speed control pattern is set to cause the plurality of sheet feeding rollers to operate to feed one corrugated paperboard sheet, the roller speed control pattern comprising:

a stopping region for stopping the rotation of the roller motor;

an acceleration region for accelerating the roller motor from a stopped state thereof to a given rotational speed corresponding to the feeding speed;

a constant-speed region for rotating the roller motor at a given rotational speed; and a deceleration region for decelerating the roller motor from the given rotational speed to the stopped state.

4. The corrugated paperboard sheet feeding apparatus according to claim 3, wherein each of the up-and-down control section and the roller control section is operable to set a respective one of the up-and-down speed control pattern and the roller speed control pattern, in such a manner that the second region of the up-and-down speed control pattern and a combination of the acceleration region and the constant-speed region of the roller speed control pattern overlap each other in terms of control timing, and the fourth region of the up-and-down speed control pattern and the deceleration region of the roller speed control pattern overlap each other in terms of control timing, and wherein a rate of change of speed per unit time at which the rotation of the roller motor is accelerated in the acceleration region of the roller speed control pattern is set to be greater than a rate of change of speed per unit time at which the rotation of the roller motor is decelerated in the deceleration region of the roller speed control pattern.

5. The corrugated paperboard sheet feeding apparatus according to claim 4, wherein the up-and-down control section is operable, in the second region of the up-and-down speed control pattern, to stop the rotation of the drive motor so as to keep the up-and-down member at a lower position below the plurality of sheet feeding rollers, and, in the fourth control region the up-and-down speed control pattern, to stop the rotation of the drive motor so as to keep the up-and-down member at an upper position above the plurality of sheet feeding rollers, and wherein the roller control section is operable to set the roller speed control pattern, in such a manner that the constant-speed region of the roller speed control pattern is continued until a bottommost one of the corrugated paperboard sheets is spaced apart the plurality of sheet feeding rollers when the up-and-down member is moved up from the lower position toward the upper position, wherein the constant-speed region is terminated before termination of the third region of the up-and-down speed control pattern set in conformity to the maximum sheet length.

6. The corrugated paperboard sheet feeding apparatus according to claim 1, wherein the motion conversion mechanism comprises:

a drive shaft configured to receive transmission of the unidirectional rotation of the drive motor to rotate 360 degrees during one cycle of up-and-down motion of the up-and-down member;

an eccentric member formed eccentrically with respect to an axis of the drive shaft and fixed to the drive shaft;

a support mechanism supporting the up-and-down member in a movable up and down manner;

a coupling shaft coupled to the support mechanism; and a swingable member fixed to the coupling shaft and configured to be swung about the coupling shaft while being engaged with the eccentric member, and wherein the up-and-down member is configured to undergo the up-and-down motion, according to two contra-directional rotational movements of the coupling shaft along with the swinging motion of the swingable member, and wherein the corrugated paperboard sheet feeding apparatus further comprises a detection section configured to detect a rotational position of the drive shaft and generate a position detection signal, and the up-and-down control section is operable to perform variable speed control for the unidirectional rotation of the drive motor, in synchronization of the position detection signal from the detection section.

7. The corrugated paperboard sheet feeding apparatus according to claim 1, which comprises a mode setting section configured to selectively set one of a one-sheet feeding mode for feeding one corrugated paperboard sheet in a given processing cycle during which a printing cylinder of a printing apparatus is rotated 360 degrees, and a two-sheet feeding mode for sequentially feeding two corrugated paperboard sheets in the given processing cycle, wherein the up-and-down control section is operable to change the up-and-down speed control pattern in conformity to one of the feeding modes set by the mode setting section.

8. The corrugated paperboard sheet feeding apparatus according to claim 7, wherein the mode setting section comprises an operation section configured to select one of the one-sheet feeding mode and the two-sheet feeding mode, and a display configured to display thereon the selected feeding mode.

* * * * *